US009964877B2

(12) United States Patent
Kuribayashi et al.

(10) Patent No.: US 9,964,877 B2
(45) **Date of Patent: *May 8, 2018**

(54) IMAGE FORMING APPARATUS

(71) Applicant: FUJI XEROX CO., LTD., Tokyo (JP)

(72) Inventors: Masataka Kuribayashi, Kanagawa (JP); Naoki Ota, Kanagawa (JP); Takafumi Koide, Kanagawa (JP); Yusuke Fukuda, Kanagawa (JP); Katsuyuki Kitajima, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/422,840

(22) Filed: Feb. 2, 2017

(65) Prior Publication Data

US 2018/0004107 A1 Jan. 4, 2018

(30) Foreign Application Priority Data

Jul. 1, 2016 (JP) ..... 2016-132008

(51) Int. Cl.

| | |
|---|---|
| ***G03G 9/087*** | (2006.01) |
| ***G03G 21/00*** | (2006.01) |
| ***G03G 15/08*** | (2006.01) |
| ***G03G 9/08*** | (2006.01) |
| ***G03G 9/09*** | (2006.01) |
| ***G03G 15/00*** | (2006.01) |

(52) U.S. Cl.

CPC ..... *G03G 9/0827* (2013.01); *G03G 9/0819* (2013.01); *G03G 9/08711* (2013.01); *G03G 9/08755* (2013.01); *G03G 9/0918* (2013.01); *G03G 15/00* (2013.01); *G03G 21/0011* (2013.01)

(58) Field of Classification Search

CPC ..... G03G 9/0827; G03G 9/0819; G03G 5/14713; G03G 21/0011

USPC ... 430/110.3, 110.4, 119.71, 119.82, 119.83, 430/119.86

See application file for complete search history.

(56) References Cited

U.S. PATENT DOCUMENTS

| | | | | |
|---|---|---|---|---|
| 8,431,301 | B2 * | 4/2013 | Ninomiya ..... | G03G 9/0819 430/109.4 |
| 8,741,512 | B2 * | 6/2014 | Iwasaki ..... | C07C 219/32 430/58.65 |
| 2008/0227014 | A1 | 9/2008 | Mizuguchi et al. | |
| 2009/0233210 | A1 | 9/2009 | Ninomiya et al. | |
| 2013/0089359 | A1 | 4/2013 | Mizuguchi et al. | |

FOREIGN PATENT DOCUMENTS

| | | | |
|---|---|---|---|
| JP | 2008-225120 | A | 9/2008 |
| JP | 2009-223055 | A | 10/2009 |
| JP | 2010-134124 | A | 6/2010 |

* cited by examiner

*Primary Examiner* — Janis L Dote
(74) *Attorney, Agent, or Firm* — Oliff PLC

(57) ABSTRACT

An image forming apparatus includes an electrophotographic photoreceptor having an overcoat layer and a cleaning unit that includes a cleaning blade and a tip of the cleaning blade contacts with the photoreceptor toward the direction opposite to the rotation direction, wherein the toner particle contains a crystalline polyester resin, an average circularity of the toner particles is from 0.955 to 0.971, a content ratio of the toner particles having a particle diameter of 4.5 μm or more and less than 7.5 μm and a circularity of 0.980 or more is from 16% by number to 40% by number, and a content ratio of the toner particles having a particle diameter of 7.5 μm or more and less than 15 μm and a circularity of 0.900 or more and less than 0.940 is 3% by number or less.

9 Claims, 6 Drawing Sheets

IMAGE FORMING APPARATUS

CROSS-REFERENCE TO RELATED APPLICATIONS

This application is based on and claims priority under 35 USC 119 from Japanese Patent Application No. 2016-132008 filed Jul. 1, 2016.

BACKGROUND

1. Technical Field

The present invention relates to an image forming apparatus.

2. Related Art

Image forming by using an electrophotographic method is performed in such a manner that the entire surface of a photoreceptor is charged, the surface of the photoreceptor is exposed to a laser beam in accordance with image information data so as to form an electrostatic latent image, subsequently, the electrostatic latent image is developed with a developer including toner to form a toner image, and lastly the toner image is transferred and fixed to a surface of a recording medium.

SUMMARY

According to an aspect of the invention, there is provided an image forming apparatus including:

an electrophotographic photoreceptor that is provided with a photosensitive layer and an overcoat layer on an electroconductive substrate in this order;

a charge unit that charges a surface of the electrophotographic photoreceptor;

an electrostatic latent image forming unit that forms an electrostatic latent image on the charged surface of the electrophotographic photoreceptor;

a developing unit that contains a developer containing toner particles, and develops the electrostatic latent image formed on the surface of the electrophotographic photoreceptor with the developer to form a toner image;

a transfer unit that transfers the toner image to a surface of a recording medium;

a cleaning unit that includes a cleaning blade and a tip of the cleaning blade contacts with the electrophotographic photoreceptor toward the direction opposite to a rotation direction of the electrophotographic photoreceptor to remove a residue on the surface of the electrophotographic photoreceptor; and a fixing unit that fixes the toner image transferred on the recording medium, wherein the toner particle contains a binder resin containing a crystalline polyester resin, a colorant, and a release agent, an average circularity of the toner particles is from 0.955 to 0.971, a content ratio of the toner particles having a particle diameter of 4.5 μm or more and less than 7.5 μm and a circularity of 0.980 or more is in a range of 16% by number to 40% by number, and a content ratio of the toner particles having a particle diameter of 7.5 μm or more and less than 15 μm and a circularity of 0.900 or more and less than 0.940 is 3% by number or less.

BRIEF DESCRIPTION OF THE DRAWINGS

Exemplary embodiments of the present invention will be described in detail based on the following figures, wherein.

DETAILED DESCRIPTION

Figure 1:
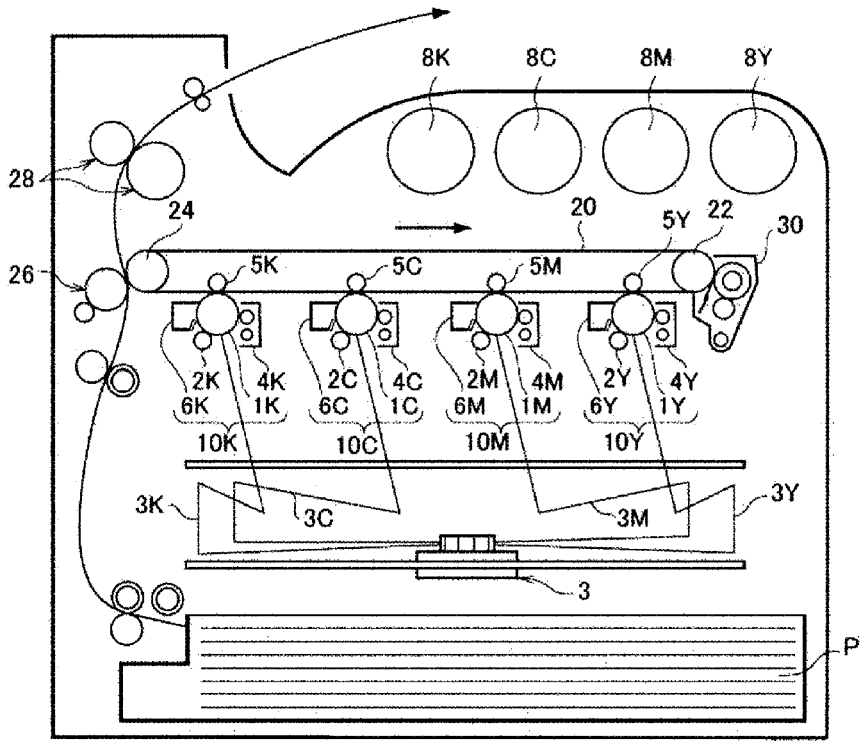
FIG. 1 illustrates the structure of an image forming apparatus according to an exemplary embodiment of the present invention.

Hereinafter, the exemplary embodiment which is an example of the invention will be described in detail.

Image Forming Apparatus/Image Forming Method

An image forming apparatus according to an exemplary embodiment includes an electrophotographic photoreceptor (hereinafter, referred to as "a specific photoreceptor" in some cases) that includes a photosensitive layer and an overcoat layer on an electroconductive substrate in this order; a charge unit that charges the surface of the specific photoreceptor; an electrostatic latent image forming unit that forms an electrostatic latent image on the charged surface of the specific photoreceptor; a developing unit that contains a developer containing a specific toner described lager, and develops the electrostatic latent image formed on the specific photoreceptor with the developer so as to form a toner image; a transfer unit that transfers the toner image to a surface of a recording medium; a cleaning unit (hereinafter, referred to as "a specific cleaning unit" in some cases) that includes a cleaning blade, and a tip of the cleaning blade contacts with the specific photoreceptor toward the direction opposite to the rotation direction the specific photoreceptor to remove a residue on the surface; and a fixing unit that fixes the toner image transferred to the recording medium.

In the related art, an electrophotographic photoreceptor which is provided with a photosensitive layer and an overcoat layer on the electroconductive substrate in this order is used for the image forming apparatus. Particularly, from the aspect that the electrophotographic photoreceptor has a long lifespan, and may continuously form images, for example, an electrophotographic photoreceptor (corresponding to the photoreceptor in the image forming apparatus of the exemplary embodiment) including an overcoat layer on a charge generation layer and a charge transport layer (hereinafter, the charge generation layer and the charge transport layer may be generally referred to as "a photosensitive layer") is used.

On the other hand, the image forming apparatus utilizing the electrophotographic method is provided with units, such as a charge unit and a transfer unit that perform discharge, around the electrophotographic photoreceptor. In accordance with the discharge of the units, in the image forming apparatus, oxygen and nitrogen in the air react with each other so as to generate so-called corona products. When the corona products are attached onto the surface of the electrophotographic photoreceptor, the attached corona products absorb the moisture under the high temperature and high humidity environment (for example, temperature of 28° C. and humidity of 85% RH), and the surface resistance of the electrophotographic photoreceptor is decreased. For this reason, it is hardly to hold the electrostatic latent image on the photoreceptor, and thus an image flow is likely to occur.

In a case of the image forming apparatus including the electrophotographic photoreceptor in which the overcoat layer is not formed, the corona products are removed from the surface of the electrophotographic photoreceptor through the action such as being scraped together with the surface layer portion of the photosensitive layer by the cleaning blade, and thus the occurrence of the image flow is easily prevent.

However, in the photoreceptor (the specific photoreceptor) including the overcoat layer, the overcoat layer is harder than the photosensitive layer, and thus the action such as being scraped together with the surface layer portion of the photosensitive layer by the cleaning blade does not easily occur. Particularly, in a case where an overcoat layer is formed of a cured material of a composition containing a compound having at least one of an acryloyl group and a methacryloyl group, the overcoat layer becomes harder, and thus the action of scrapping does not easily occur. For this reason, in the image forming apparatus including the specific photoreceptor, the corona products attached on the surface of the overcoat layer are not easily removed by the cleaning blade, and thus the image flow easily occur under the high temperature and high humidity environment.

In contrast, the image forming apparatus according to exemplary embodiment is provided with a specific photoreceptor including an overcoat layer, a specific cleaning unit including a cleaning blade, and a developing unit that contains a developer containing a specific toner.

The specific toner contains a binder resin containing a crystalline polyester resin, a colorant, and a release agent, and includes toner particles of which the average circularity is in a range of 0.955 to 0.971, the particle diameter is in a range of 4.5 μm or more and less than 7.5 μm, the circularity is 0.980 or more, and the content ratio of the toner particles is in a range of 16% by number to 40% by number, and the toner particles of which the particle diameter is 7.5 μm or more and less than 15 μm, the circularity is 0.900 or more and less than 0.940, and the content ratio of the toner particles is 3% by number or less.

In the specific toner having the average circularity within the above range, the content ratio of the toner particles having coarse particle diameter and low circularity is small, and the content ratio of the toner particles having almost spherical shape with a small diameter is large. In the image forming apparatus according to exemplary embodiment, the occurrence of the image flow is prevented by using the specific toner satisfying the above-described condition range under the high temperature and high humidity environment. Although the reason is not clear, the following reasons may be presumed.

Figure 6:
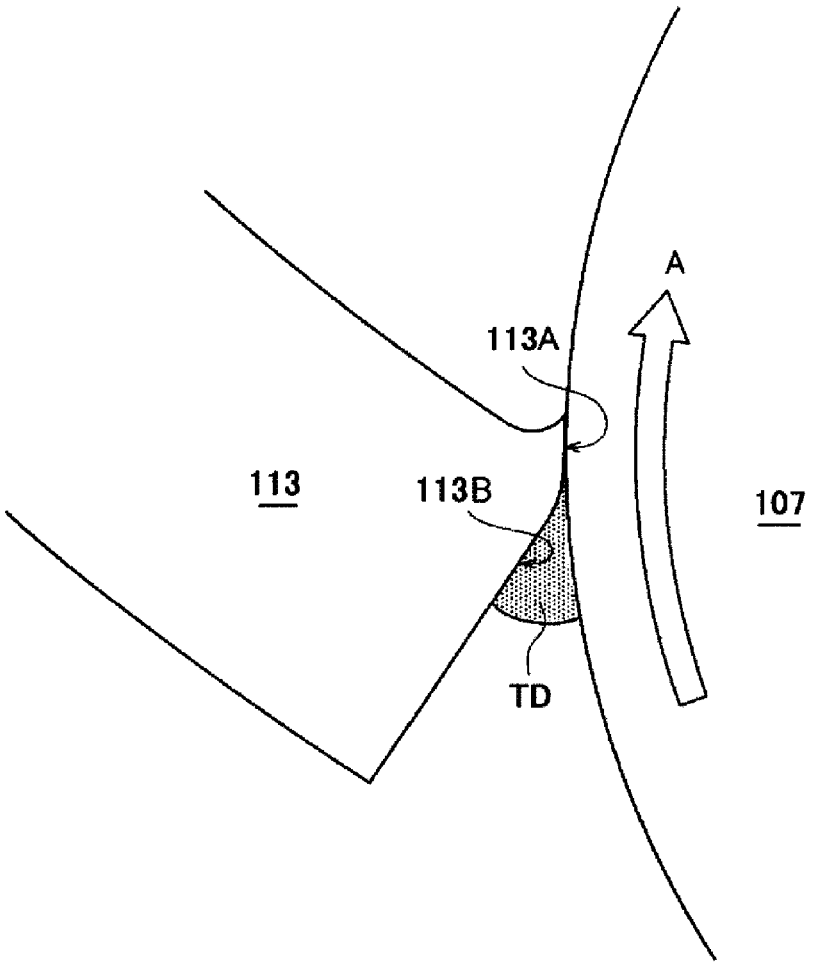
FIG. 6 illustrates enlarged schematic view of the cleaning blade in the image forming apparatus according to the exemplary embodiment.

FIG. 6 is enlarged schematic view illustrating enlarged vicinity of the cleaning blade in the image forming apparatus according to the exemplary embodiment. As illustrated in FIG. 6, a tip of the cleaning blade 113 is directed to the direction opposite to the rotation direction (direction of arrow A) of the electrophotographic photoreceptor 107, and concurrently contacts with the electrophotographic photoreceptor 107. In addition, when the cleaning blade 113 is disposed, a gap (hereinafter, the gap is referred to as "a pre nip portion 113B") between the electrophotographic photoreceptor 107 and the cleaning blade 113 is generated on the upstream side of the rotation direction of the electrophotographic photoreceptor 107 from the contact portion between the electrophotographic photoreceptor 107 and the cleaning blade 113 (hereinafter, the contact portion is referred to as "a nip portion 113A").

During the rotation of an electrophotographic photoreceptor 107, by a dynamic frictional force generated between the surface of the electrophotographic photoreceptor 107 and a nip portion 113A of a cleaning blade 113, the nip portion 113A is deformed in a state of being pulled in the rotation direction (direction of arrow A) of the electrophotographic photoreceptor 107, and a tip angle is formed into a wedge shape. In addition, when the electrophotographic photoreceptor 107 is rotated, a residual matter of toner (hereinafter, the residual matter of toner is also referred to as "a toner dam TD") is formed in a pre nip portion 113B.

Here, when an image is formed by using the specific toner in the developing unit provided in the image forming apparatus according to the exemplary embodiment, the toner dam TD is formed by the residual toner after transferring the specific toner in the pre nip portion 113B. In the toner dam TD, the toner particles of the specific toner are closet packed by the shape property of having the specific toner, and thus the specific toner is further likely to exist in the vicinity of the nip portion 113A. For this reason, the deformation of the nip portion 113A due to the toner dam TD formed by the specific toner becomes larger, and the dynamic frictional force between the surface of the electrophotographic photoreceptor 107 and the nip portion 113A is enhanced, and the load of the nip portion 113A with respect to the electrophotographic photoreceptor 107 becomes larger. In addition, the surface of the electrophotographic photoreceptor 107 is stably cleaned by the cleaning blade 113, and thus the corona products are easily removed. As a result, it is considered that in the image forming apparatus according to exemplary embodiment, the occurrence of the image flow is prevented under the high temperature and high humidity environment.

Meanwhile, in a case where the toner shape is formed into an almost spherical shape which is beyond the range of the above-described specific toner shape (that is, in a case where the content ratio of the particles having a particle diameter of 4.5 μm or more and less than 7.5 μm, and a circularity of 0.980 or more is greater than 40% by number and the average circularity is greater than 0.971), the toner dam formed by the specific toner is likely to become larger, the deformation of the nip portion becomes further larger, and thus it becomes hard to maintain the state of the toner dam. For this reason, the cleaning properties of the toner are deteriorated, and toner easily passes through. The toner easily passing through tends to be manifest as a streaky defect on the image.

The rotational speed of the electrophotographic photoreceptor is preferably 300 mm/s or more.

As described above, in the image forming apparatus according to exemplary embodiment, the occurrence of the image flow is prevented by using the specific toner under the high temperature and high humidity environment.

In the image forming apparatus according to exemplary embodiment, an image forming method is performed, and the method includes a charging step of charging the surface of the specific photoreceptor, an electrostatic latent image forming step of forming an electrostatic latent image on the charged specific photoreceptor, a developing step of developing the electrostatic latent image formed on the surface of the specific photoreceptor by a developer containing the specific toner described later so as to form a toner image, a transfer step of transferring the toner image to the surface of the recording medium, and a cleaning step of including a cleaning blade, and removing residues on the surface of the specific photoreceptor by contact the tip of the cleaning blade with the specific photoreceptor toward the direction opposite to the rotation direction, and a fixing step of fixing the toner image transferred to the recording medium.

Configuration of Image Forming Apparatus

As the image forming apparatus according to the exemplary embodiment, well-known image forming apparatuses such as an apparatus including a direct-transfer type apparatus that directly transfers the toner image formed on the surface of the electrophotographic photoreceptor to the recording medium; an intermediate transfer type apparatus that primarily transfers the toner image formed on the surface of the electrophotographic photoreceptor to a surface of an intermediate transfer member, and secondarily transfers the toner image transferred to the intermediate transfer member to the surface of the recording medium; an apparatus includes an erasing unit that erases charges by irradiating the electrophotographic photoreceptor with erasing light before being charged and after transferring the toner image; and an apparatus including an electrophotographic photoreceptor heating member that increases the temperature of the electrophotographic photoreceptor so as to decrease a relative temperature are employed.

In a case where the intermediate transfer type apparatus is used, the transfer unit is configured to include an intermediate transfer member that transfers the toner image to the surface, a primary transfer unit that primarily transfers the toner image formed on the surface of the electrophotographic photoreceptor to the surface of the intermediate transfer member, and a secondary transfer unit the toner image formed on the surface of the intermediate transfer member is secondarily transferred to the surface of the recording medium.

In the image forming apparatus according to the exemplary embodiment, for example, a unit including the electrophotographic photoreceptor may be a cartridge structure (process cartridge) which is detachable from the image forming apparatus. As a process cartridge, for example, a process cartridge including the specific photoreceptor having the above-described layer configuration and the above-described specific cleaning unit is preferably used. Further, in addition to the electrophotographic photoreceptor and the cleaning unit, at least one selected from the group consisting of a charge unit, an electrostatic latent image forming unit, a developing unit, and a transfer unit may be included in the process cartridge.

Hereinafter, an example of the image forming apparatus of the exemplary embodiment will be described; however, the invention is not limited thereto. Note that, in the drawing, major portions will be described, and others will not be described.

FIG. 1 illustrates the structure of an image forming apparatus according to an exemplary embodiment.

The image forming apparatus as illustrated in FIG. 1 has four electrophotographic image forming units 10Y, 10M, 10C, and 10K (image forming unit) that output an image for each color of yellow (Y), magenta (M), cyan (C), and black (K) based on color separated image data. These image forming units 10Y, 10M, 10C, and 10K (hereinafter, simply referred to as a "unit" in some cases) are arranged apart from each other by a predetermined distance in the horizontal direction. The units 10Y, 10M, 10C, and 10K may be the process cartridge which is detachable from the image forming apparatus.

As an intermediate transfer member, an intermediate transfer belt 20 passing through the respective units is extended upward in the drawing of the respective units 10Y, 10M, 10C, and 10K. The intermediate transfer belt 20 is provided to be wound onto a support roller 24 and a driving roller 22 which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown), and thus a tension is applied to the intermediate transfer belt 20 which is wound onto both. Further, an intermediate transfer member cleaning device 30 is provided on the side surface of the image holding member of the intermediate transfer belt 20 so as to face the driving roller 22.

Each of developing devices (an example of the developing unit) 4Y, 4M, 4C, and 4K of the each of the units 10Y, 10M, 10C, and 10K contains the developer containing the toner. In addition, four colors toner of yellow, magenta, cyan, and black stored in toner cartridges 8Y, 8M, 8C, and 8K are correspondingly supplied to each of the developing devices 4Y, 4M, 4C, and 4K.

The first to fourth units 10Y, 10M, 10C, and 10K have the same configuration as each other, and thus the first unit 10Y for forming a yellow image disposed on the upstream side the travel direction of the intermediate transfer belt will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y includes a photoreceptor 1Y.

In the vicinity of the photoreceptor 1Y, a charging roller (an example of the charge unit) 2Y which charges the surface of the photoreceptor 1Y with a predetermined potential, an exposure device (an example of the electrostatic latent image forming unit) 3 which exposes the charged surface by using a laser beam 3Y based on color separated image signal so as to form an electrostatic latent image, a developing device (an example of the developing unit) 4Y which supplies the charged toner to the electrostatic latent image and develops the electrostatic latent image, a primary transfer roller 5Y (an example of the transfer unit) which transfers the developed toner image onto the intermediate transfer belt 20, and a photoreceptor cleaning device (an example of the cleaning unit) 6Y which removes the residues remaining on the surface of the photoreceptor 1Y after primary transfer are sequentially disposed.

The primary transfer roller 5Y is disposed inside the intermediate transfer belt 20, and is provided at a position facing the photoreceptor 1Y. Further, bias power supply (not shown) which applies the primary transfer voltage is connected to each of the primary transfer rollers 5Y, 5M, 5C, and 5K. The bias power supply changes the primary transfer voltage which is applied to the primary transfer roller by control of a control unit (not shown).

In the exemplary embodiment, at least one unit (preferably all of the units) among the first to fourth units 10Y, 10M, 10C, and 10K is a unit which provided with the specific photoreceptor as a photoreceptor, the specific cleaning unit as a photoreceptor cleaning device, and uses a developer containing the specific toner a developer included in the developing device.

Hereinafter, an operation of forming a yellow image in the first unit 10Y will be described.

First, before starting the operation, the surface of the photoreceptor 1Y is charged with the potential in a range of −600 V to −800 V by the charging roller 2Y.

When being irradiated with the laser beam 3Y, the photoreceptor 1Y has the properties of changing the resistivity of a portion which is irradiated with the laser beam. In this regard, in accordance with image data for yellow transmitted from the control unit (not shown), the laser beam 3Y is output to the charged surface of the photoreceptor 1Y via the exposure device 3. The photosensitive layer of the surface of the photoreceptor 1Y is irradiated with the laser beam 3Y, and thereby, the electrostatic latent image of a yellow image pattern is formed on the surface of the photoreceptor 1Y.

The electrostatic latent image means an image formed on the charged surface of the photoreceptor 1Y, in which resistivity of a portion of the photosensitive layer to be irradiated with the laser beam 3Y is decreased and the charges for charging the surface of the photoreceptor 1Y move; while charges of a portion which is not irradiated with the laser beam 3Y remain, namely the electrostatic latent image is a so-called negative latent image.

The electrostatic latent image formed on the photoreceptor 1Y is rotated to the predetermined developing position in accordance with the traveling of the photoreceptor 1Y. Further, at the developing position, the electrostatic latent image on the photoreceptor 1Y is visualized (developed) as a toner image by the developing device 4Y.

The developing device 4Y contains, for example, a developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, whereby the electrostatic latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed by a photoreceptor cleaning device 6Y to be collected.

The primary transfer voltages that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20.

Meanwhile, a recording sheet (an example of the recording medium) P is supplied to a gap between the secondary transfer roller 26 and the intermediate transfer belt 20 by a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a pressure-contacting part (nip part) between a pair of fixing rollers in a fixing device (an example of the fixing unit) 28 so that the toner image is fixed to the recording sheet P, whereby a fixed image is formed. Examples of the recording sheet P include plain paper that is used in electrophotographic copying machine, printers, and the like, and as a recording medium, an OHP sheet is also exemplified other than the recording sheet P.

The recording sheet P on which the fixing of the color image is completed is discharged toward a discharge part, and a series of the color image forming operations end.

Next, a process cartridge which is detachable from the image forming apparatus will be described.

Hereinafter, an example of the process cartridge according to this exemplary embodiment will be shown. However, the process cartridge is not limited thereto. Major parts shown in the drawing will be described, but descriptions of other parts will be omitted.

Figure 2:
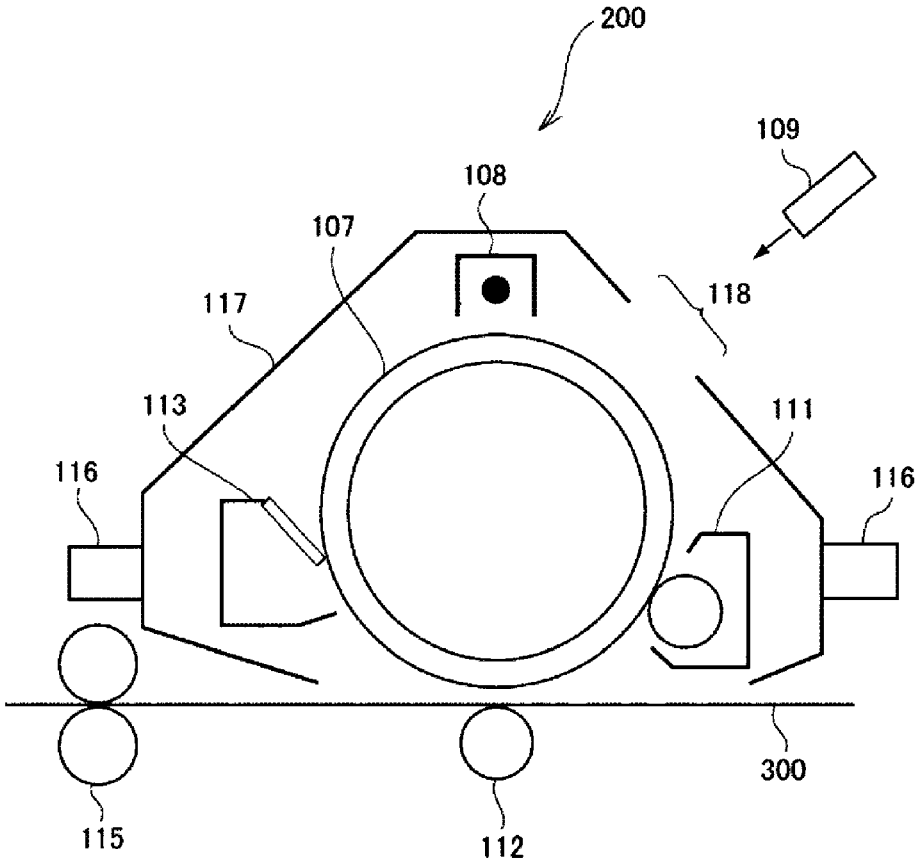
FIG. 2 illustrates the structure of a process cartridge which is applicable to the image forming apparatus according to the exemplary embodiment.

FIG. 2 is a configuration diagram illustrating a configuration of the process cartridge.

The process cartridge 200 illustrated in FIG. 2 is configured such that an electrophotographic photoreceptor 107, a charging roller 108 (an example of the charge unit) which is provided in the vicinity of the electrophotographic photoreceptor 107, a developing device 111 (an example of the developing unit), and a photoreceptor cleaning device 113 (an example of the cleaning unit) are integrally formed in combination, and are held by a housing 117 which is provided with an attached rail 116 and an opening portion 118 for exposing light.

Note that, in FIG. 2, reference numeral 109 is denoted as an exposing device (an example of the electrostatic latent image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Subsequently, the respective components (the specific photoreceptor, the charge unit, the electrostatic latent image forming unit, the developing unit, the transfer unit, the specific cleaning unit, the fixing unit, and the developer) constituting the image forming apparatus according to the exemplary embodiment will be more specifically described.

Note that, the reference numerals of members will be omitted.

Specific Photoreceptor

The specific photoreceptor in the image forming apparatus according to the exemplary embodiment sequentially includes the photosensitive layer and the overcoat layer on the electroconductive substrate. The photosensitive layer may be a single layer-type photosensitive layer in which the charge generation material and the charge transport material are included in the same photosensitive layer so as to integrate the functions, or may be a lamination type photosensitive layer in which functions of having the charge generation layer and the charge transport layer are separated. In a case where the photosensitive layer is a lamination type photosensitive layer, the order of the charge generation layer and the charge transport layer is not particularly limited; however, the specific photoreceptor preferably has a configuration such that the charge generation layer, the charge transport layer, and the overcoat layer are sequentially provided on the electroconductive substrate. Further, the specific photoreceptor may include other layers in addition to the above layers.

Figure 3:
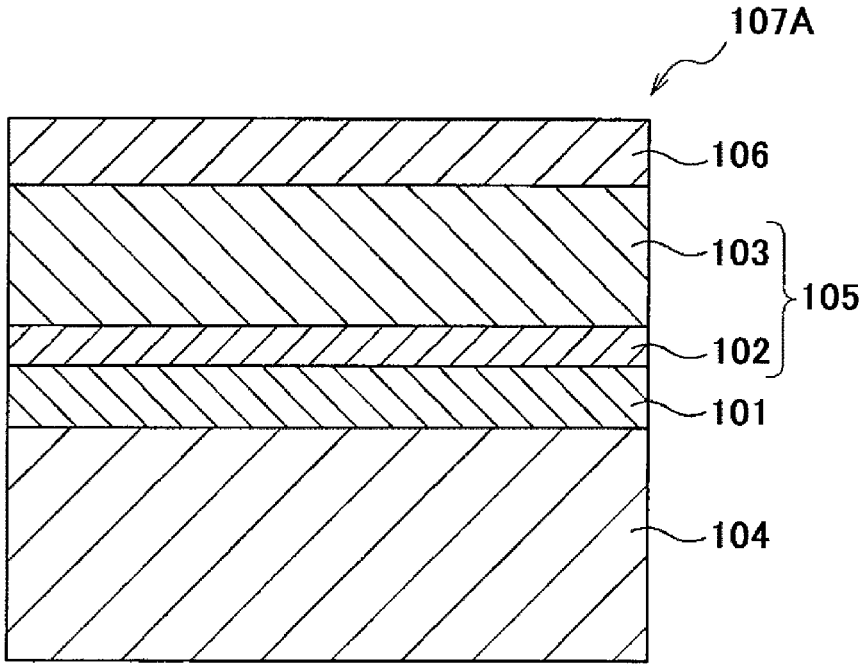
FIG. 3 illustrates the structure of a layer configuration of an electrophotographic photoreceptor in the image forming apparatus according to the exemplary embodiment.

FIG. 3 is a schematic sectional view illustrating an example of a layer configuration of an electrophotographic photoreceptor in the image forming apparatus according to the exemplary embodiment. An electrophotographic photoreceptor 107A has a structure in which an undercoat layer 101 is provided on an electroconductive substrate 104, and a charge generation layer 102, a charge transport layer 103, and an overcoat layer 106 are sequentially formed on the undercoat layer 101. The electrophotographic photoreceptor 107A is provided with a photosensitive layer 105 of which the function is separated to the charge generation layer 102 and the charge transport layer 103.

Figure 4:
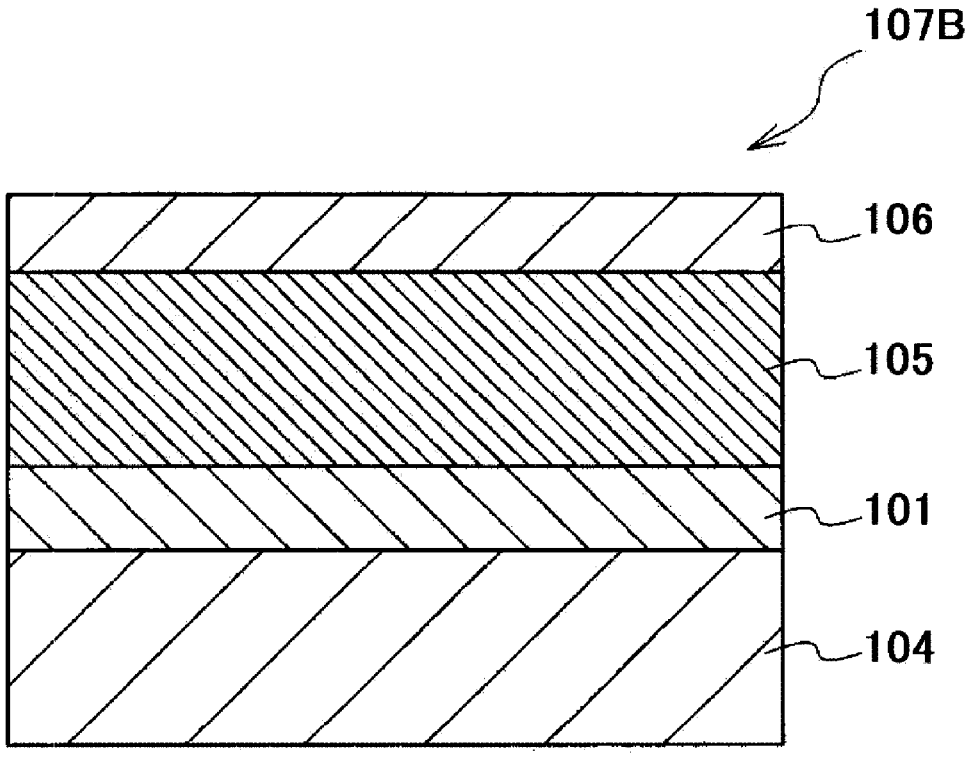
FIG. 4 illustrates a partially schematic sectional view of a layer configuration of an electrophotographic photoreceptor in the image forming apparatus according to the exemplary embodiment.

In addition, FIG. 4 is a partially schematic sectional view illustrating another example of a layer configuration of an electrophotographic photoreceptor in the image forming apparatus according to the exemplary embodiment. An electrophotographic photoreceptor 107B as illustrated in FIG. 4 has a structure in which the undercoat layer 101 is provided on the electroconductive substrate 104, and the photosensitive layer 105 and the overcoat layer 106 are sequentially formed on the undercoat layer 101. The electrophotographic photoreceptor 107B is provided with the single layer-type photosensitive layer in which the charge generation material and the charge transport material are included in the same photosensitive layer 105 so as to integrate the functions.

Note that, the specific photoreceptor may be or may be not provided with the undercoat layer 101.

Hereinafter, the specific photoreceptor will be described in detail without description of reference numerals.

Electroconductive Substrate

Examples of the conductive substrate include a metal plate including metal (aluminum, copper, zinc, chromium, nickel, molybdenum, vanadium, indium, gold, platinum, and the like) or alloy (stainless steel and the like), a metal drum, and a metal belt. In addition, examples of the electroconductive substrate include a sheet coated, deposited, or laminated with a conductive compound (for example, a conductive polymer and an indium oxide), metal (for example, aluminum, palladium, and gold), or alloy, a resin film, and a belt. Here, the "conductivity" means the volume resistivity which is less than $10^{13}$ Ωcm.

In a case where the specific photoreceptor is used as a laser printer, for the purpose of preventing interference fringe generated at the time of irradiating a laser beam, the surface of the electroconductive substrate is subjected to roughening with center line average roughness Ra in a range of 0.04 μm to 0.5 μm. Note that, when non-interference light is used for a light source, the roughening for preventing the interference fringe is not particularly necessary, but it prevents the occurrence of defects due to irregularities on the surface of the electroconductive substrate, and thus is suitable for longer life.

Examples of a method of the roughening include wet honing performed by suspending the abrasive in water and blowing it on the electroconductive substrate, centerless grinding in which an electroconductive substrate is pressed against a rotating grinding stone and subjected to continuous grinding, and an anodic oxidation treatment.

As the method of the roughening, a method in which the surface of the electroconductive substrate is not subjected to the roughening, conductive or semiconductive powders are dispersed in the resin, a layer is formed on the surface of the electroconductive substrate, and the particles which are dispersed in the layer are used to perform the roughening.

The roughening treatment by the anodic oxidation is to form an oxide film on the surface of the electroconductive substrate by setting a metallic electroconductive substrate (for example, formed of aluminum) as an anode so as to perform the anodic oxidation in the electrolyte solution. Examples of the electrolyte solution include a sulfuric acid solution, an oxalic acid solution, and the like. However, a porous anodized film formed by the anodic oxidation is chemically active in the state as it is, and tends to be contaminated, and resistance fluctuation due to the environment is also large. In this regard, it is preferable to perform a sealing treatment with respect to the porous anodized film so as to make more stable hydrated oxide by preventing the volume expansion of microspores of the oxide film due to hydration reaction in pressurized steam or boiling water (a metal salt such as nickel may be added).

The film thickness of the anodized film is preferably, for example, in a range of 0.3 μm to 15 μm. When the film thickness is in the above-described range, the barrier properties against injection tend to be exhibited, and increase in residual potential due to repeated use tends to be prevented.

The electroconductive substrate may be subjected to a treatment by using an acid treatment solution and a boehmite treatment.

The treatment by using the acid treatment solution is performed as follows, for example. First, an acid treatment solution containing phosphoric acid, chromic acid, and hydrofluoric acid is prepared. The mixing ration of phosphoric acid, chromic acid, and hydrofluoric acid in the acid treatment solution is as follows, for example. The content of the phosphoric acid is in a range of 10% by weight to 11% by weight, the content of the chromic acid is in a range of 3% by weight to 5% by weight, and the hydrofluoric acid is in a range of 0.5% by weight to 2% by weight. The entire concentration of these acids may be in a range of 13.5% by weight to 18% by weight. The treatment temperature is preferably in a range of 42° C. to 48° C. The thickness of the coated film is preferably in a range of 0.3 μm to 15 μm.

The boehmite treatment is performed by, for example, dipping the substrate in the pure water in a temperature range of 90° C. to 100° C. for 5 minutes to 60 minutes, or causing the substrate to be in contact with heated steam in the temperature range of 90° C. to 120° C. for 5 minutes to 60 minutes. The thickness of the coated film is preferably in a range of 0.1 to 5 The coated film may be further subjected to the anodic oxidation treatment by using an electrolyte solution having low film solubility such as adipic acid, boric acid, borate, phosphate, phthalate, maleate, benzoate, tartrate, and citrate.

Undercoat Layer

The undercoat layer is, for example, a layer including an inorganic particle and a binder resin.

Examples of the inorganic particle include inorganic particles having powder resistance (volume resistivity) in a range of $10^2$ Ωcm to $10^{11}$ Ωcm.

Among them, as the inorganic particle having the resistance value, metal oxide particles such as tin oxide particles, titanium oxide particles, zinc oxide particles, and zirconium oxide particles may be used, and particularly, the zinc oxide particles are preferably used.

A specific surface area by a BET method of the inorganic particle may be, for example, equal to or greater than 10 $m^2/g$.

The volume average particle diameter of the inorganic particle may be, for example, in a range of 50 nm to 2,000 nm (preferably in a range of 60 nm to 1,000 nm).

The content of the inorganic particle is, for example, is preferably in a range of 10% by weight to 80% by weight, and is further preferably in a range of 40% by weight to 80% by weight, with respect to the binder resin.

The inorganic particle may be subjected to the surface treatment. Two or more inorganic particles which are subjected to the surface treatment in a different way, or which have different particle diameters may be used in combination.

Examples of a surface treatment agent include a silane coupling agent, a titanate coupling agent, an aluminum coupling agent, and a surfactant. Particularly, the silane coupling agent is preferably used, and a silane coupling agent having an amino group is further preferably used.

Examples of the silane coupling agent having an amino group include 3-aminopropyl triethoxy silane, N-2-(aminoethyl)-3-aminopropyl trimethoxy silane, N-2-(aminoethyl)-3-aminopropyl methyl dimethoxy silane, and N,N-bis(2-hydroxy ethyl)-3-aminopropyl triethoxy silane; however, the silane coupling agent is not limited to these examples.

Two or more types of the silane coupling agents may be used in combination. For example, the silane coupling agent having an amino group and other silane coupling agents may be used in combination. Examples of other silane coupling agents include vinyl trimethoxy silane, 3-methacryloxypropyl-tris(2-methoxyethoxy) silane, 2-(3,4-epoxycyclohexyl) ethyl trimethoxy silane, 3-glycidoxypropyltrimethoxysilane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl dimethoxy silane, N,N-bis(2-hydroxyethyl)-3-aminopropyl triethoxy silane, 3-chloropropyl trimethoxy silane; however, other silane coupling agents are not limited to these examples.

The method of surface treatment by using the surface treatment agent is not limited as long as it is a well-known method, and a drying method or a wet method may be used.

The amount of the surface treatment agent is, for example, preferably in a range of 0.5% by weight to 10% by weight with respect to the inorganic particle.

Here, the undercoat layer of the exemplary embodiment may include an inorganic particle and an electron-accepting compound (acceptor compound) from the viewpoint that long-term stability of electrical characteristics and the carrier blocking properties are improved.

Examples of the electron-accepting compound include an electron transporting substance, for example, a quinone compound such as chloranil and bromanil; a tetracyanoquinodimethane compound; a fluorenone compound such as 2,4,7-trinitrofluorenone, 2,4,5,7-tetranitro-9-fluorenone; an oxadiazole compound such as 2-(4-biphenyl)-5-(4-t-butyl phenyl)-1,3,4-oxadiazole, 2,5-bis(4-naphthyl)-1,3,4-oxadiazole, 2,5-bis(4-diethyl amino-phenyl)-1,3,4-oxadiazole; a xanthone compound; a thiophene compound; and a diphenoquinone compound such as 3,3',5,5' tetra-t-butyl diphenoquinone. Particularly, as the electron-accepting compound, a compound having an anthraquinone structure is preferably used. As the compound having an anthraquinone structure, for example, a hydroxyanthraquinone compound, an amino anthraquinone compound, and an amino hydroxy anthraquinone compound are preferably used, and specifically, anthraquinone, alizarin, quinizarin, anthrarufin, and purpurin are preferably used.

The electron-accepting compound may be dispersed in the undercoat layer together with the inorganic particle, or may be attached on the surface of the inorganic particle.

Examples of the method of attaching the electron-accepting compound on the surface of the inorganic particle include a drying method and a wet method.

The drying method is a method of attaching the electron-accepting compound to the surface of the inorganic particle, for example, the electron-accepting compound or the electron-accepting compound which is dissolved in the organic solvent is added dropwise, and is sprayed with dry air or nitrogen gas while stirring the inorganic particle by using a large mixer having a shear force. The electron-accepting compound may be added dropwise or sprayed at a temperature below the boiling point of the solvent. After the electron-accepting compound is added dropwise or sprayed, sintering may be performed at a temperature of 100° C. or more. The sintering is not particularly limited as long as a temperature and time for obtaining the electrophotographic properties are provided.

The wet method is a method of attaching the electron-accepting compound to the surface of the inorganic particle by removing the solvent after the electron-accepting compound is added and stirred or dispersed while dispersing the inorganic particles in the solvent through a stirrer, ultrasound, a sand mill, an attritor, a ball mill, and the like. As a method of removing a solvent, for example, the solvent is distilled off by filtration or distillation. After removing the solvent, sintering may be performed at a temperature of 100° C. or more. The sintering is not particularly limited as long as a temperature and time for obtaining the electrophotographic properties are provided. In the wet method, the water content of the inorganic particle may be removed before adding the electron-accepting compound, and examples thereof includes a method of removing the water content of the inorganic particle while stirring and heating in the solvent, and a method of removing the water content of the inorganic particle by forming an azeotrope with the solvent.

Attaching the electron-accepting compound may be performed before or after performing the surface treatment on the inorganic particle by using a surface treatment agent, and the attaching of the electron-accepting compound and the surface treatment by using a surface treatment agent may be concurrently performed.

The content of the electron-accepting compound may be in a range of 0.01% by weight to 20% by weight, and is preferably in a range of 0.01% by weight to 10% by weight with respect to the inorganic particle.

Examples of the binder resin used for the undercoat layer include a well-known polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, an urethane resin, an alkyd resin, and an epoxy resin; a zirconium chelate compound; a titanium chelate compound; an aluminum chelate compound; a titanium alkoxide compound; an organic titanium compound; and a well-known material such as an a silane coupling agent.

Examples of the binder resin used for the undercoat layer include a charge transport resin having a charge transport group, and a conductive resin (for example, polyaniline).

Among them, as the binder resin used for the undercoat layer, an insoluble resin in the coating solvent for the upper layer is preferably used. Particularly, examples thereof include a thermosetting resin such as a urea resin, a phenol resin, a phenol-formaldehyde resin, a melamine resin, a urethane resin, an unsaturated polyester resin, an alkyd resin, and an epoxy resin; and a resin obtained by reaction of at least one resin selected from the group consisting of a polyamide resin, a polyester resin, a polyether resin, a methacrylic resin, an acrylic resin, a polyvinyl alcohol resin, and a polyvinyl acetal resin, and a curing agent.

In a case where two or more binder resins are used in combination, the mixing ratio thereof is set if necessary.

The undercoat layer may contain various types of additives so as to improve electrical properties, environmental stability, and image quality.

Examples of the additive include well-known materials, for example, an electron transporting pigment such as a polycyclic condensed pigment and an azo pigment, a zirconium chelate compound, a titanium chelate compound, an aluminum chelate compound, a titanium alkoxide compound, an organic titanium compound, and a silane coupling agent. The silane coupling agent is used for the surface treatment of the inorganic particle as described above, and may be also added to the undercoat layer as an additive.

Examples of the silane coupling agent as an additive include vinyl trimethoxy silane, 3-methacryloxy propyl-tris (2-methoxyethoxy)silane, 2-(3,4-epoxycyclohexyl)ethyl trimethoxy silane, 3-glycidoxypropyltrimethoxysilane, vinyl triacetoxy silane, 3-mercaptopropyl trimethoxy silane, 3-aminopropyl triethoxy silane, N-2-(aminoethyl)-3-aminopropyl trimethoxy silane, N-2-(aminoethyl)-3-aminopropyl methyl methoxy silane, N,N-bis(2-hydroxyethyl)-3-aminopropyl triethoxy silane, and 3-chloro-propyl trimethoxy silane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-normal butyl titanate, butyl titanate dimer, tetra(2-ethylhexyl) titanate, titanium acetylacetonate, poly titanium acetylacetonate, titanium octylene glycolate, titanium lactate ammonium salt, titanium lactate, titanium lactate ethyl ester, titanium triethanolaminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, aluminum tris (ethyl acetoacetate).

The above-described additives may be used alone or may be used as a mixture of plural compounds or polycondensate.

The Vickers' hardness of the undercoat layer may be 35 or more.

In order to prevent the occurrence of moire images, the surface roughness (ten-point average roughness) of the undercoat layer may be suitably adjusted to ½ from 1/(4n) (n is the refractive index of the upper layer) of the using exposure laser wavelength λ.

The resin particle or the like may be added into the undercoat layer so as to adjust the surface roughness. Examples of the resin particle include a silicone resin particle, and a crosslinked polymethyl methacrylate resin particle. The surface of the undercoat layer may be polished so as to adjust the surface roughness. Examples of a polishing method include a buffing method, a sandblasting method, a wet honing method, and a grinding method.

The forming of the undercoat layer is not particularly limited, and a well-known forming method is used. For example, the method is performed in such a manner that a coated film coated with the coating liquid for forming an undercoat layer to which the above-described components are added as a solvent is formed, dried, and then heated if necessary.

Examples of the solvent for preparing the coating liquid for forming an undercoat layer include a well-known organic solvent such as an alcohol solvent, an aromatic hydrocarbon solvent, a halogenated hydrocarbon solvent, a ketone solvent, a ketone alcohol solvent, an ether solvent, and an ester solvent.

Specific examples of the solvent include general organic solvents such as methanol, ethanol, n-propanol, isopropanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

A method of dispersing inorganic particles at the time of preparing the coating liquid for forming an undercoat layer includes a well-known method by using a roll mill, a ball mill, a vibrating ball mill, an attritor, a sand mill, a colloid mill, and a paint shaker.

Examples of the method of coating the conductive support with the coating liquid for forming an undercoat layer include a general method such as a blade coating method, a wire-bar coating method, a spray coating method, a dipping coating method, a bead coating method, an air knife coating method, and a curtain coating method.

The film thickness of the undercoat layer is, for example, preferably 15 μm or more, and more preferably from 20 μm to 50 μm.

Intermediate Layer

Although not shown in the drawings, an intermediate layer may be further provided between the undercoat layer and the photosensitive layer.

The intermediate layer is a layer including a resin. Examples of the resin used for the intermediate layer include a polymer compound such as an acetal resin (such as polyvinyl butyral), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride vinyl acetate-maleic anhydride resin, a silicone resin, a silicone-alkyd resin, a phenol-formaldehyde resin, and a melamine resin.

The intermediate layer may be a layer including an organometallic compound. Examples of the organometallic compound used for the intermediate layer include an organometallic compound containing a metal atom such as zirconium, titanium, aluminum, manganese, and silicon.

The compounds used for the intermediate layer may be used alone, or may be used as a mixture of plural compounds or a polycondensate.

Among them, the intermediate layer is preferably a layer including an organometallic compound containing a zirconium atom or a silicon atom.

The forming of the intermediate layer is not particularly limited, and a well-known forming method is used. For example, the method is performed in such a manner that a coated film coated with the coating liquid for forming an intermediate layer to which the above-described components are added as a solvent is formed, dried, and then heated if necessary.

Examples of a coating method for forming an intermediate layer include a dipping coating method, an extrusion coating method, a wire-bar coating method, a spray coating method, a blade coating method, a knife coating method, and a curtain coating method.

The thickness of intermediate layer is preferably set in a range of 0.1 μm to 3 μm, for example. Note that, the intermediate layer may be used as an undercoat layer.

Charge Generation Layer

The charge generation layer includes, for example, a charge generation material and a binder resin. In addition, the charge generation layer may be a deposited layer of the charge generation material. The deposited layer of the charge generation material is preferably used in a case where a non-coherent light source such as a light-emitting diode (LED), organic electro-luminescence (EL) image array.

Examples of the charge generation material include an azo pigment such as bisazo and trisazo; a condensed aromatic pigment such as dibromoanthanthrone; a perylene pigment; a pyrrolopyrrole pigment; phthalocyanine pigment; zinc oxide; and trigonal selenium.

Among them, in order to correspond to the laser exposure in the near infrared region, a metal phthalocyanine pigment, or a non-metal phthalocyanine pigment are preferably used as the charge generation material. Specific examples thereof include hydroxy gallium phthalocyanine disclosed in JP-A-5-263007 and JP-A-5-279591; chloro gallium phthalocyanine disclosed in JP-A-5-98181; dichlorotin phthalocyanine disclosed in JP-A-5-140472 and JP-A-5-140473; and titanyl phthalocyanine disclosed in JP-A-4-189873.

On the other hand, in order to correspond to the laser exposure in the near ultraviolet region, a condensed aromatic pigment such as dibromoanthanthrone; a thioindigo pigment; a porphyrazine compound; zinc oxide; trigonal selenium; and a bisazo pigment disclosed in JP-A-2004-78147 and JP-A-2005-181992 are preferably used as the charge generation material.

In a case of using the non-coherent light source such as LED, and the organic EL image array which have the central wavelength of the emitted light in the range of 450 nm to 780 nm, the above-described charge generation material may be used; however, in terms of the resolution, when the photosensitive layer having a thickness of 20 μm or less, the electric field intensity is enhanced in the photosensitive layer, and due to reduction of charging by the charge injection from the conductive support, an image defect which is so-called "black dot" is likely to occur. This phenomine is remarkable when the charge generation material which is a p-type semiconductor such as trigonal selenium and a phthalocyanine pigment, and easily causes a dark current is used.

In contrast, in a case of using an n-type semiconductor such as a condensed aromatic pigment, a perylene pigment, and an azo pigment as the charge generation material, the dark current is less likely to occur and the image defect which is a so-called dark dot may be prevented even with thin film. As the n-type charge generation material, for example, compounds (CG-1) to (CG-27) disclosed in paragraphs [0288] to [0291] of JP-A-2012-155282 are exemplified; however, the example thereof is not limited thereto.

The determination of the n-type is performed by polarity of flowing photocurrent with a time-of-flight method which is generally used, and a material which causes electrons to easily flow as carriers as compared with a hole is set as an n-type.

The binder resin used for the charge generation layer may be selected from the insulating resins in a wide range, or may be selected from organic photoconductive polymers such as poly-N-vinylcarbazole, polyvinyl anthracene, polyvinyl pyrene, and polysilanes.

Examples of the binder resin include a polyvinyl butyral resin, a polyarylate resin (a polycondensate of bisphenol and an aromatic dicarboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, an urethane resin, an epoxy resin, casein, a polyvinyl alcohol resin, and a polyvinyl pyrrolidone resin. Here "insulation properties" mean a case where the volume resistivity is $10^{13}$ Ωcm or more. These binder resins may be used alone or two or more types thereof may be used in combination.

The mixing ratio of the charge generation material to the binder resin is preferably in a range of 10:1 to 1:10 by the weight ratio.

The charge generation layer may include other well-known additives.

The charge generation layer is not particularly limited, and a well-known forming method is used. For example, the method is performed in such a manner that a coated film coated with the coating liquid for forming a charge generation layer to which the above-described components are added as a solvent is coated, dried, and then heated if necessary. The forming of the charge generation layer may be performed by vaporizing the charge generation material. The forming of the charge generation layer performed by vaporizing the charge generation material is particularly preferable in a case where a condensed aromatic pigment and a perylene pigment are used as the charge generation material.

Examples of the solvent for preparing coating liquid for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone, or two or more types thereof are used in combination.

Examples of a method of dispersing the particles (for example, charge generation material) in the coating liquid forming a charge generation layer include a method by using a media dispersing machine such as a ball mill, a vibrating ball mill, an attritor, a sand mill, and a horizontal sand mill, and a medialess disperser such as a stirrer, an ultrasonic disperser, a roll mill, and a high pressure homogenizer. Examples of the high-pressure homogenizer include a collision-type homogenizer in which a dispersion is dispersed by liquid-liquid collision, and liquid-wall collision under high pressure, and a passing-through-type homogenizer in which a dispersion is dispersed by passing the dispersion through thin flow paths under high pressure. At the time of this dispersion, the average particle diameter of the charge generation material in the coating liquid forming a charge generation layer is preferably 0.5 μm or less, more preferably 0.3 μm or less, and most preferably 0.15 μm or less.

Examples of a method of coating the undercoat layer (or on the intermediate layer) with the coating liquid forming a charge generation layer include a general method such as a blade coating method, a wire-bar coating method, a spray coating method, a dipping coating method, a bead coating method, an air knife coating method, and a curtain coating method.

The thickness of the charge generation layer is preferably set to be in a range of 0.1 μm to 5.0 μm, and is further preferably set to be in a range of 0.2 μm to 2.0 μm, for example.

Charge Transport Layer

The charge transport layer is, for example, a layer including a charge transport material and a binder resin. The charge transport layer may be a layer including a polymer charge transport material.

Examples of the charge transport material include an electron transporting compound such as a quinone compound such as p-benzoquinone, chloranil, bromanil, and anthraquinone; a tetracyanoquinodimethane compound; a fluorenone compound such as 2,4,7-trinitrofluorenone; a xanthone compound; a benzophenone compound; and a cyanovinyl compound; an ethylene compound. Examples of the charge transport material include a hole-transporting compound such as a triarylamine compound, a benzidine compound, an arylalkane compound, an aryl substituted ethylene compound, a stilbene compound, an anthracene compound, and a hydrazone compound. These charge transport materials may be used alone or two or more types thereof may be used, but are not limited thereto.

As the charge transport material, in terms of charge mobility, a triarylamine derivative represented by the following formula (a-1) and a benzidine derivative represented by the following formula (a-2) are preferably used.

(a-1)

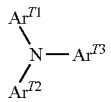

In formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$ or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group. Examples of the substituent of the respective groups include a halogen atom, an alkyl group having 1 to 5 carbon atoms, and an alkoxy group having 1 to 5 carbon atoms. In addition, examples of the substituent of the respective groups include a substituted amino group which is substituted with an alkyl group having 1 to 3 carbon atoms.

(a-2)

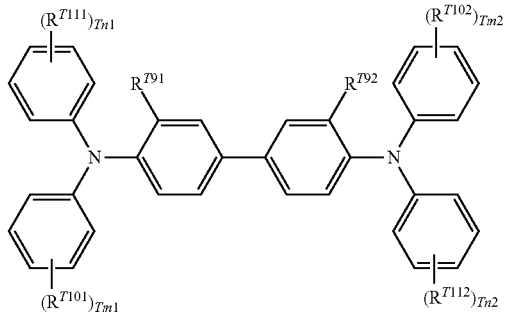

In formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group which is substituted with an alkyl group having 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group. Tm1, Tm2, Tn1 and Tn2 each independently represent an integer of 0 to 2. Examples of the substituent of the respective groups include a halogen atom, an alkyl group having 1 to 5 carbon atoms, and an alkoxy group having 1 to 5 carbon atoms. In addition, examples of the substituent of the respective groups include a substituted amino group which is substituted with an alkyl group having 1 to 3 carbon atoms.

Here, among a triarylamine derivative represented by formula (a-1) and a benzidine derivative represented by the formula (a-2), a triarylamine derivative having "$—C_6H_4—CH=CH—CH=C(R^{T7})(R^{T8})$", and a benzidine derivative having "$—CH=CH—CH=C(R^{T15})(R^{T16})$" are particularly preferable in terms of the charge mobility.

As the polymer charge transport material, a material having charge transporting properties such as poly-N-vinylcarbazole and polysilane is used. Particularly, a polyester polymer charge transport material, and the like disclosed in JP-A-8-176293 and JP-A-8-208820 are particularly preferable. The polymer charge transport material may be used alone, or may be used in combination with the binder resin.

Examples of the binder resin used for the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, and polysilane. Among them, as the binder resin, the polycarbonate resin and the polyarylate resin are preferably used. These binder resins may be used alone or two or more types thereof may be used in combination.

The mixing ratio of the charge transport material to the binder resin is 10:1 to 1:5 by the weight ratio.

The charge transport layer may include other well-known additives.

The charge transport layer is not particularly limited, and a well-known forming method is used. For example, the method is performed in such a manner that a coated film coated with the coating liquid for forming a charge transport layer to which the above-described components are added as a solvent is coated, dried, and then heated if necessary.

Examples of the solvent for preparing the coating liquid forming a charge transport layer include general organic solvents such as aromatic hydrocarbons such as benzene, toluene, xylene, and chlorobenzene; ketones such as acetone and 2-butanone; halogenated aliphatic hydrocarbons such as methylene chloride, chloroform, and methylene chloride; and cyclic or linear ethers such as tetrahydrofuran and diethyl ether. These solvents may be used alone or two or more types thereof may be used in combination.

Examples of the method of coating the charge generation layer with the coating liquid for forming a charge transport layer include a general method such as a blade coating method, a wire-bar coating method, a spray coating method, a dipping coating method, a bead coating method, an air knife coating method, and a curtain coating method.

The thickness of the charge transport layer is, for example, preferably set to be in a range of 5 μm to 50 μm, and is further preferably set to be in a range of 10 μm to 30 μm.

Overcoat Layer

The overcoat layer is provided on the photosensitive layer if necessary. For example, the overcoat layer is provided so as to prevent the photosensitive layer during charge from being chemically changed, or to further enhance the mechanical strength of the photosensitive layer.

The overcoat layer may employ a layer formed of a cured film (a cross-linked membrane). Examples of these layers include layers described in the following description 1) or 2).

1) A layer which is formed of a cured film of a composition including a reactive group-containing charge transport material having a reactive group and a charge transport skeleton in the same molecule (that is, a layer including a polymer or a crosslinked polymer of the reactive group-containing charge transport material)

2) A layer which is formed of a cured film of a composition including a non-reactive charge transport material and a reactive group-containing non-charge transport material having a reactive group without a charge transport skeleton (that is, a layer including a polymer or crosslinked polymer a non-reactive charge transport material and the reactive group-containing non-charge transport material)

Examples of the reactive group of the reactive group-containing charge transport material include well-known reactive groups such as a chain polymerization group, an epoxy group, —OH, —OR [here, R represents an alkyl group], —$NH_2$, —SH, —COOH, —$SiR^{Q1}{}_{3-Qn}$ $(OR^{Q2})_{Qn}$ [here, $R^{Q1}$ represents a hydrogen atom, an alkyl group, or a substituted or non-substituted aryl group, $R^{Q2}$ represents a hydrogen atom, an alkyl group, and a trialkylsilyl group. Qn represents integer of 1 to 3].

Note that, as the reactive group in the reactive group-containing charge transport material, the above-described well-known reactive groups are exemplified.

The chain polymerization group is not particularly limited as long as it is a functional group capable of radical polymerization, and examples thereof include a functional group having a group containing at least carbon double bond. Specific examples thereof include a group containing at least one selected from a vinyl group, a vinyl ether group, a vinyl thioether group, a styryl group, a vinyl phenyl group, an acryloyl group, a methacryloyl group, and derives thereof. Among them, in terms of excellent reactivity, a group containing at least one selected from a vinyl group, a styryl group, a vinyl phenyl group, an acryloyl group, a methacryloyl group, and the derives thereof is preferably used as the chain polymerization group, and at least one selected from an acryloyl group, a methacryloyl group, and the derives thereof is further preferably used.

The charge transport skeleton of the reactive group-containing charge transport material is not particularly limited as long as it is a well-known structure in the electrophotographic photoreceptor. For example, a skeleton derived from a nitrogen-containing hole transport compound such as a triarylamine compound, a benzidine compound, and a hydrazone compound is used, and examples thereof include a structure is conjugated a nitrogen atom. Among them, the triarylamine skeleton is preferably used.

The reactive group-containing charge transport material having the reactive group and the charge transport skeleton, the non-reactive charge transport material, and the reactive group-containing charge transport material may be selected from well-known materials.

Note that, the overcoat layer may include other well-known additives in addition to the above-described materials.

The forming of the overcoat layer is not particularly limited, and may be determined depending on the materials to be used, and a well-known forming method is used. For example, the method is performed in such a manner that a coated film coated with the coating liquid for forming an overcoat layer to which the above-described components are added as a solvent is coated, dried, and then heated if necessary.

Examples of the solvent for preparing the coating liquid for forming an overcoat layer includes an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a cellosolve solvent such as ethylene glycol monomethyl ether; and an alcohol solvent such as isopropyl alcohol and butanol. These solvents may be used alone or two or more types thereof may be used in combination. The coating liquid for forming an overcoat layer may be a coating liquid of an inorganic solvent.

Examples of the method of coating the photosensitive layer (for example, a charge transport layer) with the coating liquid for forming a protective layer include a well-known method such as a dipping coating method, an extrusion coating method, a wire-bar coating method, a spray coating method, a blade coating method, a knife coating method, and a curtain coating method.

Cured Material of Composition Containing Compound Having at Least One of Acryloyl Group and Methacryloyl Group The overcoat layer in the specific photoreceptor is preferably formed of a cured material of a composition containing a compound having at least one of an acryloyl group and a methacryloyl group.

Among them, the overcoat layer may be formed of a cured material of a composition containing a compound (hereinafter, also referred to "a specific charge transport material (a)") having a charge transport skeleton and an acryloyl group, or a methacryloyl group in the same molecule.

Hereinafter, the cured material (cured film) of composition containing the specific charge transport material (a) will be described with reference to examples.

Specific Charge Transport Material (a)

The specific charge transport material (a) used for the overcoat layer is a compound having a charge transport skeleton and an acryloyl group, or a methacryloyl group in the same molecule, and is not particularly limited as long as it satisfies the conditions of the above structure.

Here, regarding the charge transport skeleton in the specific charge transport material (a), examples of the charge transport skeleton in the reactive charge transport material (a) include a skeleton derived from a nitrogen-containing hole transport compound such as a triarylamine compound, a benzidine compound, and a hydrazone compound.

Particularly, the specific charge transport material (a) is preferably a compound containing a methacryloyl group.

Although the reason is not clear, the following reasons may be presumed.

Typically, a compound having a highly reactive acryloyl group is frequently used for the curing reaction. In a case where the bulky charge transport skeleton has the highly reactive acryloyl group as a substituent, the curing reaction is prone to unevenness, and unevenness and wrinkles of the overcoat layer are easily generated on the cured film. On the other hand, when using the specific charge transport material (a) having the lower reactive methacryloyl group than the acryloyl group, it is presumed that unevenness and wrinkles of the overcoat layer are easily prevented from being generated on the cured film.

Further, it is preferable that the specific charge transport material (a) has a structure in which one or more carbon atoms are interposed between the charge transport skeleton and the acryloyl group or a methacryloyl group. In other words, it is preferable that the specific charge transport material (a) has a carbon chain including one or more carbon atoms interposed between the charge transport skeleton and the acryloyl group or the methacryloyl group, as a linking group. Particularly, it is further preferable that the above linking group is an alkylene group.

The reason why the above embodiment is preferable is not clear, but the following reasons, for example, may be considered.

Regarding the mechanical strength in the overcoat layer, it is considered that when the bulky charge transport skeleton and a polymerization site (an acryloyl group or a methacryloyl group) are close to each other and are rigid, the polymerization sites are hard to move, and the probability of the reaction is decreased.

In addition, the specific charge transport material (a) is preferably a compound (a') having a structure including a triphenyl amine skeleton, and three or more, preferably, four or more of methacryloyl groups in the same molecule. In this configuration, the stability of the compound during synthesis is easily ensured. In addition, with such a configuration, the overcoat layer having a high crosslink density and sufficient mechanical strength may be formed, and thus it is easy to make the overcoat layer thickened.

In the exemplary embodiment, it is preferable that the specific charge transport material (a) is a compound represented by the following general formula (A) in terms of the excellent charge transporting properties.

(A)

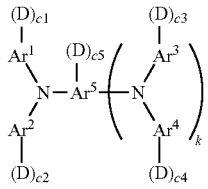

In the above-described general formula (A), $Ar^1$ to $Ar^4$ each independently represents a substituted or unsubstituted aryl group, $Ar^5$ represents a substituted or unsubstituted aryl group, or a substituted or unsubstituted arylene group, D represents $—(CH_2)_d—(O—CH_2—CH_2)_e—O—CO—C(CH_3)=CH_2$, c1 to c5 each independently represents an integer in a range of 0 to 2, k represents 0 or 1, d represents an integer in a range of 0 to 5, e represents 0 or 1, and total number of D is 4 or more.

In the general formula (A), $Ar^1$ to $Ar^4$ each independently represents a substituted or unsubstituted aryl group. Ar' to $Ar^4$ may be the same as or different from each other.

Here, in addition to D: $—(CH_2)_d—(O—CH_2—CH_2)_e—O—CO—C(CH_3)=CH_2$, examples of the substituent in the substituted aryl group include an alkyl group or an alkoxy group having 1 to 4 carbon atoms, a substituted or unsubstituted aryl group having 6 to 10 carbon atoms.

$Ar^1$ to $Ar^4$ are preferably any one of the following formulae (1) to (7). Note that, the following formulae (1) to (7) indicate "$-(D)_{C1}$" to "$-(D)_{C4}$" which may be linked to each of $Ar^1$ to $Ar^4$, and "$-(D)_{C1}$" to "$-(D)_{C4}$" are collectively indicated as "$-(D)_C$" which is collectively indicated.

(1)

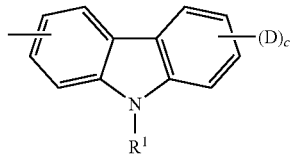

(2)

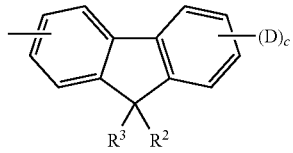

(3)

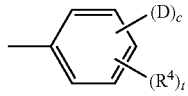

(4)

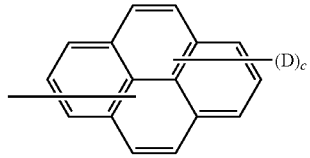

(5)

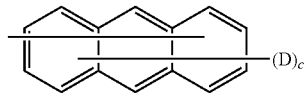

-continued (6)

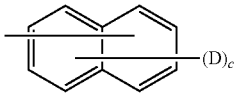

(7)

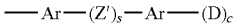

In the above-described formulae (1) to (7), $R^1$ represents one selected from the group consisting of a hydrogen atom, an alkyl group having 1 to 4 carbon atoms, a phenyl group which is substituted with the alkyl group having 1 to 4 carbon atoms or an alkoxy group having 1 to 4 carbon atoms, an unsubstituted phenyl group, and an aralkyl group having 7 to 10 carbon atoms, $R^2$ to $R^4$ each independently represents one selected from the group consisting of a hydrogen atom, an alkyl group having 1 to 4 carbon atoms, an alkoxy group having 1 to 4 carbon atoms, a phenyl group which is substituted with the alkoxy group having 1 to 4 carbon atoms, an unsubstituted phenyl group, an aralkyl group having 7 to 10 carbon atoms, and a halogen atom, Ar represents a substituted or unsubstituted arylene group, D represents $—(CH_2)_d—(O—CH_2—CH_2)_e—O—CO—C(CH_3)=CH_2$, c represents 1 or 2, s represents 0 or 1, and t represents an integer in a range of 0 to 3.

Here, examples of Ar in formula (7) include those indicated in the following structural formula (8) or (9).

(8)

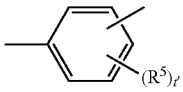

(9)

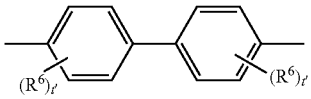

In the above-described formulae (8) and (9), $R^5$ and $R^6$ each independently represents one selected from the group consisting of a hydrogen atom, an alkyl group having 1 to 4 carbon atoms, an alkoxy group having 1 to 4 carbon atoms, a phenyl group which is substituted with the alkoxy group having 1 to 4 carbon atoms, an unsubstituted phenyl group, an aralkyl group having 7 to 10 carbon atoms, and a halogen atom, and t' represents an integer in a range of 0 to 3.

In addition, in the above-described formula (7), Z' represents a divalent organic linking group, and is preferably represented by any one of the following formulae (10) to (17). Further, in the above-described formula (7), s represents 0 or 1.

(10)

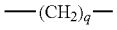

(11)

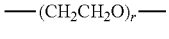

(12)

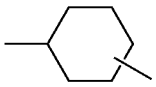

(13)

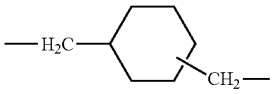

-continued (14)

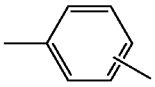

(15)

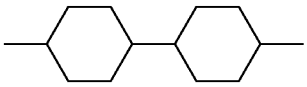

(16)

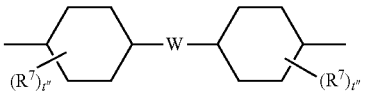

(17)

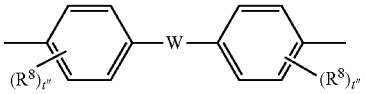

In the above-described formulae (10) to (17), $R^7$ and $R^8$ each independently represents one selected from the group consisting of a hydrogen atom, an alkyl group having 1 to 4 carbon atoms, an alkoxy group having 1 to 4 carbon atoms or a phenyl group which is substituted with the alkoxy group having 1 to 4 carbon atoms, an unsubstituted phenyl group, an aralkyl group having 7 to 10 carbon atoms, and a halogen atom, W represents a divalent group, q and r each independently represents an integer in a range of 1 to 10, and t" represents an integer in a range of 0 to 3.

W in the above-described formulae (16) and (17) preferably any one of the divalent groups represented by the following formulae (18) to (26). Here, in the formula (25), u represents an integer in a range of 0 to 3.

(18) $—CH_2—$

(19) $—C(CH_3)_2—$

(20) $—O—$

(21) $—S—$

(22) $—C(CF_3)_2—$

(23) $—Si(CH_3)_2—$ (24)

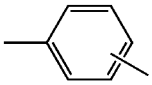

(25)

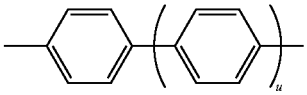

(26)

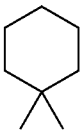

In addition, in the general formula (A), $Ar^5$ represents a substituted or unsubstituted aryl group when k is 0, and examples of the aryl group include the same one as the aryl group exemplified in the description of $Ar^1$ to $Ar^4$. In addition, $Ar^5$ represents a substituted or unsubstituted arylene group when k is 1, and examples of the arylene group include an arylene group which is obtained by removing one hydrogen atom at a position where $—N(Ar^3\text{-}(D)_{C3})(Ar^4\text{-}(D)_{C4})$ is substituted from the aryl group exemplified in the description of $Ar^1$ to $Ar^4$.

Hereinafter, the specific examples of the compounds (compounds A-1 to A-21) represented by the general formula (A) are described. Note that, the compound represented by the general formula (A) is not limited to the examples at all.
| No. | |
|---|---|
| A-1 | 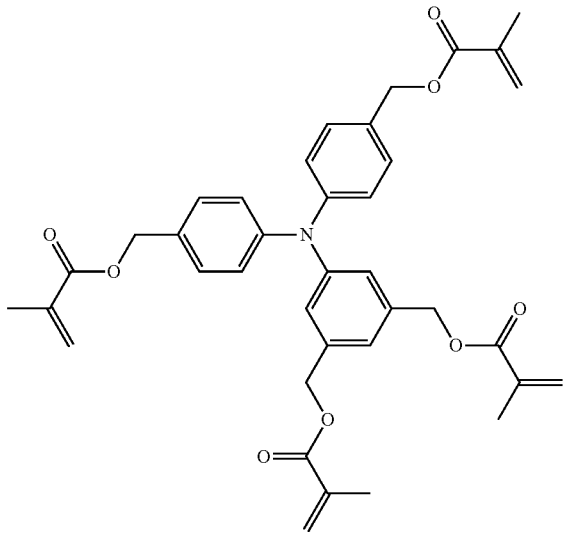 |
| A-2 | 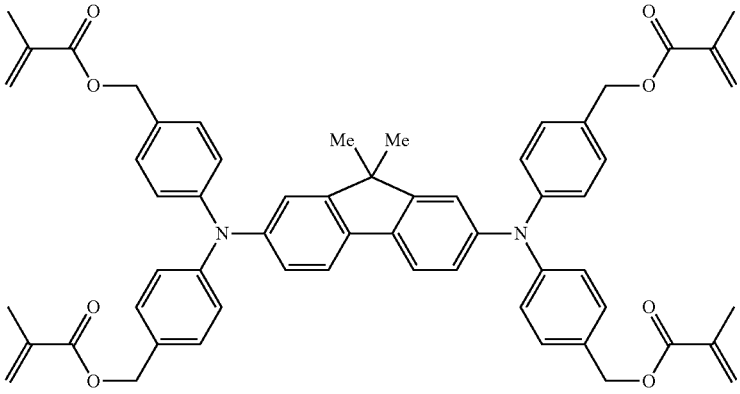 |
| A-3 | 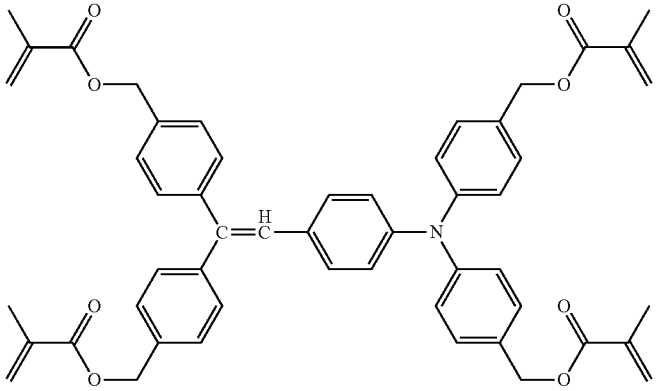 |

-continued
| No. | |
|---|---|
| A-4 | 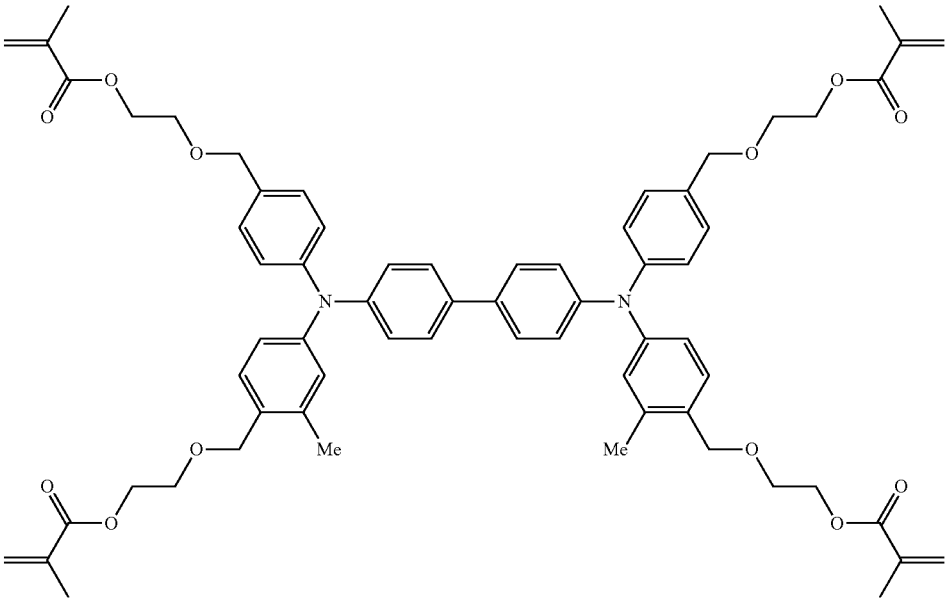 |
| A-5 | 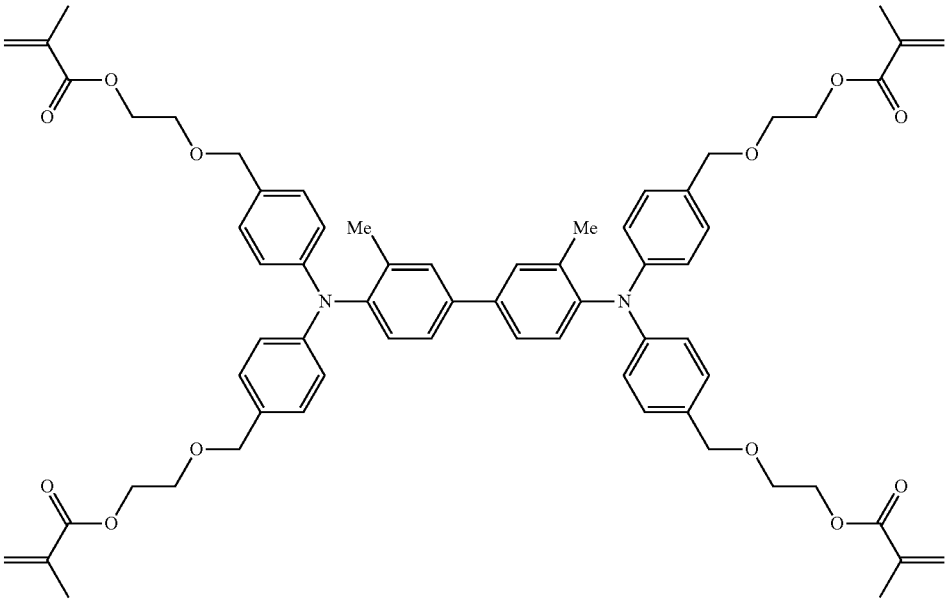 |

-continued
| No. | |
|---|---|
| A-6 | 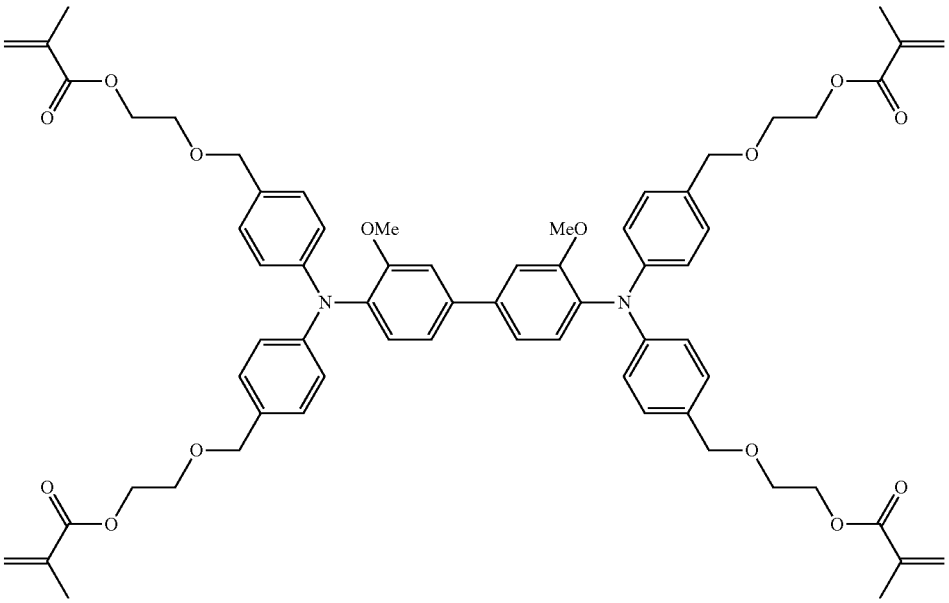 |
| A-7 | 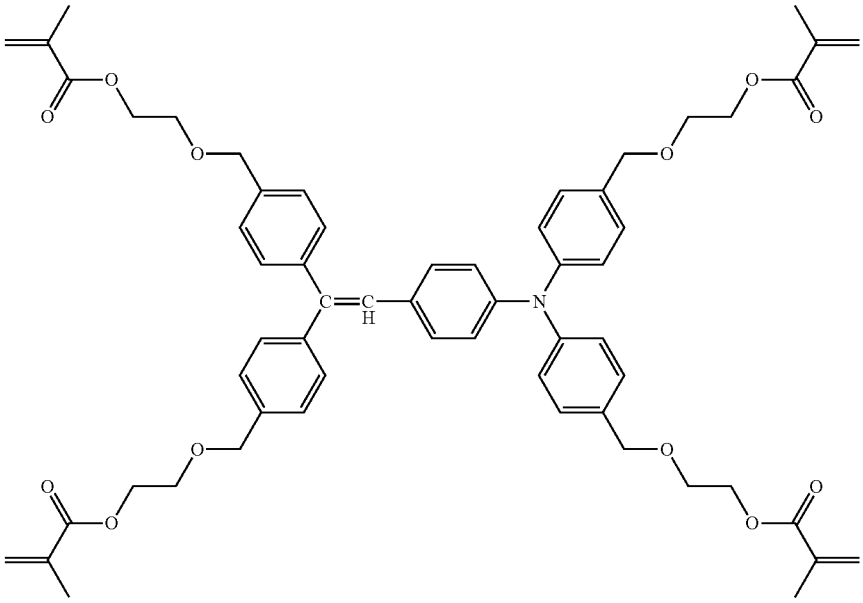 |

-continued
| No. | |
|---|---|
| A-8 | 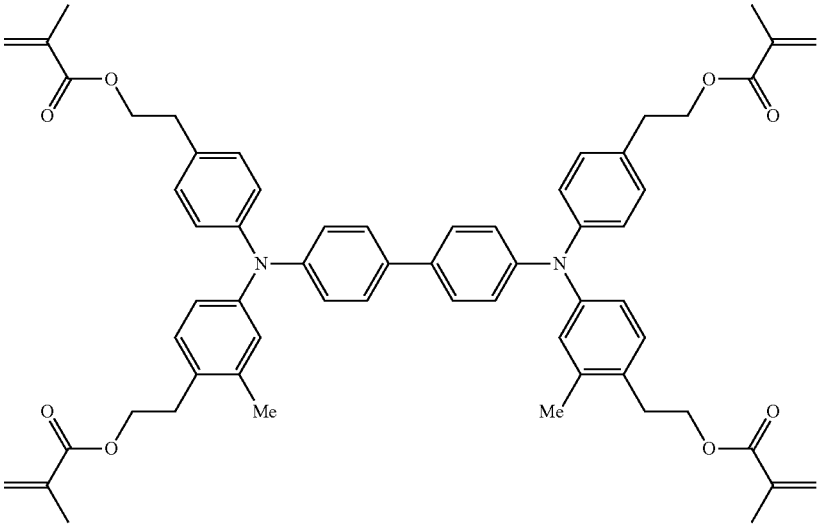 |
| A-9 | 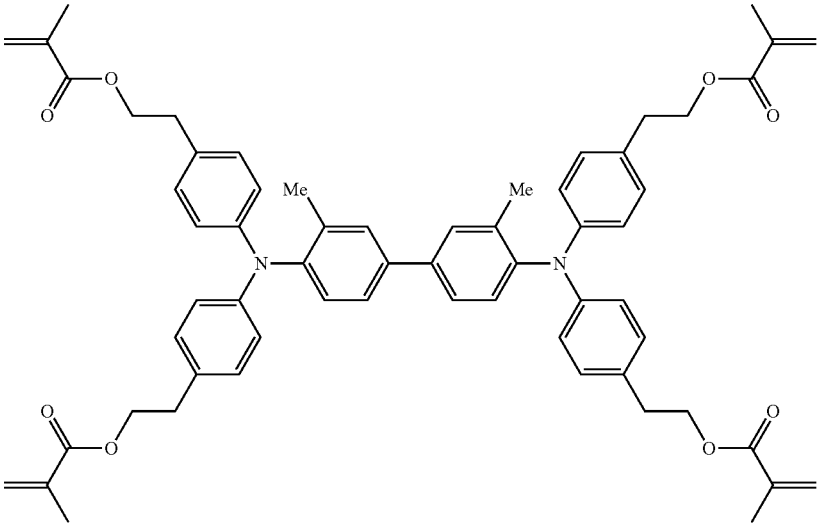 |
| A-10 | 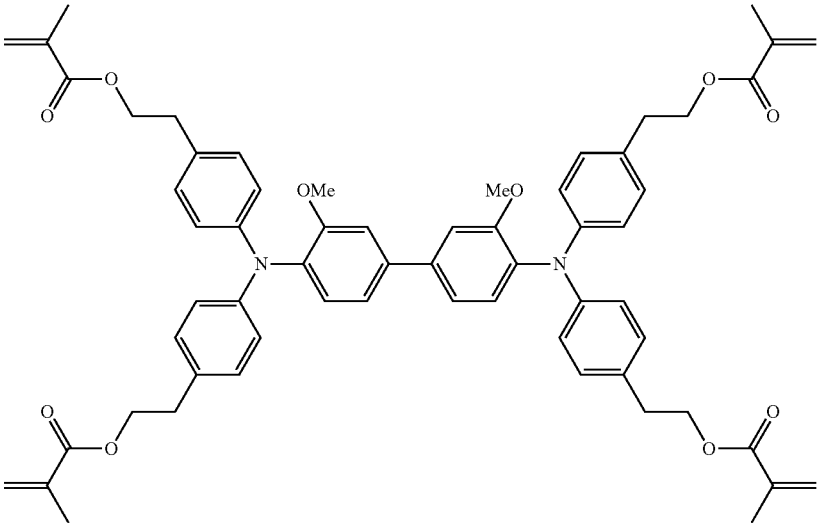 |

-continued
| No. |
| --- |
| A-11 |
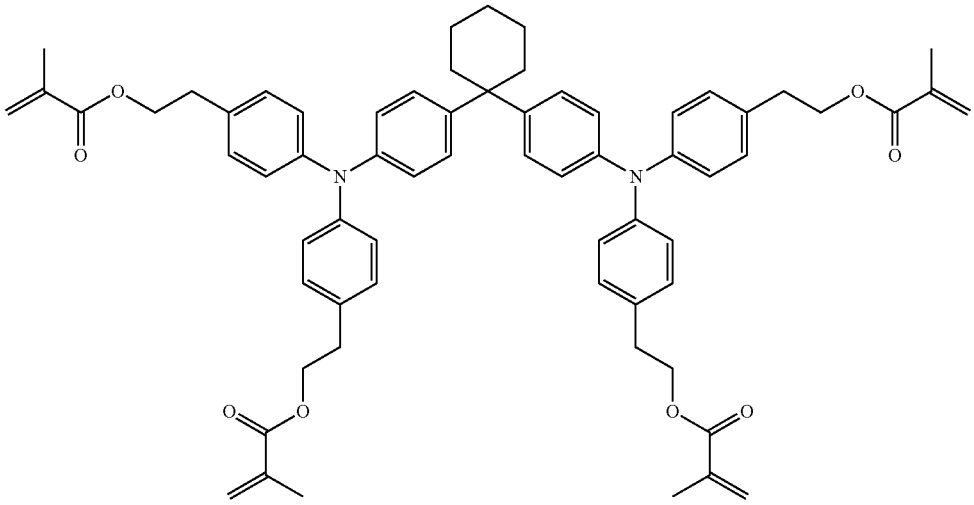
A-12
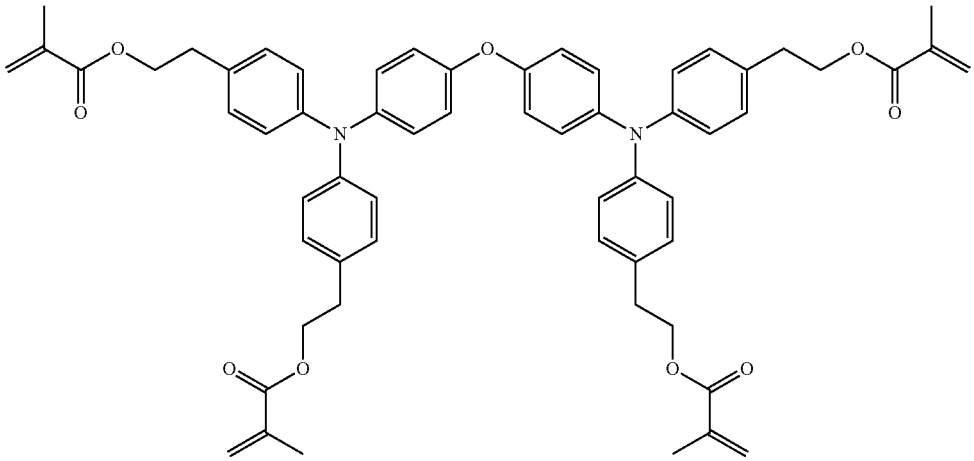
A-13
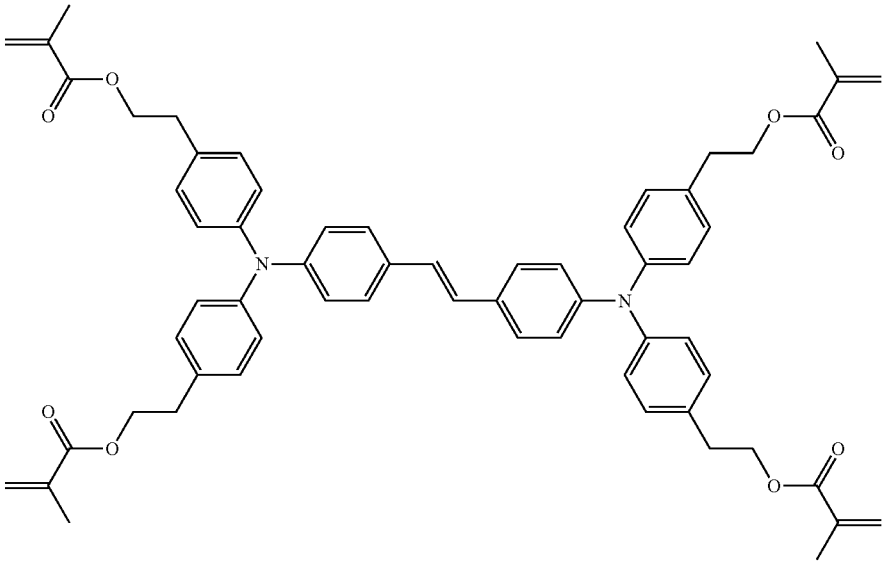

-continued
| No. | |
|---|---|
| A-14 | 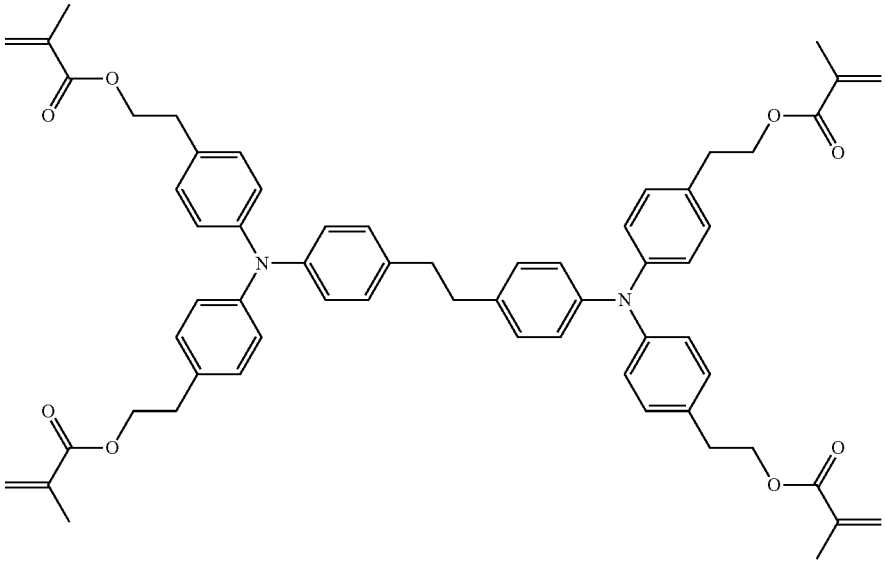 |
| A-15 | 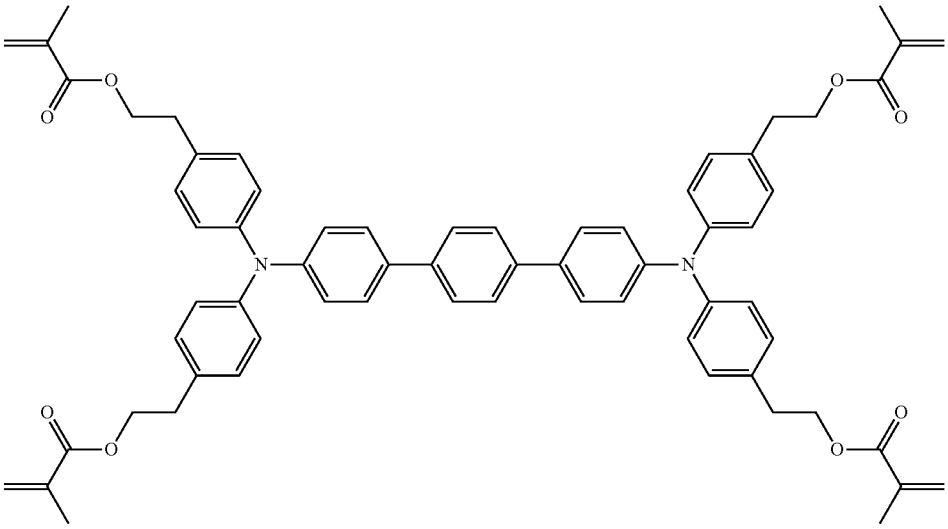 |

-continued
| No. | |
|---|---|
| A-16 | 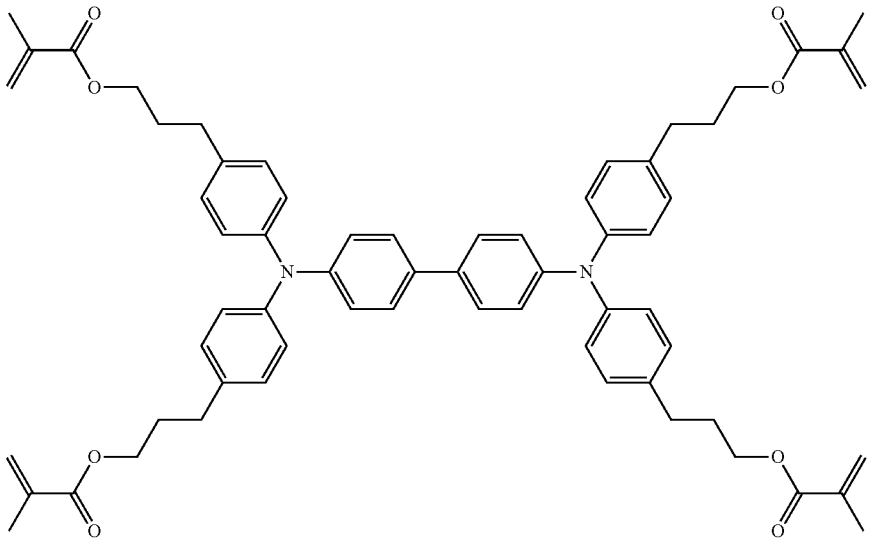 |
| A-17 | 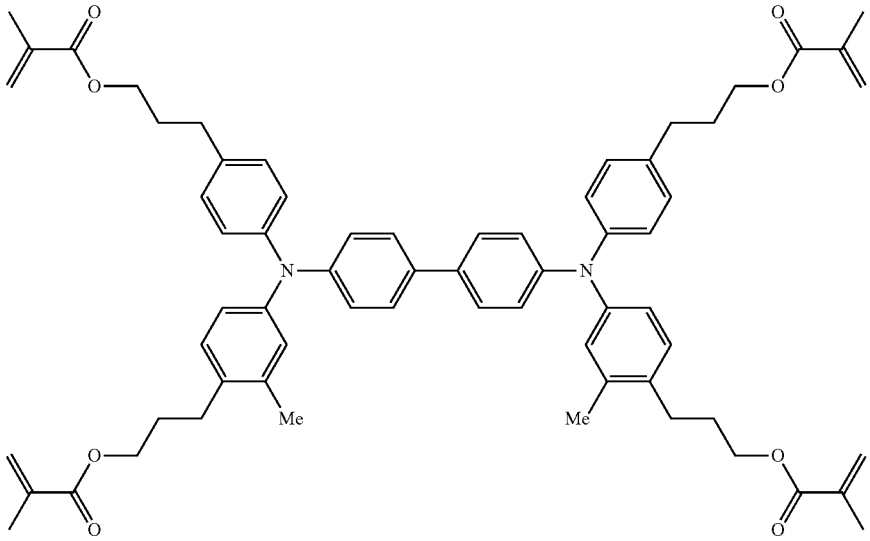 |
| A-18 | 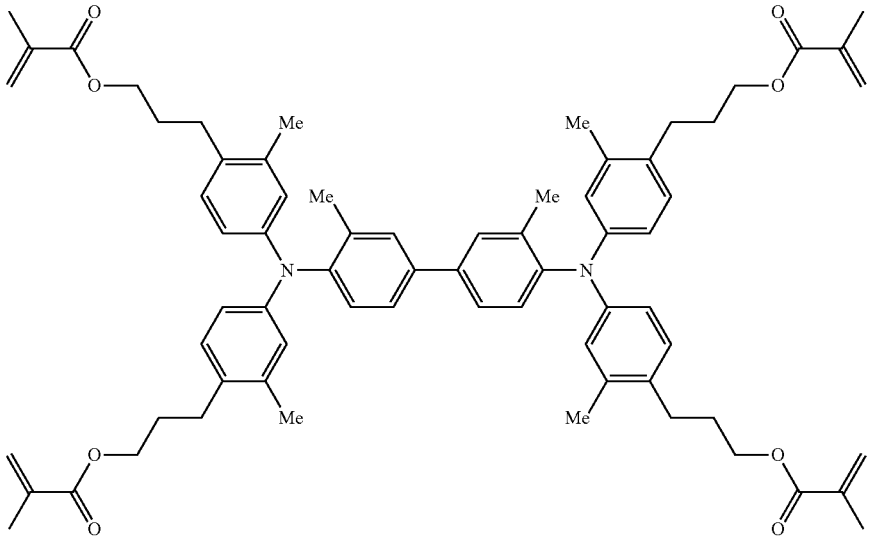 |

-continued
| No. |
| --- |
A-19
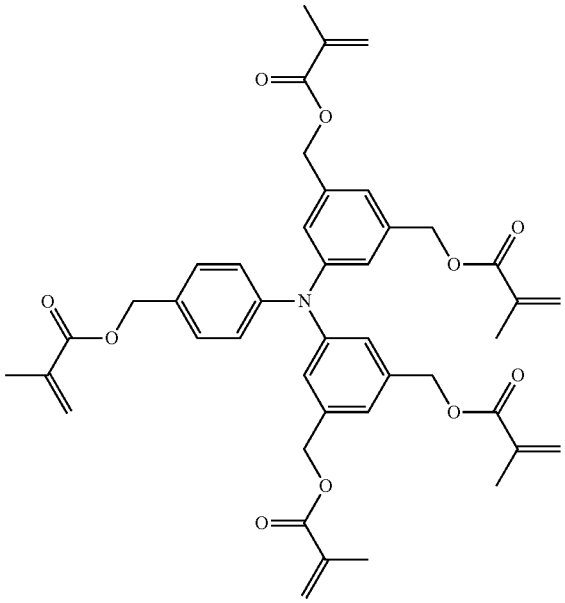
A-20
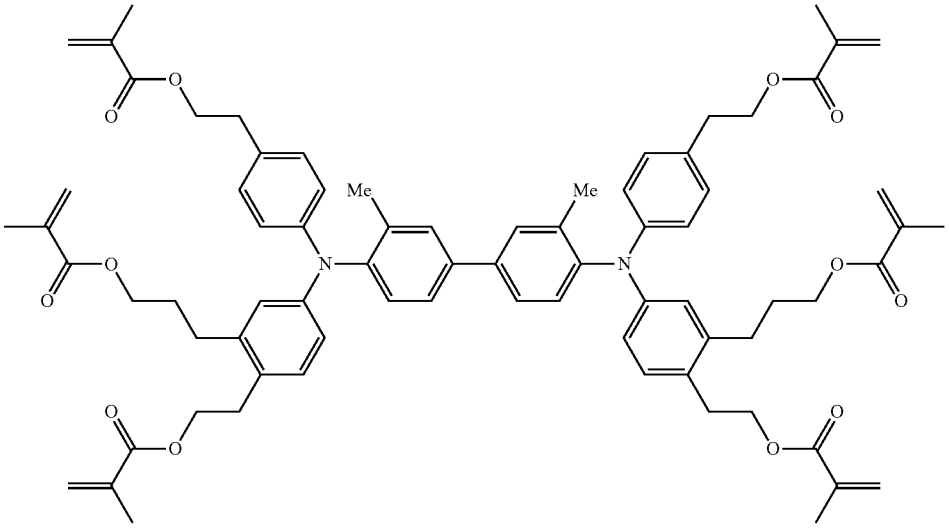

-continued

| No. | |
|---|---|
| A-21 | 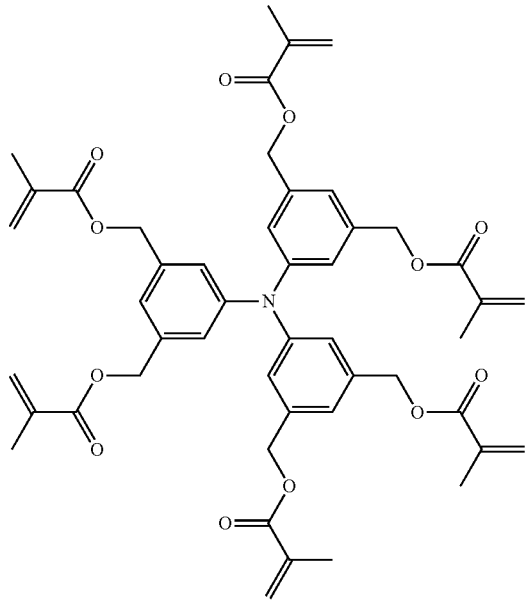 |

The compounds represented by the general formula (A) are synthesized as follows.

That is, the compounds represented by the general formula (A) may be obtained by condensing precursor alcohol condensed with the corresponds methacrylic acid, or methacrylic acid halide, or by being synthesized with a methacrylic acid derivative having a hydroxyl group such as hydroxyethyl methacrylate through dehydration etherification and the like in a case where the precursor alcohol is a benzyl alcohol structure.

A synthetic route of compound A-4 and compound A-17 which are compounds represented by the general formula (A) will be described as an example.

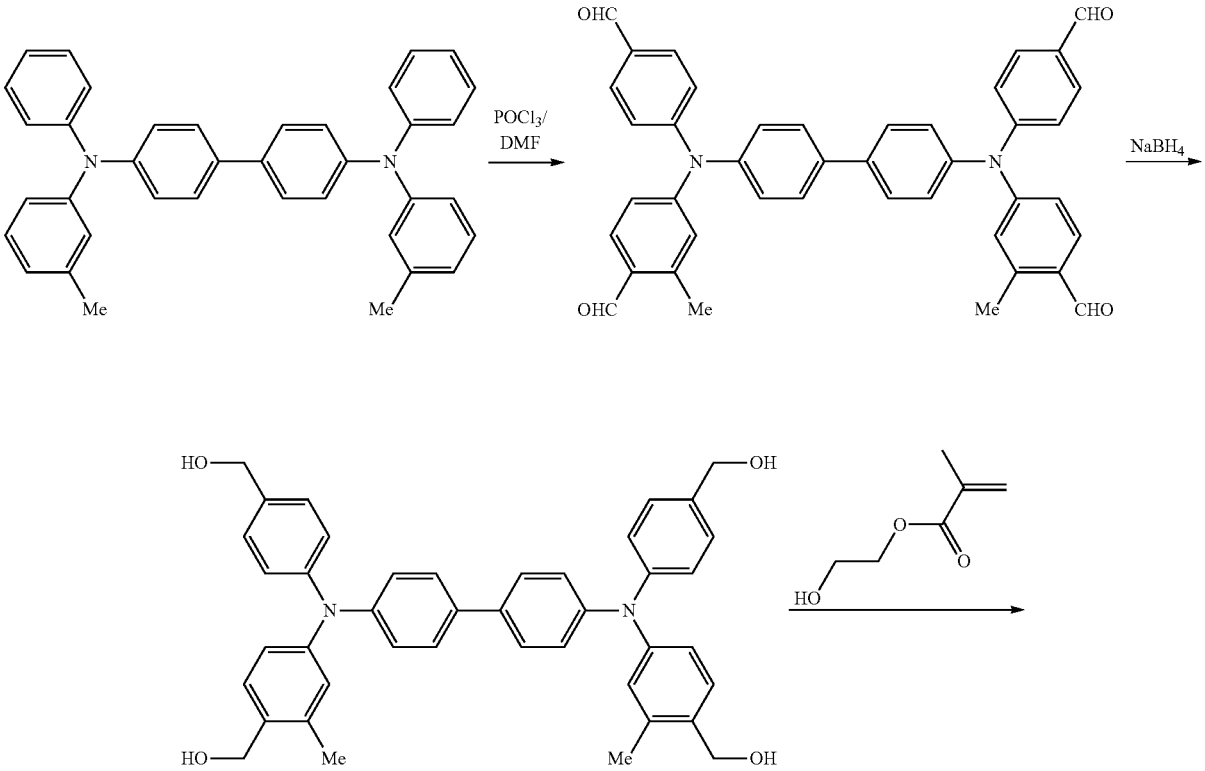

-continued
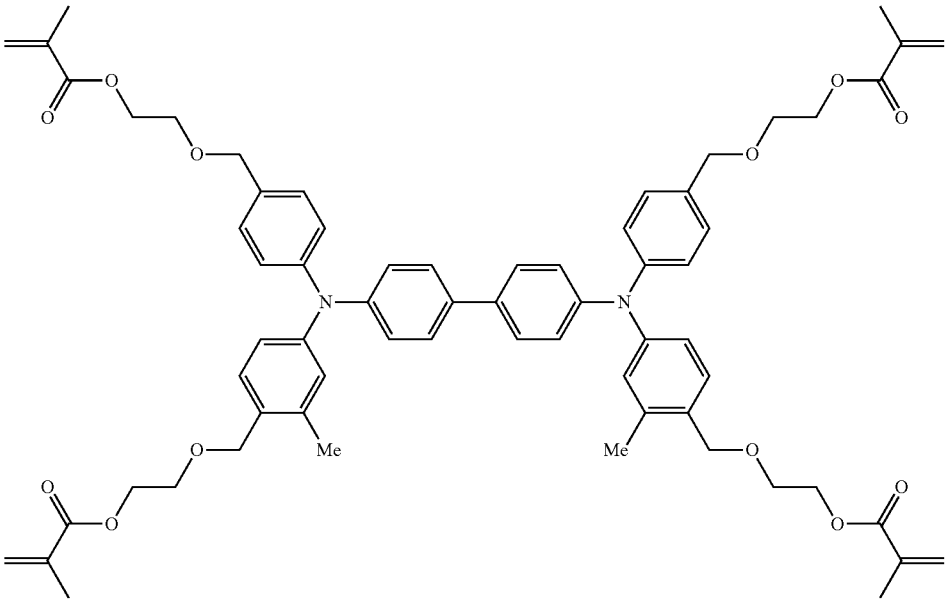
Compound A-4
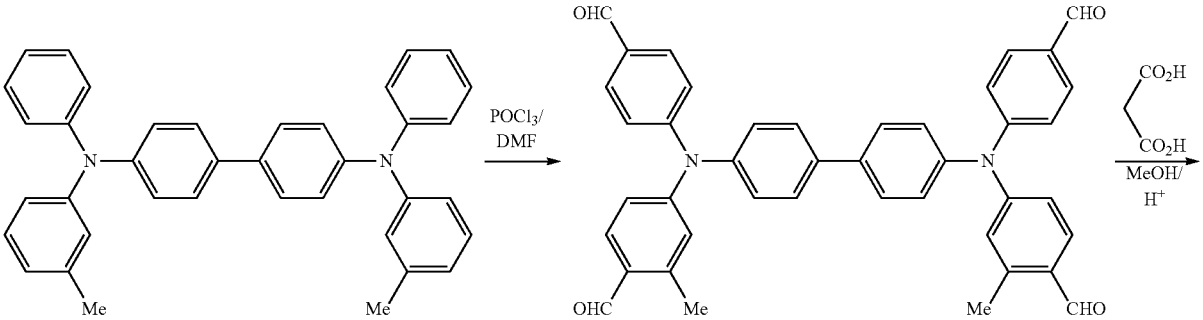
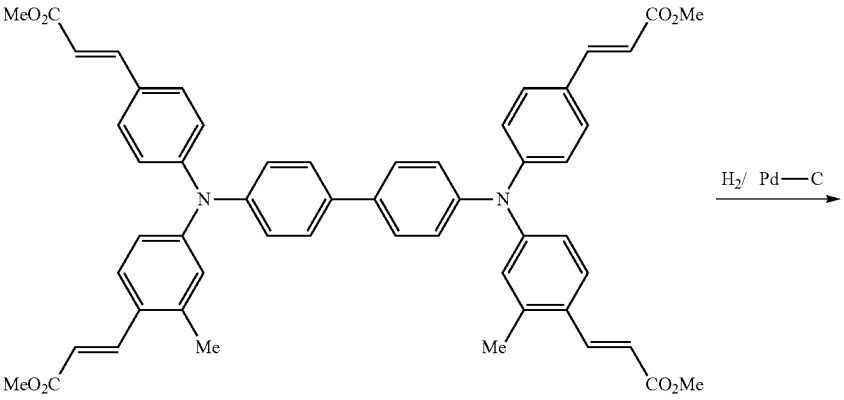

-continued

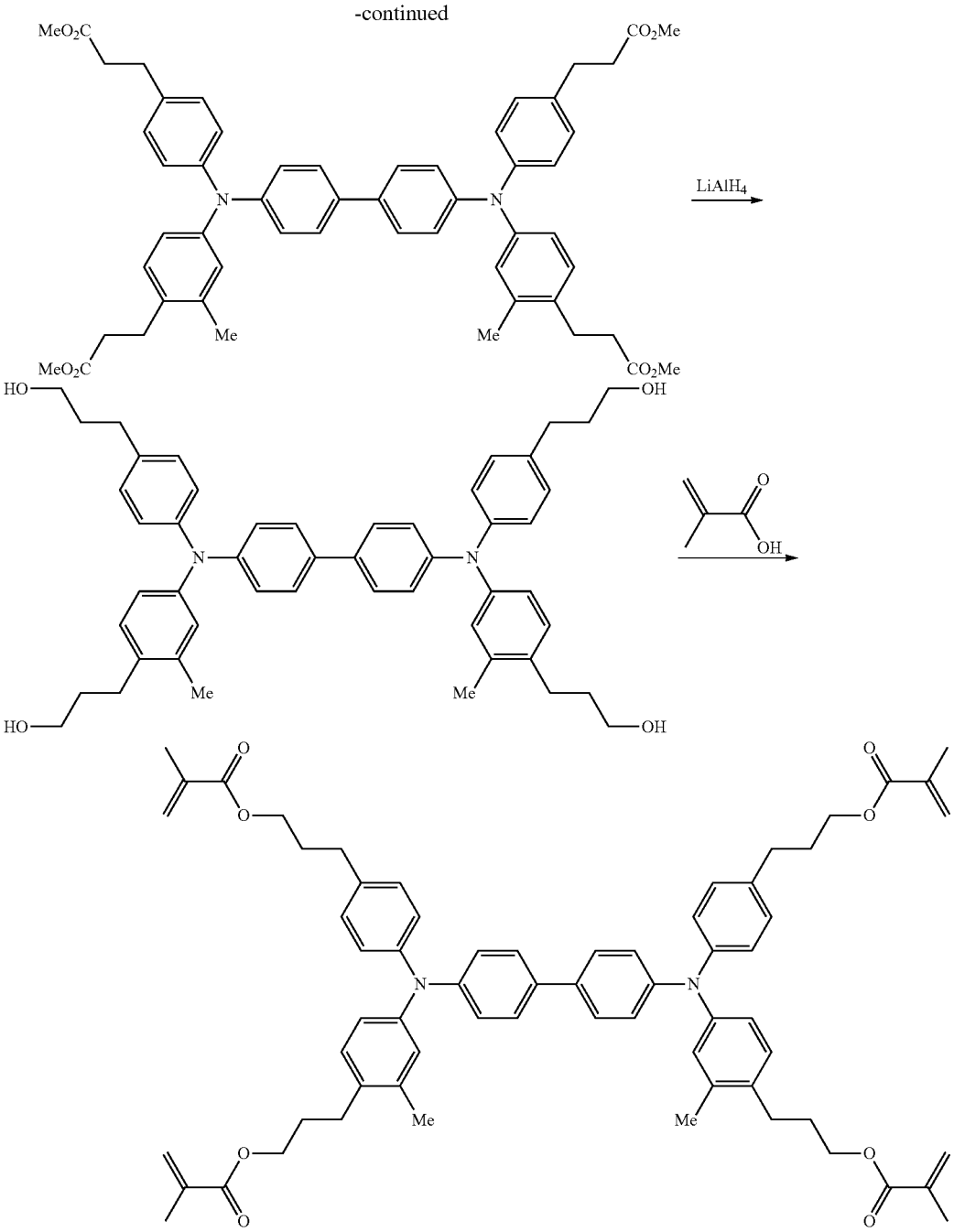

Compound A-17

As described above, as preferable aspect of the specific charge transport material (a), the compound (a') having the triphenyl amine skeleton and four or more methacryloyl groups in the same molecule is described; however, in addition to the above compound, the following compounds (hereinafter, referred to as "other reactive charge transport materials (a")) are used as the specific charge transport material (a).

In other words, examples of other reactive charge transport materials (a") include a compound (a") in which an acryloyl group or a methacryloyl group are introduced to the well-known charge transport material. Examples of the well-known charge transport material include, a triarylamine compound, a benzidine compound, an arylalkane compound, an aryl substituted ethylene compound, a stilbene compound, an anthracene compound, and a hydrazone compound which are exemplified as a hole transporting compound in the charge transport materials forming the charge transport layer. More specifically, examples of other reactive charge transport materials (a") include a compound disclosed in JP-A-5-216249, a compound disclosed in JP-A-2000-206715, a compound disclosed in JP-A-2004-12986, a compound disclosed in JP-A-7-72640, a compound disclosed in JP-A-2004-302450, a compound disclosed in JP-A-2000-206717, a compound disclosed in JP-A-2001-175016, and a compound disclosed in JP-A-2005-115353.

Among them, as other reactive charge transport materials (a"), compounds having the triphenyl amine skeleton and one to three more acryloyl groups or a acryloyl group in the same molecule are preferably used. particularly, in the general formula (A), compounds in which D represents $—(CH_2)_f—(O—CH_2—CH_2)_g—O—CO—C(R)=CH_2$, f represents an integer in a range of 0 to 5, g represents 0 or 1, R represents a hydrogen atom or a methyl group, the total numbers of D is in a range of 1 to 3 are preferably used. Among them, a compound in which in D, f is an integer in a range of 1 to 5, and R is a methyl group is preferably used.

Hereinafter, specific examples of other reactive charge transport materials (a") will be described.

As specific examples of the compound which is one of other reactive charge transport materials (a"), and has the triphenyl amine skeleton and one acryloyl group or a methacryloyl group in the same molecule, compounds I-1 to I-12 are exemplified; however, the examples are not limited thereto.

| No. | |
|---|---|
| I-1 | 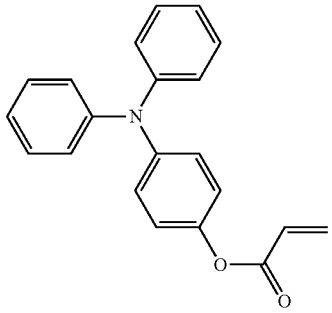 |
| I-2 | 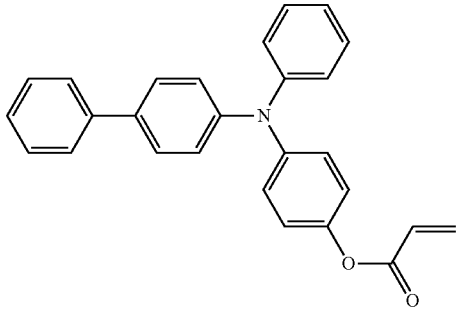 |
| I-3 | 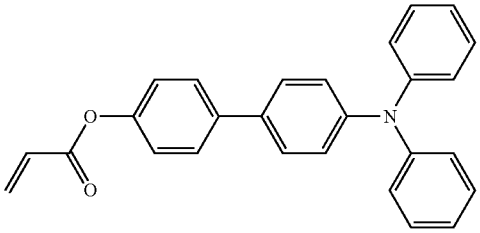 |
| I-4 | 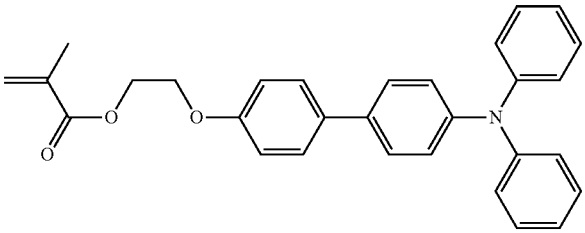 |

-continued
| No. | |
|---|---|
| I-5 | 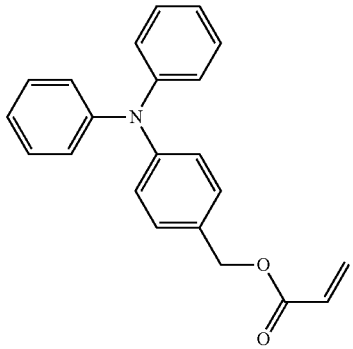 |
| I-6 | 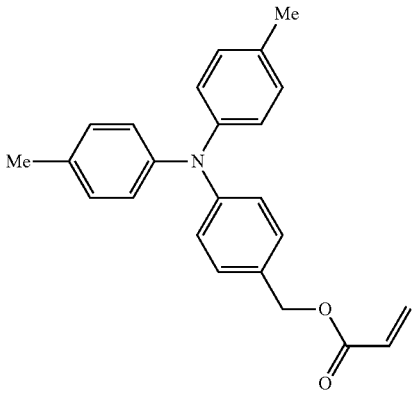 |
| I-7 | 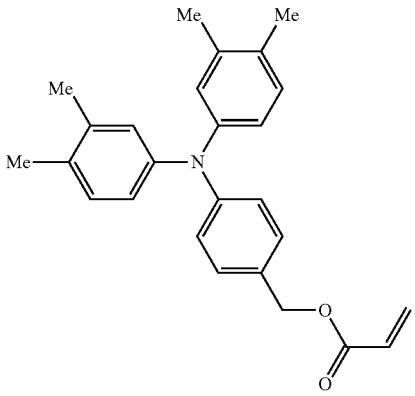 |
| I-8 | 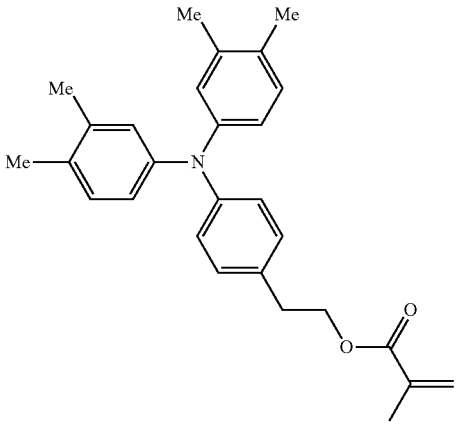 |

-continued
| No. | |
|---|---|
| I-9 | 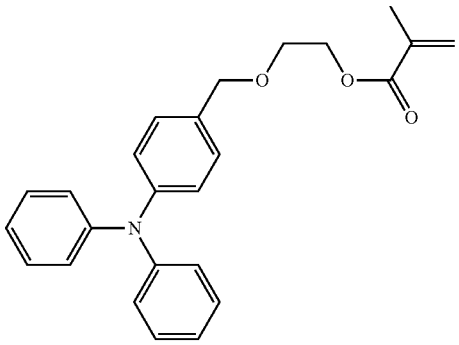 |
| I-10 | 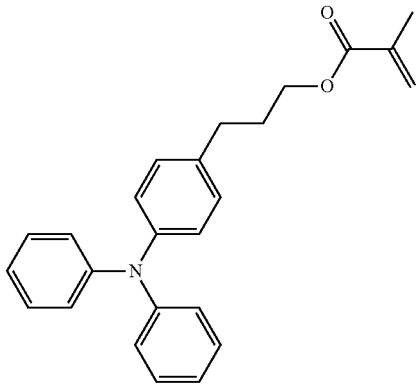 |
| I-11 | 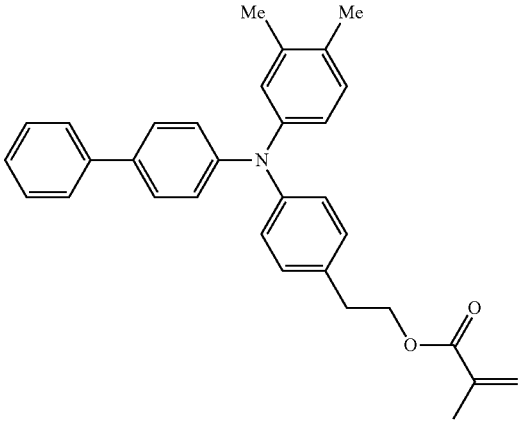 |
| I-12 | 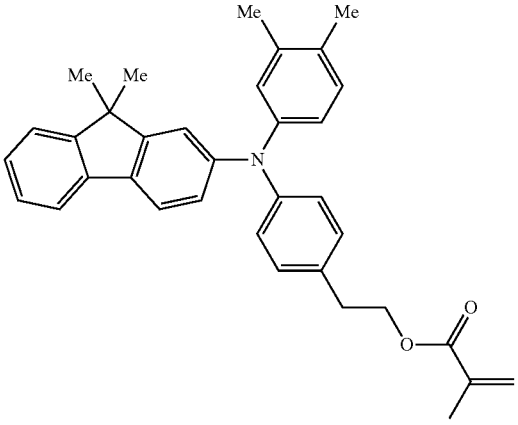 |

As specific examples of the compound which is one of other reactive charge transport materials (a"), and has the triphenyl amine skeleton and two acryloyl groups or a methacryloyl group in the same molecule, compounds II-1 to II-19 are exemplified; however, the examples are not limited thereto.
| No. | |
|---|---|
| II-1 | 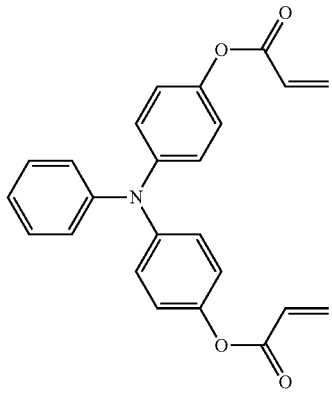 |
| II-2 | 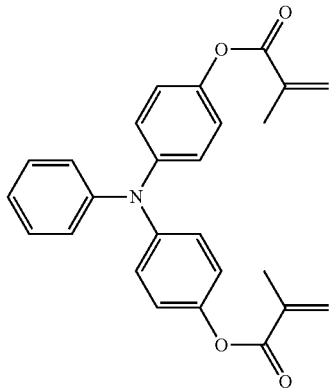 |
| II-3 | 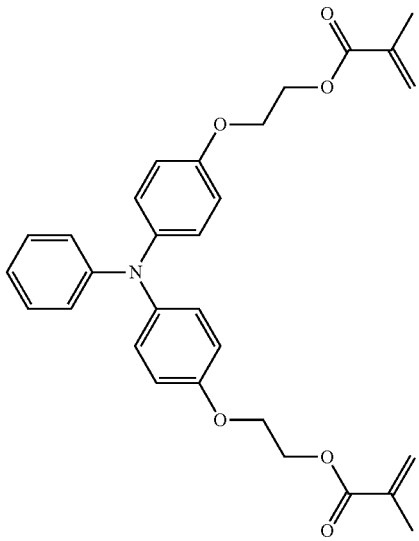 |

-continued
| No. | |
|---|---|
| II-4 | 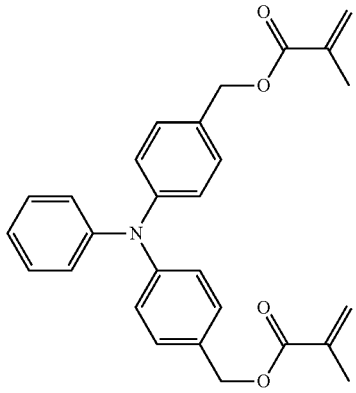 |
| II-5 | 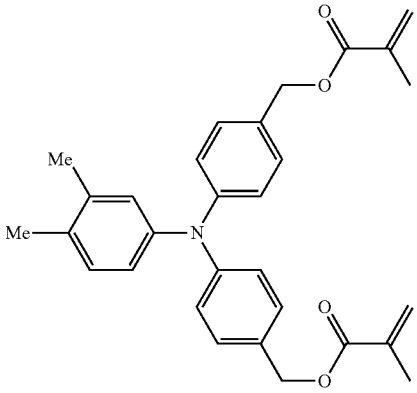 |
| II-6 | 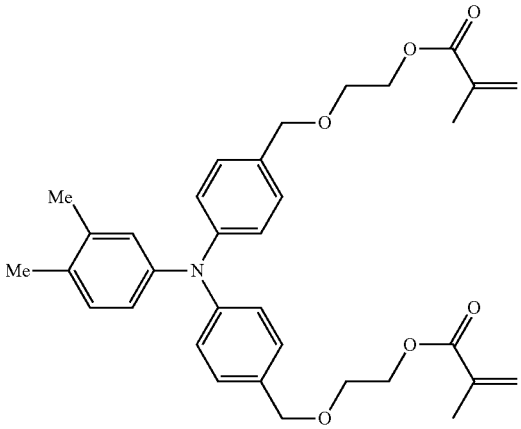 |

-continued
| No. | |
|---|---|
| II-7 | 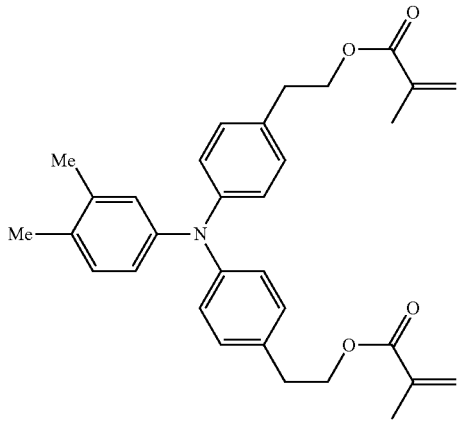 |
| II-8 | 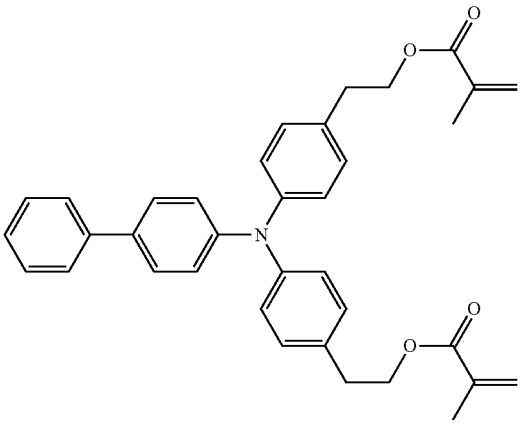 |
| II-9 | 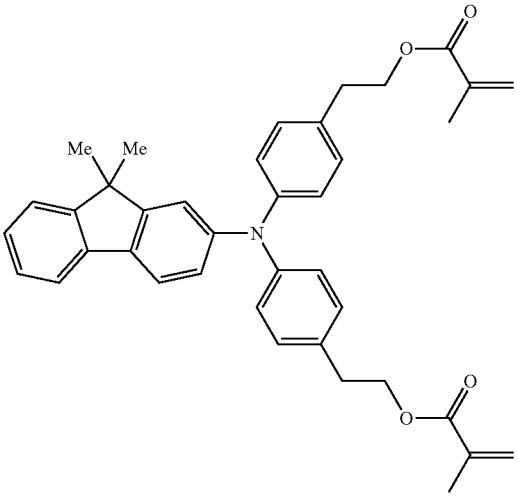 |

-continued
| No. | |
|---|---|
| II-10 | 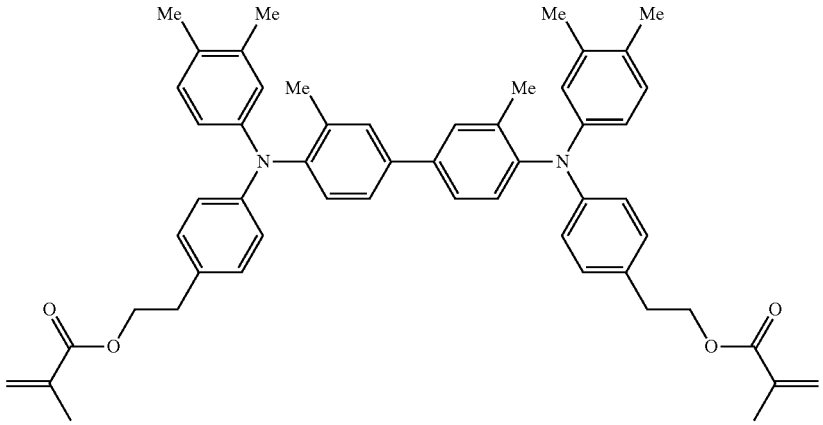 |
| II-11 | 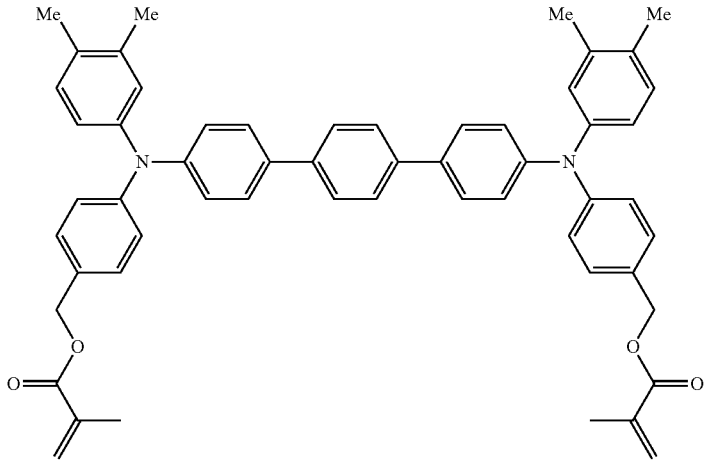 |
| II-12 | 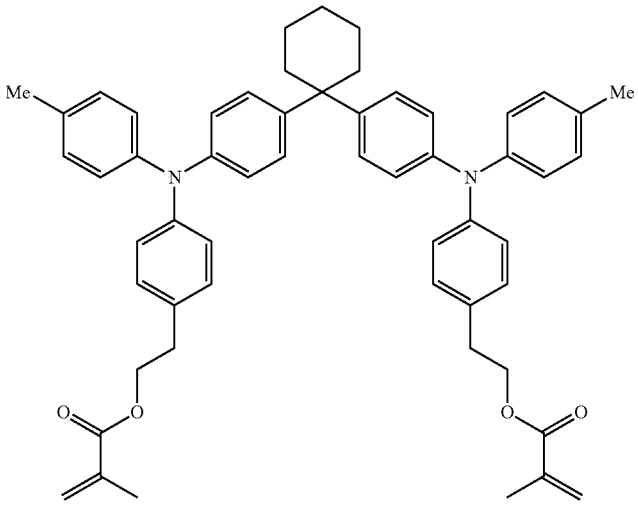 |

-continued
| No. | |
|---|---|
| II-13 | 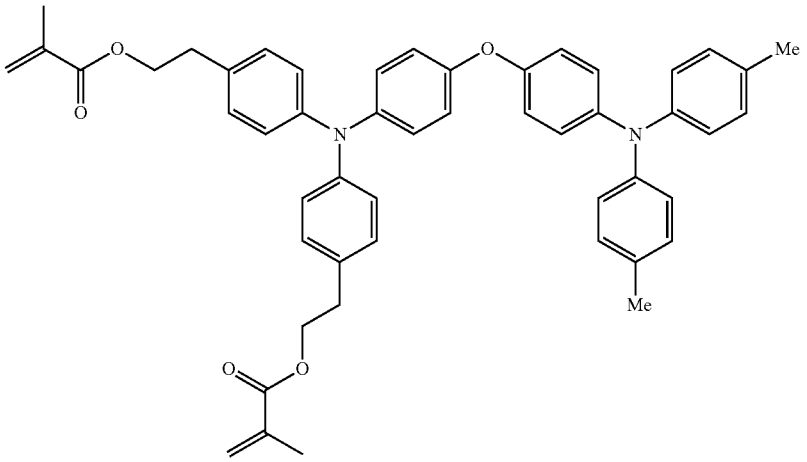 |
| II-14 | 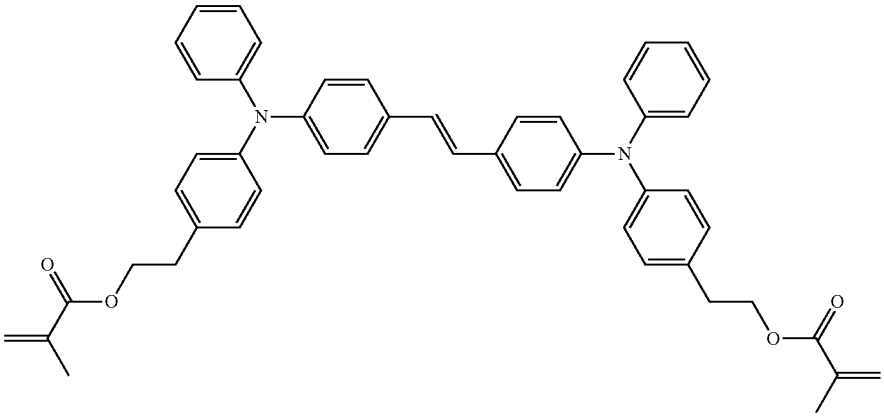 |
| II-15 | 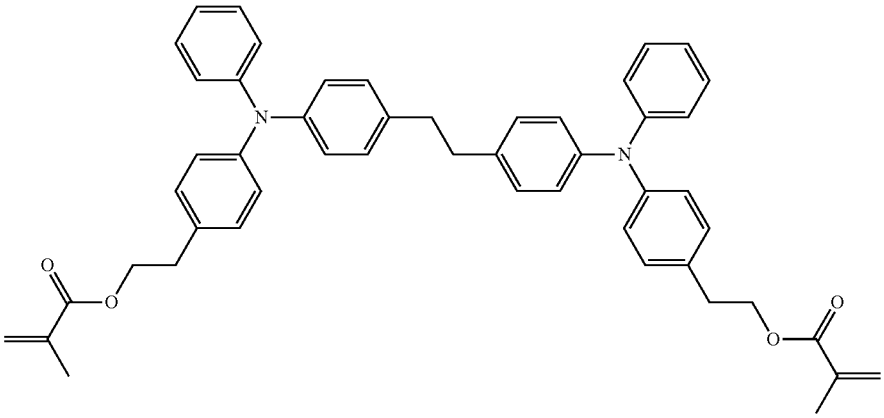 |

-continued
| No. | |
|---|---|
| II-16 | 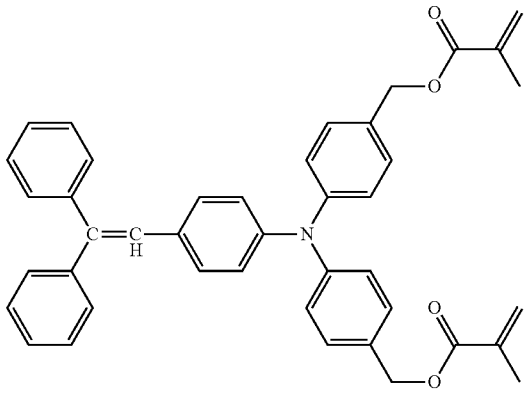 |
| II-17 | 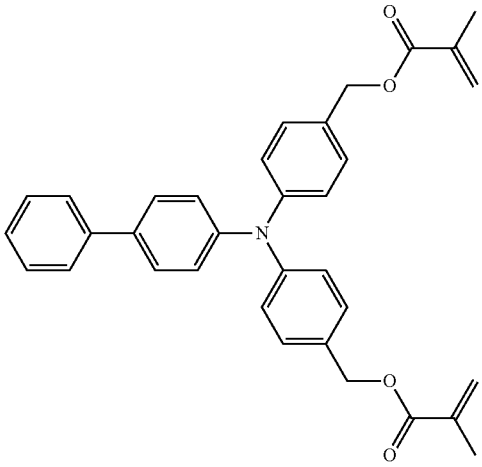 |
| II-18 | 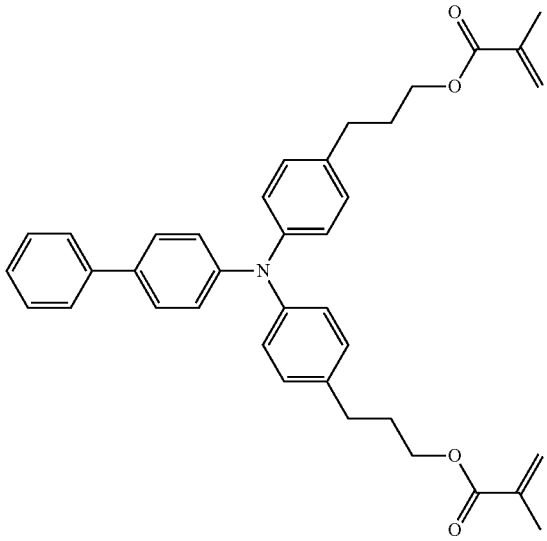 |

-continued
| No. | |
|---|---|
| II-19 | 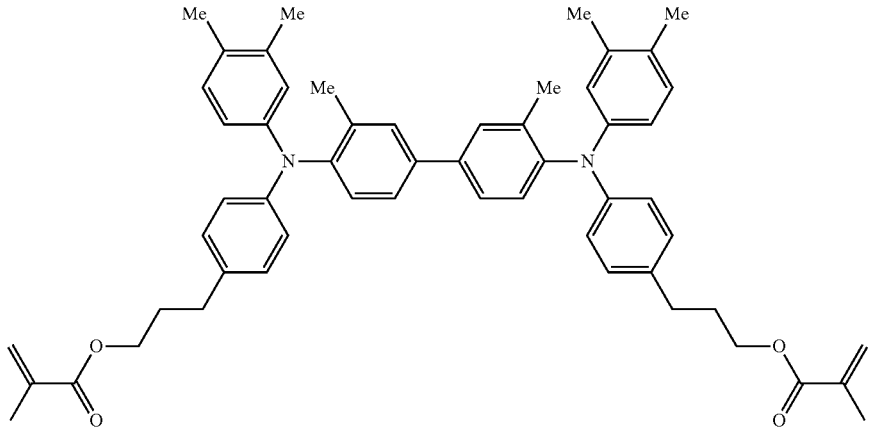 |
As specific examples of the compound which is one of other reactive charge transport materials (a"), and has the triphenyl amine skeleton and three acryloyl groups or a methacryloyl group in the same molecule, compounds III-1 to III-11 are exemplified; however, the examples are not limited thereto.
| No. | |
|---|---|
| III-1 | 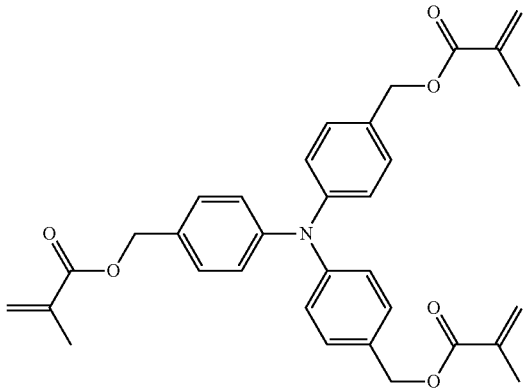 |
| III-2 | 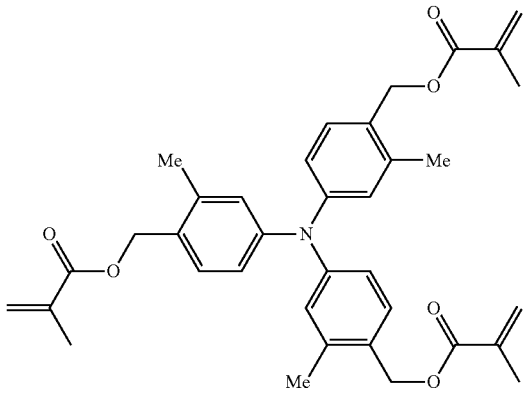 |

-continued
| No. |
| --- |
III-3
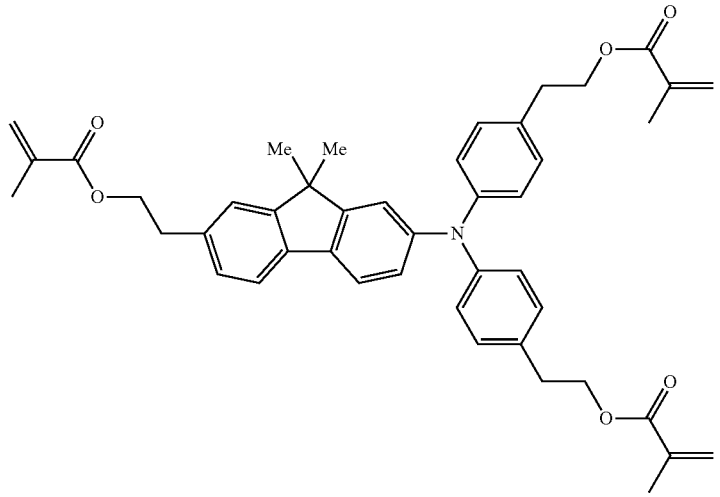
III-4
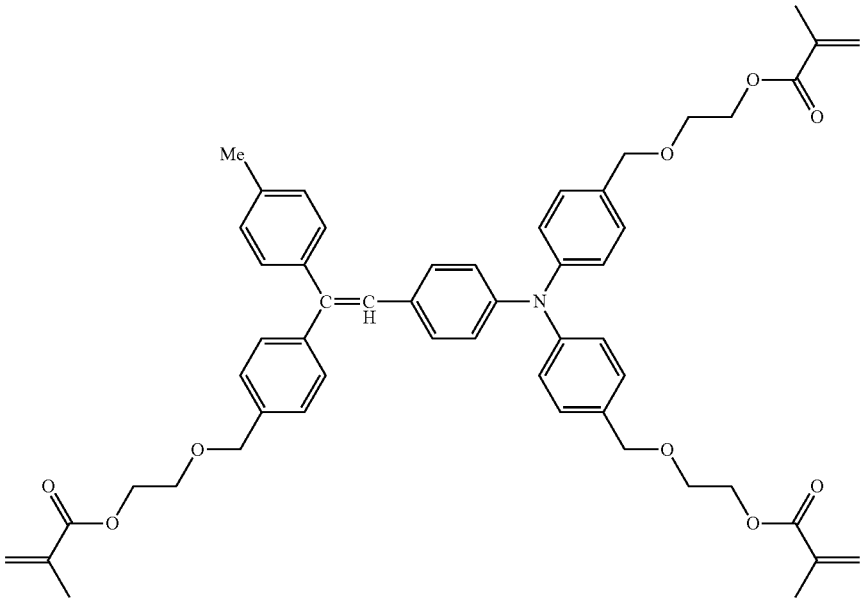

-continued
| No. |
| --- |
| III-5 |
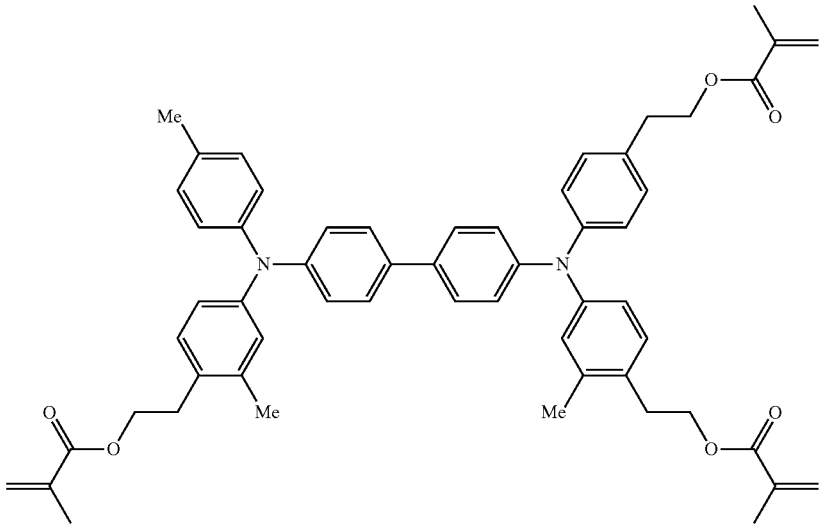
III-6
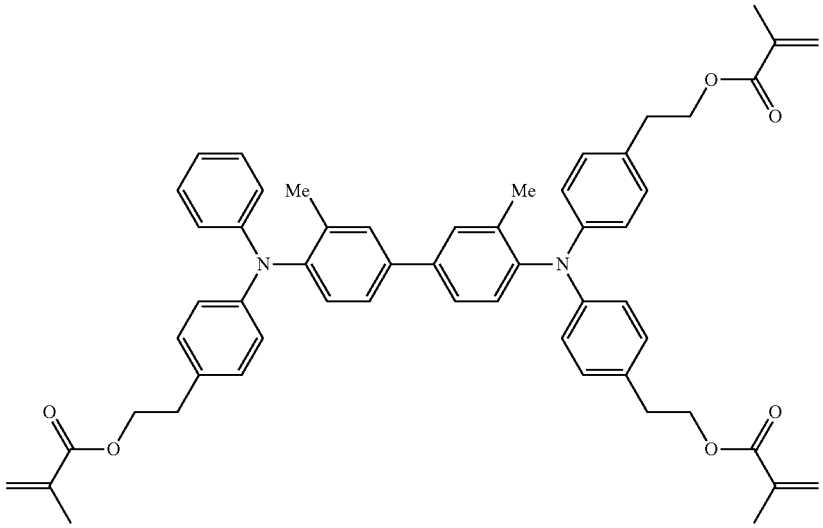
III-7
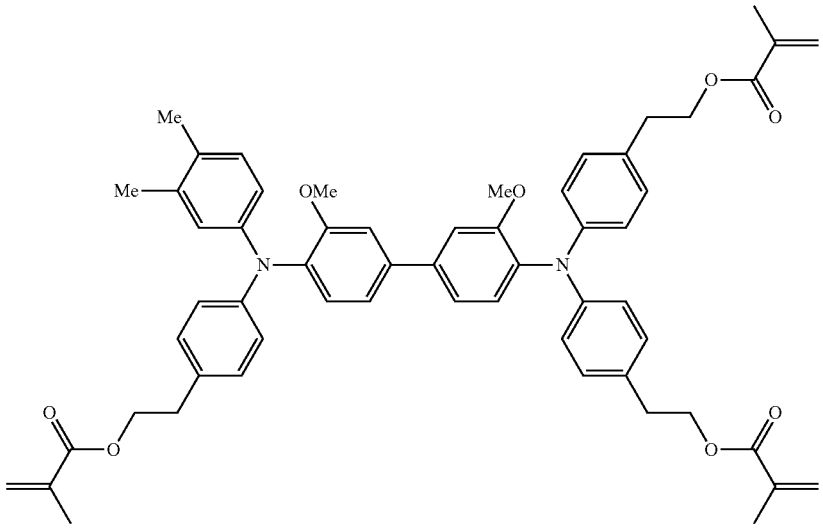

-continued
| No. | |
|---|---|
| III-8 | 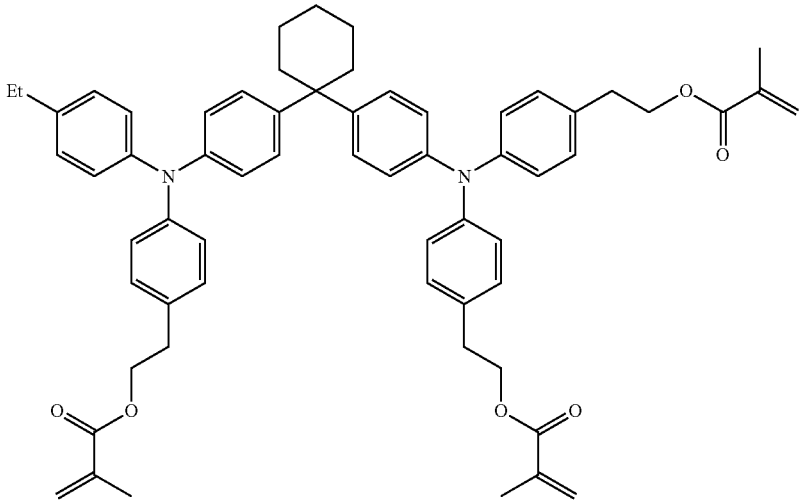 |
| III-9 | 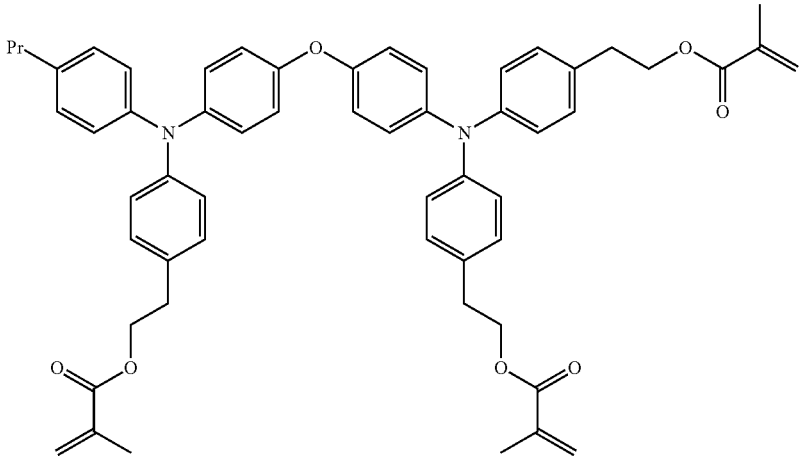 |
| III-10 | 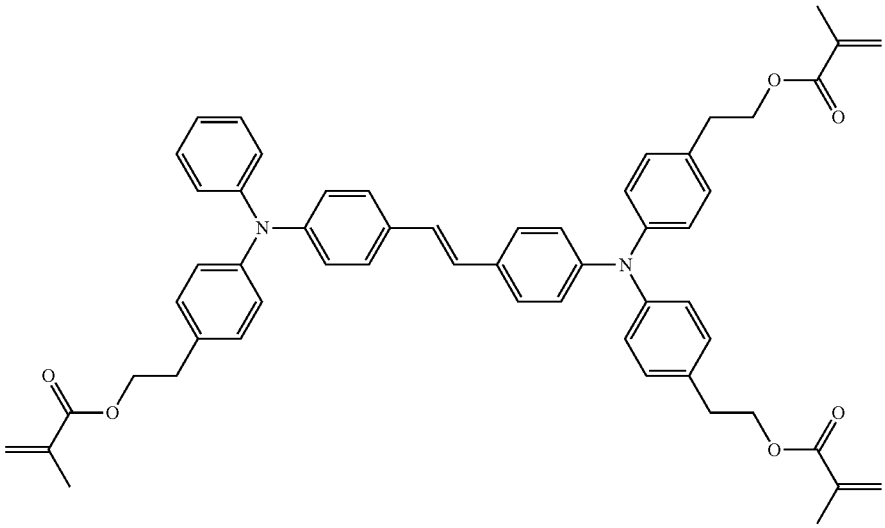 |

-continued

| No. | |
|---|---|
| III-11 | 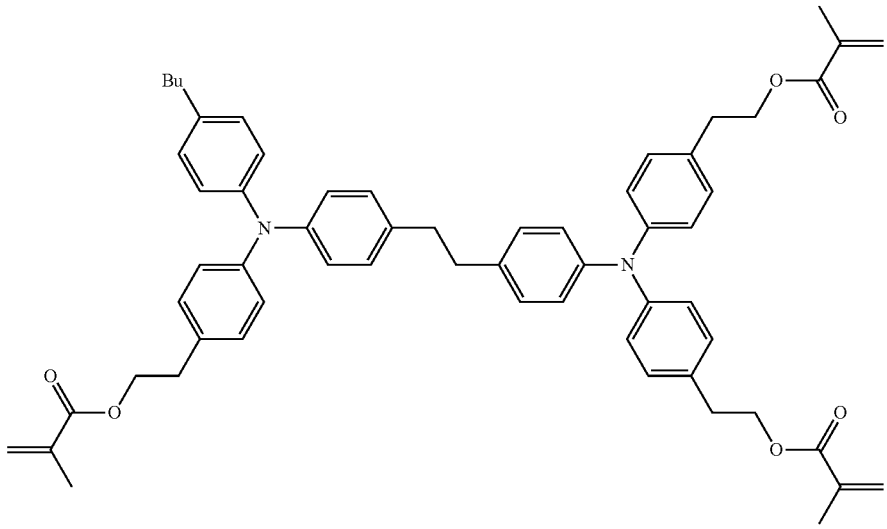 |

Note that, in the compounds I-1 to I-12, the compounds II-1 to II-19, and the compounds III-1 to III-11 described above, "Me" represents a methyl group, "Et" represents an ethyl group, "Pr" represents a propyl group, and "Bu" represents a butyl group.

The total content of the specific charge transport materials (a) is preferably in a range of 30% by weight to 100% by weight, is further preferably in a range of 40% by weight to 100% by weight, and is still further preferably in a range of 50% by weight to 100% by weight, with respect to the composition (solid content) used at the time of forming the overcoat layer.

When the content is in the above-described range, it is possible to obtain a cured film which is thick and excellent in electrical properties.

Further, among the specific charge transport materials (a), the content of the compound having the charge transport skeleton and three or more acryloyl groups or methacryloyl groups is 5% by weight or more, is further preferably 10% by weight or more, and still further preferably 15% by weight or more with respect to the composition used at the time of forming the overcoat layer.

As the specific charge transport material (a), it is preferable to use a compound having a charge transport skeleton and four or more acryloyl groups or methacryloyl groups, and a compound having a charge transport skeleton and one or two acryloyl groups or methacryloyl groups in combination. Particularly, it is preferable to use the compound represented by the general formula (A) and e compound having the triphenyl amine skeleton and one or two acryloyl groups or methacryloyl groups in the same molecule in combination.

In this aspect, as compared with the compound having four or more methacryloyl groups (reactive groups), in all of the specific charge transport materials (a), the crosslink density may be decreased without reducing the amount of the charge transport skeletons, and thus it is possible to adjust the strength of the overcoat layer while maintaining the electrical properties.

In a case where the compound having the charge transport skeleton and four or more acryloyl groups or methacryloyl groups, and the compound having the charge transport skeleton and one to three acryloyl groups or methacryloyl groups are used in combination, the content of the compound having the charge transport skeleton and four or more acryloyl groups or methacryloyl groups is preferably 5% by weight or more, is further preferably 10% by weight or more, and is still further preferably 15% by weight or more with respect to the entire amount of the specific charge transport materials (a).

In addition, the specific charge transport material (a) is not limited to the configuration of containing the compound having the charge transport skeleton and four or more acryloyl groups or methacryloyl groups. A configuration of containing only the compound having the charge transport skeleton and one to three acryloyl groups or methacryloyl groups as the specific charge transport material (a) may be employed.

Other Charge Transport Materials

In addition, the cured film forming the overcoat layer may be obtained by using a well-known charge transport material which does not have a reactive group other than the above-described specific charge transport material (a), if necessary. Here, the reactive group means a radical polymerizable unsaturated bond.

Regarding the well-known charge transport material which does not have a reactive group, for example, when the well-known charge transport material is used in combination, since it does not have a reactive group, the concentration of the charge transport components is substantially increased, and thus the electrical properties of the overcoat layer may be further improved. In addition, the well-known charge transport material which does not have a reactive group may be contributed to adjust the strength of the overcoat layer. Further, since the specific charge transport material (a) has the charge transport skeleton, it has excellent compatibility with the well-known charge transport material which does not have a reactive group, and thus doping of the charge transport material which does not have a reactive group in the related art is performed, thereby realizing the further improved electrical properties.

Examples of the well-known charge transport material which does not have a reactive group include charge transport materials which are exemplified as the charge transport material constituting the above-described charge transport layer are used. Among them, a charge transport material having a triphenyl amine skeleton is preferably used in terms of the mobility and compatibility.

The content of the well-known charge transport material which does not have a reactive group is preferably used in a range of 2% by weight to 50% by weight, is further preferably used in a range of 5% by weight to 45% by weight, and is still further preferably used in a range of 10% by weight to 40% by weight with respect to the solid content of the composition used at the time of forming the overcoat layer.

Polymerization Initiator

The overcoat layer is formed by polymerizing and curing the composition containing the specific charge transport material (a) with the application of at least one energy selected from thermal energy, light energy, and electron beam energy. Note that, in polymerizing and curing reaction, a polymerization initiator (b) may be used; however, the reaction easily proceeds by using at least one polymerization initiator (b) selected from a photopolymerization initiator and a thermal polymerization initiator which are exemplified as described below.

Examples of the photopolymerization initiator include an intramolecular cleavage-type photopolymerization initiator and a hydrogen abstraction drawing type polymerization initiator.

Examples of the intramolecular cleavage-type photopolymerization initiator include a benzyl ketal photopolymerization initiator, an alkylphenone photopolymerization initiator, an aminoalkylphenone photopolymerization initiator, a phosphine oxide photopolymerization initiator, a titanocene photopolymerization initiator, and an oxime photopolymerization initiator.

Specifically, examples of the benzyl ketal photopolymerization initiator include 2,2-dimethoxy-1,2-diphenylethan-1-one.

Examples of the alkylphenone photopolymerization initiator include 1-hydroxy-cyclohexyl-phenyl-ketone, 2-hydroxy-2-methyl-1-phenyl-propan-1-one, 1-[4-(2-hydroxyethoxy)-phenyl]-2-hydroxy-2-methyl-1-propan-1-one, 2-hydroxy-1-{4-[4(2-hydroxy-2-methyl-propionyl)-benzyl] phenyl}-2-methyl-propan-1-one, acetophenone, and 2-phenyl-2-(p-toluenesulfonyloxy) acetophenone.

Examples of the aminoalkylphenone photopolymerization initiator include p-dimethyl aminoacetophenone, p-dimethyl aminopropiophenone, 2-methyl-1-(4-methyl thiophenyl)-2-morpholinopropane-1-one, 2-benzyl-2-dimethylamino-1-(4-morpholinophenyl)-butanone-1, and 2-(dimethylamino)-2-[(4-methylphenyl) methyl]-1-[4-(4-morpholinyl) phenyl]-1-butanone.

Examples of the phosphine oxide photopolymerization initiator include 2,4,6-trimethylbenzoyl-diphenyl-phosphine oxide, and bis(2,4,6-trimethylbenzoyl) phenylphosphine oxide.

Examples of the titanocene photopolymerization initiator include bis(η5-2,4-cyclopentadien-1-yl))-bis(2,6-difluoro-3-(1H-pyrrol-1-yl)-phenyl) titanium.

Examples of the oxime photopolymerization initiator include 1,2-octanedione, 1-[4-(phenylthio)-, 2-(0-benzoyloxime)], ethanone, 1-[9-ethyl-6-(2-methyl benzoyl)-9H-carbazol-3-yl]-, 1-(0-acetyloxime), and the like.

Examples of the hydrogen abstraction type polymerization initiator include a benzophenone polymerization initiator, a thioxanthone polymerization initiator, a benzyl polymerization initiator, and a Michler's ketone polymerization initiator.

As specific examples of the hydrogen abstraction type polymerization initiator, examples of the benzophenone polymerization initiator include 2-benzoylbenzoic acid, 2-chlorobenzophenone, 4,4'-dichlorobenzophenone, 4-benzoyl 4'-methyl diphenyl sulfide, and p,p'-bisdiethyl aminobenzophenone.

Examples of the thioxanthone polymerization initiator include 2,4-diethyl thioxanthen-9-one, 2-chlorothioxanthone, and 2-isopropyl thioxanthone.

Examples of the benzyl polymerization initiator include benzyl, (±)-camphorquinone, and p-anisyl.

Further, as a thermal polymerization initiator used for thermalsetting, a known thermal polymerization initiator may be used, and specifically, for example, it is preferable to use a commercially available thermal polymerization initiator shown below.

In addition, in a case where the composition containing the specific charge transport material (a) by light or an electron beam, the curing reaction proceeds excessively fast, and thus, the overcoat layer may have unevenness and wrinkles which are generated due to a residual strain. In this case, as the polymerization initiator, it is preferable to use a thermal polymerization initiator. Particularly, in a case where the specific charge transport material (a) has a lower reactive methacryloyl group than an acryloyl group, when the thermal polymerization initiator is used, the occurrence of the residual strain is easily prevented, and thus the occurrence of the unevenness and wrinkles is easily prevented in the overcoat layer.

That is, examples of the commercially available thermal polymerization initiator include an azo initiator such as V-30 (10 hour half-life temperature: 104° C.), V-40 (same as above: 88° C.), V-59 (same as above: 67° C.), V-601 (same as above: 66° C.) V-65 (same as above: 51° C.), V-70 (same as above: 30° C.), VF-096 (same as above: 96° C.), Vam-110 (same as above: 111° C.), and Vam-111 (same as above: 111° C.) (which are manufactured by Wako Pure Chemical Industries, Ltd.); OTAZO-15 (same as above: 61° C.), OTAZO-30, AIBN (same as above: 65° C.), AMBN (same as above: 67° C.), ADVN (same as above: 52° C.), and ACVA (same as above: 68° C.) (which are all trade names, manufactured by Otsuka Chemical Co., Ltd.).

In addition, PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PERROYL IB, PERROYL 355, PERROYL L, PERROYL SA, NYPER BW, NYPER BMT-K40/M, PERROYL IPP, PERROYL NPP, PERROYL TCP, PERROYL OPP, PERROYL SBP, PERCUMYL ND, PEROCTA ND, PERHEXYL ND, PERBUTYL ND, PERBUYTL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, PERBUTYL Z (which are all trade names, manufactured by NOF Corp.);

KAYAKETAL AM-C55, TRIGONOX 36-C75, RAUROX, PERKADOX L-W75, PERKADOX CH-50L, TRIGONOX TMBH, KAYACUMENE H, KAYABUTYL H-70, PERKADOX BC-FF, KAYAHEXA AD, PERKADOX 14, KAYABUTYL C, KAYABUTYL D, KAYAHEXA YD-E85, PERKADOX 12-XL25, PERKADOX 12-EB20, TRIGONOX 22-N70, TRIGONOX 22-70E, TRIGONOX

D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON 1-20, KAYACARBON BIC-75, TRIGONOX 117, KAYARENE 6-70 (which are all trade names, manufactured by Kayaku Akzo Corp.);

LUPEROX LP (10 hour half-life temperature: 64° C.), LUPEROX 610 (same as above: 37° C.), LUPEROX 188 (same as above: 38° C.), LUPEROX 844 (same as above: 44° C.), LUPEROX 259 (same as above: 46° C.), LUPEROX 10 (same as above: 48° C.), LUPEROX 701 (same as above: 53° C.), LUPEROX 11 (same as above: 58° C.), LUPEROX 26 (same as above: 77° C.), LUPEROX 80 (same as above: 82° C.), LUPEROX 7 (same as above: 102° C.), LUPEROX 270 (same as above: 102° C.) LUPEROX P (same as above: 104° C.), LUPEROX 546 (same as above: 46° C.), LUPEROX 554 (same as above: 55° C.), LUPEROX 575 (same as above: 75° C.), LUPEROX TANPO (same as above: 96° C.), LUPEROX 555 (same as above: 100° C.), LUPEROX 570 (same as above: 96° C.) LUPEROX TAP (same as above: 100° C.), LUPEROX TBIC (same as above: 99° C.), LUPEROX TBEC (same as above: 100° C.), LUPEROX JW (same as above: 100° C.), LUPEROX TRIC (same as above: 96° C.), LUPEROX TAEC (same as above: 99° C.), LUPEROX DC (same as above: 117° C.), LUPEROX 101 (same as above: 120° C.), LUPEROX F (same as above: 116° C.), LUPEROX DI (same as above: 129° C.), LUPEROX 130 (same as above: 131° C.), LUPEROX 220 (same as above: 107° C.), LUPEROX 230 (same as above: 109° C.), LUPEROX 233 (same as above: 114° C.), LUPEROX 531 (same as above: 93° C.) (which are all trade names, manufactured by ARKEMA YOSHITOMI, LTD.).

Among the thermal polymerization initiators, a thermal polymerization initiator of which the half-life temperature is in a range of 10° C. to 100° C. is preferably used. In the in the exemplary embodiment, the half-life temperature means a 10 hour half-life temperature.

Even when the thermal polymerization initiator is used alone, the curing reaction proceeds, but when two or more types are used, the overcoat layer of a cured material in which residual strain is prevented is easily obtained.

Particularly, among two or more types of thermal polymerization initiators, the thermal polymerization initiators in which a difference between the lowest 10 hour half-life temperature and the highest 10 hour half-life temperature is 20° C. or more are preferably used in combination. When two types of thermal polymerization initiators having the difference in the 10 hour half-life temperature is 20° C. or more are used, the overcoat layer of a cured material in which residual strain is prevented is easily obtained.

Further, the thermal polymerization initiators having the 10 hour half-life temperature in a range of 40° C. to 120° C. are preferably used in combination, and the thermal polymerization initiators having the 10 hour half-life temperature in a range of 50° C. to 110° C. are further preferably used in combination, in terms of the pot life of the coating solution and the degree of progress of the curing reaction.

The use ratio of the thermal polymerization initiators in which the difference in the 10 hour half-life temperature is 20° C. or more are not particularly limited, but are preferably 30% by weight or more, further preferably 40% by weight or more, and still further preferably 50% by weight or more with respect to the total amount of the thermal polymerization initiator having the lowest 10 hour half-life temperature and the thermal polymerization initiator having the highest 10 hour half-life temperature. When the thermal polymerization initiators are set to be in the above-described range, the overcoat layer of a cured material in which residual strain is prevented is easily obtained.

Further, in the thermal polymerization initiators in which the difference in the 10 hour half-life temperature is 20° C. or more, the ratio of weight (L) of the thermal polymerization initiator having lowest 10 hour half-life temperature to weight (H) of the thermal polymerization initiator having lowest 10 hour half-life temperature is preferably set to be L:H=2:8 to 9:1, is further preferably set to be L:H=3:7 to 9:1, and still further preferably set to be L:H=4:6 to 9:1. When the weight ratio of the thermal polymerization initiator having the lowest 10 hour half-life temperature is set to be equal to or greater than a certain degree, it is presumed that the curing reaction may proceed more mildly, and thus the overcoat layer of a cured material in which residual strain is prevented is easily obtained.

The total content of the polymerization initiators is preferably in a range of 0.2% by weight to 10% by weight, is further preferably in a range of 0.5% by weight to 8% by weight, and is still further preferably in a range of 0.7% by weight to 5% by weight with respect to the total solid contents of the composition containing the specific charge transport material (a).

The composition containing the specific charge transport material (a) may contain a reactive compound (c) does not have charge transporting properties. The mechanical strength of the overcoat layer may be adjusted by using the specific charge transport material (c).

Here, the phrase "does not have the charge transporting properties" means that the carrier transport is not observed by using a Time of Flight method.

As the above-described reactive compound, a polymerizable monomer, an oligomer, and a polymer of monofunctional or polyfunctional are exemplified. Examples thereof include a monomer, an oligomer, and a polymer of acrylate or methacrylate.

Specifically, examples of the monofunctional monomer include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethyl carbitol acrylate, phenoxyethyl acrylate, 2-hydroxy acrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenylphenol acrylate, o-phenylphenol glycidyl ether acrylate, and the like.

Examples of bifunctional monomers, oligomers, and polymers include diethylene glycol di(meth) acrylate, polyethylene glycol di(meth) acrylate, polypropylene glycol di(meth) acrylate, neopentyl glycol di(meth) acrylate, 1,6-hexanediol di(meth)acrylate, and the like.

Examples of trifunctional monomer, oligomer, and polymer include trimethylolpropane tri(meth) acrylate, pentaerythritol tri(meth) acrylate, aliphatic tri(meth) acrylate, and the like.

Examples of tetrafunctional monomer, oligomer, and polymer include pentaerythritol tetra(meth) acrylate, ditrimethylol propane tetra(meth) acrylate, aliphatic tetra(meth) acrylate, and the like.

In addition, examples of five or more functional monomers, oligomers, and polymers include dipentaerythritol penta(meth) acrylate, dipentaerythritol hexa(meth) acrylate, and the like, and further include (meth) acrylate having a polyester skeleton, a urethane skeleton, and a phosphazene skeleton.

The above-mentioned monomers, oligomers, and polymers may be used alone or as a mixture of two or more.

In addition, the above-described monomers, oligomers, and polymers may be 100% by weight or less, is preferably 50% by weight or less, and is further preferably 30% by weight or less with respect to the compounds (the above-described specific charge transport material and other charge transport materials) having the charge transporting properties in the composition containing the specific charge transport material.

Further, for the purpose of the particle dispensability and viscosity control, and discharge gas tolerance, mechanical strength, scratch resistance, torque reduction, abrasion amount control, and extension of pot life of the overcoat layer, a polymer (d) reacting with the specific charge transport material (a), or a polymer (e) does not react with the specific charge transport material (a) may be mixed into the composition containing the specific charge transport material (a).

The overcoat layer formed of the cured material of the composition containing the specific charge transport material (a) securely has the electrical properties and the mechanical strength, and thus various types of polymers may be used together as the binder resin. When the polymers are used, the viscosity of the composition is improved, the overcoat layer having excellent surface properties may be formed, the gas barrier properties of the outermost surface for preventing the incorporation of gas may be improved, and the adhesiveness with the lower layer may also be improved.

The polymer (d) which reacts with the specific charge transport material (a) may be a polymer having a radically polymerizable unsaturated double bond as a reactive group, and in addition to the acrylate or methacrylate polymers mentioned above, the polymers disclosed in paragraphs [0026] to [0059] of JP-A-5-216249, the polymers disclosed in paragraphs [0027] to [0029] of JP-A-5-323630, the polymers disclosed in paragraphs [0089] to [0100] of JP-A-11-52603, and the polymers disclosed in paragraphs [0107] to [0128] of JP-A-2000-264961.

The polymer (e) which does not react with the specific charge transport material (a) may be a polymer which does not include a radically polymerizable unsaturated double bond, and specifically, examples thereof include known materials such as a polycarbonate resin, a polyester resin, a polyarylate resin, a methacrylic resin, an acrylic resin, a polyvinyl chloride resin, a polyvinylidene chloride resin, and a polystyrene resin.

The above-described polymers may be 100% by weight or less, is preferably 50% by weight or less, and is further preferably 30% by weight or less with respect to the compounds (the above-described specific charge transport material (a) and other charge transport materials) having the charge transporting properties in the composition containing the specific charge transport material (a).

In addition, for the purpose of adjusting the film-forming properties, the flexibility, the lubricity, and the adhesive properties of the overcoat layer, a coupling agent, a hard coating agent, and a fluorine-containing compound may be added to the composition containing the specific charge transport material (a). Specific examples of the additives include various types of silane coupling agents, and a commercially available silicone type hard coating agent.

Examples of the silane coupling agent include vinyl trichloro silane, vinyl trimethoxy silane, vinyl triethoxy silane, γ-glycidoxypropyl methyl diethoxy silane, γ-glycidoxypropyl trimethoxy silane, γ-aminopropyl triethoxy silane, γ-aminopropyl trimethoxy silane, γ-aminopropyl methyl dimethoxy silane, N-β(aminoethyl)-γ-aminopropyl triethoxy silane, tetramethoxy silane, methyl trimethoxy silane, dimethyl dimethoxy silane, and the like.

In addition, examples of the commercially available hard coating agent include KP-85, X-40-9740, and X-8239 (which are all trade names, manufactured by Shin-Etsu Chemical Co., Ltd.), and AY42-440, AY42-441, and AY49-208 (which are all trade names, manufactured by Dow Corning Toray Co., Ltd.).

Further, in order to impart water repellency and the like, a fluorine-containing compound containing (tridecafluoro-1,1,2,2-tetrahydrooctyl) triethoxy silane, (3,3,3-trifluoropropyl) trimethoxy silane, 3-(heptafluoroisopropoxy) propyl triethoxy silane, 1H, 1H, 2H, 2H-perfluoroalkyl triethoxy silane, 1H, 1H, 2H, 2H-perfluorodecyl triethoxy silane, 1H, 1H, 2H, and 2H-perfluorooctyl triethoxy silane may be added. Further, a reactive fluorine-containing compound disclosed in JP-A-2001-166510 or the like may be mixed.

The amount of the silane coupling agent is not particularly limited, the amount of the fluorine-containing compound is preferably equal to or less than 0.25 times by weight ratio with respect to the compound which does not include fluorine.

In addition, for the purpose of discharge gas tolerance, mechanical strength, scratch resistance, torque reduction, abrasion amount control, extension of pot life, particle dispensability, viscosity control, and the like of the overcoat layer, a resin which is dissolved in alcohol may be added to the overcoat layer.

For the purpose of preventing deterioration of the overcoat layer due to oxidizing gas such as ozone generated in the charging device, an antioxidant is preferably added to the overcoat layer. When the mechanical strength of the surface of the photoreceptor is increased and the photoreceptor has a long life, the photoreceptor is in contact with the oxidizing gas for a long time, and thus strong oxidation resistance is required as compared with the related art.

As the antioxidant, a hindered phenol antioxidant or a hindered amine antioxidant is preferably used, and a known antioxidant such as an organic sulfur antioxidant, a phosphite antioxidant, a dithiocarbamate antioxidant, a thiourea antioxidant, and a benzimidazole antioxidant may be used. The addition amount of the antioxidant is preferably 20% by weight or less, and is 10% by weight or less, with respect to the total solid content in the composition for forming the overcoat layer.

Examples of the hindered phenol antioxidant include "IRGANOX 1076", "IRGANOX 1010", "IRGANOX 1098", "IRGANOX 245", "IRGANOX 1330", "IRGANOX 3114", "IRGANOX 1076", and "3,5-di-t-butyl-4-hydroxybiphenyl".

Examples of the hindered amine antioxidant include "SANOL LS2626", "SANOL LS765", "SANOL LS770", "SANOL LS744", "TINUVIN 144", "TINUVIN 622LD", "MARK LA57", "MARK LA67", "MARK LA62", "MARK LA68", and "MARK LA63", examples of thioether antioxidant include "SUMILIZER TPS" and "SUMILIZER TP-D", and examples of the phosphite antioxidant include "MARK 2112", "MARK PEP-8", "MARK PEP-24G", "MARK PEP-36", "MARK 329K", "MARK HP-10", and the like.

Further, for the purpose of decreasing the residual potential of the overcoat layer, or enhancing the strength, various types of particles may be added to the overcoat layer.

Examples of the particle include a silicon-containing particle. The silicon-containing particle is a particle containing silicon as a constituent element, and specifically, examples thereof include colloidal silica and a silicone particle. As the colloidal silica used as a silicon-containing particle, colloidal silica which is commonly available in the market by being selected from the silica having an average particle diameter in a range of 1 nm to 100 nm (preferably in a range of 10 nm to 30 nm) and being dispersed into an acidic or alkaline aqueous dispersion, or an organic solvent such as an alcohol, a ketone and an ester, may be used.

The solid content of the colloidal silica in the overcoat layer is not particularly limited; however, in terms of the film formability, the electrical properties, and the strength, the total solid content of the overcoat layer may be set in a range of 0.1% by weight to 50% by weight (preferably in a range of 0.1% by weight to 30% by weight) as standard.

The silicone particles used as the silicon-containing particle is commonly available in the market by being selected from a silicone resin particle, a silicone rubber particle, and a silicone surface-treated silica particle. These silicone particles have an almost spherical shape, and the average particle diameter thereof is preferably in a range of 1 nm to 500 nm, and is further preferably in a range of 10 nm to 100 nm. The silicone particles are chemically inactive and have a small diameter particle which is excellent in dispensability into the resin, and thus the surface properties of the electrophotographic photoreceptor are improved without preventing the crosslinking reaction. That is, when the silicone particles are almost uniformly incorporated in the crosslinked structure, the lubricity and the water repellency of the surface of the electrophotographic photoreceptor are improved, and thus the abrasion resistance, and the stain adherence resistance are easily maintained.

The content of the silicone particles in the overcoat layer is preferably in a range of 0.1% by weight to 30% by weight, and is further preferably in a range of 0.5% by weight to 10% by weight, based on the total solid content of the overcoat layer.

Other examples of the particles include fluorine particles such as ethylene tetrafluoride, ethylene trifluoride, propylene hexafluoride, vinyl fluoride, and vinylidene fluoride, and as described in "8th Polymeric Material Forum. Lecture, Proceedings, p. 89", particles formed of a resin obtained by copolymerizing a fluororesin and a monomer having a hydroxyl group, and a semiconductive metal oxide such as $ZnO—Al_2O_3$, $SnO_2—Sb_2O_3$, $In_2O_3—SnO_2$, $ZnO_2$-$TIO_2$, ZnO-$TIO_2$, $MgO—Al_2O_3$, FeO-$TIO_2$, $TIO_2$, $SnO_2$, $In_2O_3$, ZnO, MgO, and the like.

Among those particles, the silicon-containing particle is preferably used.

In addition, for the same purpose, oil such as silicone oil may be added to the overcoat layer. examples of the silicone oil include silicone oils such as dimethyl polysiloxane, diphenyl polysiloxane, and phenyl methyl siloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethyl cyclosiloxanes such as hexamethyl cyclotrisiloxane, octamethyl cyclotetrasiloxane, decamethyl cyclopentasiloxane, and dodecamethyl cyclohexasiloxane; cyclic methyl phenyl cyclosiloxanes such as 1,3,5-trimethyl-1,3,5-triphenyl cyclotrisiloxane, 1,3,5,7-tetramethyl-1,3,5,7-tetraphenyl cyclotetrasiloxane, 1,3,5,7,9-pentamethyl-1,3,5,7,9-pentaphenyl cyclopentasiloxane; cyclic phenyl cyclosiloxanes such as hexaphenyl cyclotrisiloxane; fluorine-containing cyclosiloxanes such as (3,3,3-trifluoropropyl) methyl cyclotrisiloxane; hydrosilyl group-containing cyclosiloxanes such as methyl hydrosiloxane mixture, pentamethyl cyclopentasiloxane, and phenyl hydrocyclosiloxane; and vinyl group-containing cyclosiloxanes such as pentavinyl pentamethyl cyclopentasiloxane.

In addition, metal, metal oxide, and carbon black may be added to the overcoat layer. Examples of the metal include aluminum, zinc, copper, chromium, nickel, silver, and stainless steel, or plastic particles having the surface which the metals are deposited on. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These may be used alone or in combination of two or more. When two or more types are used in combination, they may be simply mixed or may be in the form of solid solution or fusion. The average particle diameter of the conductive particles is preferably 0.3 μm or less, and particularly preferably 0.1 μm or less in terms of transparency of the protective layer.

The metal oxide particles may be subjected to the surface treatment by using a silane coupling agent. Examples of the silane coupling agent include a silane coupling agent having at least one selected from an acryloyl group, a methacryloyl group, and an amino group in the molecular structure.

The composition containing the specific charge transport material (a) used to form the overcoat layer is preferably prepared as a coating solution for forming an overcoat layer.

The coating solution for forming an overcoat layer may be solventless, or if necessary, is prepared by using alone or mixed solvent among solvents, for example, aromatic such as toluene and xylene; ketone such as methyl ethyl ketone, methyl isobutyl ketone, cyclohexanone; ester such as ethyl acetate, and butyl acetate; ether such as tetrahydrofuran and dioxane; cellosolve such as ethylene glycol monomethyl ether; and alcohol such as isopropyl alcohol and butanol.

In addition, when the coating solution is obtained by reacting the above components, in a case where the respective components are simply mixed with each other, it may be enough to be dissolved; however, the components may be heated under the conditions of temperature preferably in a range of room temperature to 100° C., further preferably in a range of 30° C. to 80° C., and heating time preferably in a range of 10 minutes to 100 hours, further preferably in a range of one hour to 50 hours. Further, it is also preferable to irradiate ultrasonic waves at this time.

The charge transport layer forming the surface to be coated is coated with the coating solution for forming an overcoat layer formed of the composition containing the specific charge transport material (a) by using well-known methods such as a blade coating method, a wire bar coating method, a spray coating method, a dipping coating method, a bead coating method, an air knife coating method, and a curtain coating method.

Thereafter, a method of imparting heat with respect to the obtained coated film so as to cause radical polymerization is used, and with this, the coated film is polymerized and cured.

At the time of polymerizing and curing the coated film by heat, the heating condition is preferably 50° C. or more. If the temperature is less than 50° C., the life span of the cured film may be short, which is not preferable. Particularly, the heating temperature is preferably in a range of 100° C. to 170° C., in terms of strength, electrical properties, and surface properties of cured film.

As such, the polymerization and curing reaction of the coated film is performed with the oxygen concentration in vacuum or an inert gas atmosphere which is 10% or less, is further preferably 5% or less, and is still further preferably 2% or less, and most preferably performed with low oxygen concentration of 500 ppm or less such that the chain reaction is able to be performed without deactivation of radical generated by heat.

As described above, the cured material (cured film) of the composition containing the compound having at least one of an acryloyl group and a methacryloyl group is described with reference to an example of the cured material of the composition containing the specific charge transport material (a); however, the cured material is not limited thereto.

For example, a cured material of a composition containing a compound which has at least one of an acryloyl group and a methacryloyl group, and does not have the charge transport skeleton in the same molecule may be exemplified. In this case, a cured material of a composition containing at least one of a compound which has at least one of an acryloyl group and a methacryloyl group, and does not have the charge transport skeleton in the same molecule, and a non-reactive charge transport material, and various types of particles (a metallic particle, a metal oxide particle, a resin particle, a silicon-containing particle, and the like) may also be employed.

Examples of the compound having at least one of an acryloyl group and a methacryloyl group, and does not have the charge transporting properties include a compound which is the same as the monofunctional, or the bifunctional or higher polyfunctional acrylate or methacrylate monomer, oligomer, and polymer.

Examples of the non-reactive charge transport material include a well-known charge transport material.

Examples of the various types of particles include at least one selected from the metallic particle, the metal oxide particle, the resin particle, and the silicon-containing particle, and specifically include the same particles as those of the above-described various types of particles. In addition, in a case of containing the metal oxide particle, the metal oxide particle surface-treated with a coupling agent may be used, and for example, a metal oxide particle surface-treated with a silane coupling agent having at least one of an acryloyl group and a methacryloyl group is used.

The film thickness of the overcoat layer is set to be, for example, preferably in a range of 1 μm to 20 μm, and is further preferably in a range of 1 μm to 10 μm.

Single Layer-Type Photosensitive Layer

The single layer-type photosensitive layer (a charge generation layer or a charge transport layer) is a layer including, for example, a charge generation material and a charge transport material, and a binder resin and other well-known additives if necessary. Note that, these materials are the same as those in the description of the charge generation layer and the charge transport layer.

In addition, in the single layer-type photosensitive layer, the content of the charge generation material may be in a range of 10% by weight to 85% by weight, and is further preferably in a range of 20% by weight to 50% by weight with respect to the entire solid content. In addition, in the single layer-type photosensitive layer, the content of the charge transport material may be in a range of 5% by weight to 50% by weight with respect to the entire solid content.

The method of forming the single layer-type photosensitive layer is the same as the method of forming the charge generation layer or the charge transport layer.

The thickness of the single layer-type photosensitive layer is, for example, in a range of 5 μm to 50 μm, and is further preferably in a range of 10 μm to 40 μm.

Charge Unit

In the image forming apparatus as illustrated in FIG. 1, the charging rollers 2Y, 2M, 2C, and 2K are used as the charge unit; however, the charge unit is not limited to the charging rollers.

Other examples of the charge unit include a contact-type charging device using a conductive or semiconductive charging brush, a charging film, a charging rubber blade, a charging tube or the like.

In addition, well-known charger such as a non-contact type roller charger a scorotron charger using corona discharge and a corotron charger are also used.

Electrostatic Latent Image Forming Unit

In the image forming apparatus as illustrated in FIG. 1, the exposure device 3 which may emit the laser beams 3Y, 3M, 3C, and 3K is used as the electrostatic latent image forming unit; however, the electrostatic latent image forming unit is not limited to the above exposure device.

Examples of the exposure device include an optical device that exposes the surface of the electrophotographic photoreceptor in a predetermined image with the light such as a semiconductor laser beam, LED light, and liquid crystal shutter light. The wavelength of the light source is set to be within a spectral sensitivity region of the electrophotographic photoreceptor. The wavelength of the semiconductor laser beam is mainly near-infrared having an oscillation wavelength in the vicinity of 780 nm. However, the wavelength is not limited, the oscillation wavelength laser having a level of 600 nm, or laser having the oscillation wavelength in a range of 400 nm to 450 nm as a blue laser may be also used. In addition, a surface emission-type laser light source capable of outputting a multi-beam is also effective to form a color image.

Developing Unit

Examples of the developing unit (the developing device) include a general developing device that causing a developer to contact or non-contact with the specific photoreceptor so as to develop an image.

The developing device is not particularly limited as long as it has the above-described function, and is selected on the purpose. For example, a well-known developing device having a function of attaching a one component developer or a two-component developer to the photoreceptor by using a brush, a roller, or the like may be exemplified. Among them, a developing roller holding the developer on the surface is preferably used.

The developer used for the developing device may be a one component developer containing only the specific toner or may be a two-component developer containing a toner and a carrier. In addition, the developer may be magnetic or non-magnetic.

Transfer Unit

In the image forming apparatus as illustrated in FIG. 1, the intermediate transfer type device using the intermediate transfer member is employed as the transfer unit, and the primary transfer rollers 5Y, 5M, 5C, and 5K, and the secondary transfer roller 26 are used; however, the transfer unit is not limited to the intermediate transfer type device.

Other examples of the transfer unit include a transfer unit using a direct transfer method using transfer corotron and a transfer roller, and a transfer belt method for electrostatically adsorbing and transporting a recording medium and transferring the toner image onto the photoreceptor.

Examples of the transfer device unit include well-known transfer charger such as a contact type transfer charger using a belt, a film, a rubber blade, and the like, in addition to the roller, a scorotron transfer charger using corona discharge, and a corotron transfer charger are also used.

Here, as the intermediate transfer member at the time of employing the intermediate transfer method, the image forming apparatus uses the intermediate transfer belt 20 as illustrated in FIG. 1; however, the exemplary embodiment is not limited thereto.

As the intermediate transfer belt, a material, to which semiconductivity is imparted, such as polyimide, polyamideimide, polycarbonate, polyarylate, polyester, rubber, and the like are used.

The form of the intermediate transfer member is not limited to a belt shape, and a drum-shaped one may be used.

Specific Cleaning Unit

The specific cleaning unit includes a cleaning blade, and a tip of the cleaning blade contacts with the specific photoreceptor toward the direction opposite to the rotation direction the specific photoreceptor so as to remove residues on the surface.

Hereinafter, the specific cleaning unit will be described with reference to FIG. 5.

Figure 5:
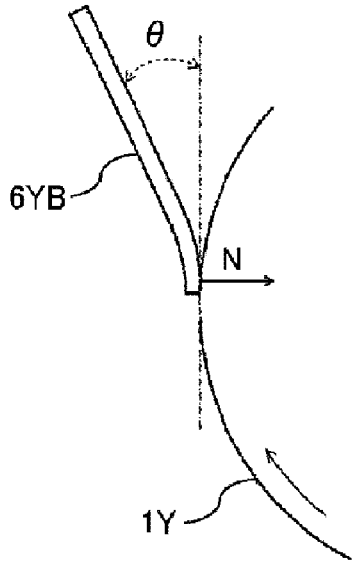
FIG. 5 illustrates the structure of a state of installation of a cleaning blade in the image forming apparatus according to in the exemplary embodiment.

FIG. 5 illustrates a state of installation of the cleaning blade in a case where the photoreceptor cleaning device 6Y illustrated in FIG. 1 is the specific cleaning unit.

As illustrated in FIG. 5, the tip of a cleaning blade 6YB is directed to the direction opposite to the rotation direction (arrow direction) of the photoreceptor 1Y, and concurrently contacts with the surface of the photoreceptor 1Y.

An angle θ between the cleaning blade 6YB and the photoreceptor 1Y is preferably set to be in a range of 5° to 35°, and is further preferably in a range of 10° to 25°.

In addition, pressing pressure N with respect to the photoreceptor 1Y of the cleaning blade 6YB is preferably set to be in a range of 0.6 gf/mm$^2$ to 6.0 gf/mm$^2$.

Here, as illustrated in FIG. 5, the above-described angle θ specifically means an angle of a corner which is formed by a tangent (a chain line in FIG. 5) at the contact portion of the tip of the cleaning blade 6YB and the photoreceptor 1Y and an unreformed portion of the cleaning blade.

Further, the pressing pressure N means a pressure (gf/mm$^2$) to press toward the center of the photoreceptor 1Y at a position where the cleaning blade 6YB contacts with the photoreceptor 1Y as illustrated in FIG. 5.

The cleaning blade in this embodiment is a plate-shaped material having elasticity.

Examples of the material forming the cleaning blade include an elastic material such as silicone rubber, fluorine rubber, ethylene/propylene/diene rubber, and polyurethane rubber, and among them, polyurethane rubber excellent in mechanical properties such as abrasion resistance, resistance to cracking, creep resistance property and the like is preferably used.

A support member (not shown in FIG. 5) is bonded to the surface side opposite to the surface which in contact with the specific photoreceptor, and the cleaning blade is supported by this support member.

With this support member, the cleaning blade is pressed with respect to the photoreceptor by the above-described pressing pressure.

Examples of the support member include metal materials such as aluminum and stainless steel.

An adhesive layer formed of an adhesive or the like may be provided between the support member and the cleaning blade for bonding the adhesion between the support member and the cleaning blade.

The specific cleaning unit may include known member in addition to the cleaning blade and the support member supporting the cleaning blade.

Fixing Unit

In the image forming apparatus as illustrated in FIG. 1, a pair of fixing rollers 28 are used as the fixing unit; however, the exemplary embodiment is not limited to the above fixing rollers.

Examples of the fixing unit include well-known fixing devices, for example, a contact type fixing device such as a heat roller pair, a pressure roller pair, and a pressure heating roller pair, and a non-contact fixing device such as a flash fixing device are commonly used, and in order to attain the above-described fixing temperature, it is preferable that the fixing device includes a heating unit.

Note that, the fixing unit is not necessarily formed of a roller pair, and for example, the fixing unit may be a fixing device including a heating pressure roller and a pressure belt in combination, or a fixing device including a pressure roller and a heating pressure belt in combination.

A fixing temperature provided by the fixing unit is preferably in a range of 100° C. or more and less than 190° C.

Developer Containing Specific Toner

The developer contained in the image forming apparatus according to the exemplary embodiment contains the specific toner as described below.

First, the specific toner will be described.

The specific toner contains a binder resin, a colorant, and the release agent, and the binder resin contains a crystalline polyester resin.

In addition, in the specific toner, the content ratio of toner particles having the average circularity in a range of 0.955 to 0.971, the particle diameter of 4.5 μm or more and less than 7.5 and the circularity of 0.980 or more is in a range of 16% by number to 40% by number, and the content ratio of the toner particles having the particle diameter of 7.5 or more and less than 15 μm and the circularity of 0.900 or more and less than 0.940 is 3% by number or less.

Hereinafter, the specific toner will be specifically described.

As described above, the specific toner satisfies that the content ratio of the toner particles having the particle diameter of 4.5 μm or more and less than 7.5 and the circularity of 0.980 or more is in a range of 16% by number to 40% by number. This condition (hereinafter, also referred to as "M ratio") means that the toner particles having the high circularity (almost spherical shape) are present at a specific ratio in the vicinity of the center of the particle diameter distribution of the toner particles.

Further, the specific toner satisfies that the content ratio of the toner particles having the particle diameter of 7.5 μm or more and less than 15 and the circularity of 0.900 or more and less than 0.940 is 3% by number or less. This condition (hereinafter, also referred to as "L ratio") means that the toner particles having the low circularity (with unevenness) are present at equal to or less than the specific ratio on the coarse side of the particle diameter distribution of the toner particles.

From the aspect that the specific toner prevents the transfer properties of the toner image transferred to the intermediate transfer member from the image holding member from being deteriorated, the content ratio of the toner particles having the particle diameter of 4.5 μm or more and less than 7.5 μm, and the circularity of 0.980 or more is preferably in a range of 16% by number to 30% by number, and is further preferably in a range of 16% by number to 25% by number. In addition, from the same aspect, the content ratio of the toner particles having the particle diameter of 7.5 μm or more and less than 15 μm, and the circularity of 0.900 or more and less than 0.940 is preferably 2% by number or less, further preferably 1% by number or less, and still further preferably 0% by number. Note that, the content ratio of the toner particles is the content ratio with respect to the entirety of the toner particles.

By selecting a glass transition temperature, a molecular weight or the like of the binder resin in the toner particles as described later, and controlling time and temperature in the aggregation and coalescence step, the specific toner having the average circularity of 0.955 to 0.971, and satisfying the above-described M ratio and L ratio is provided.

Here, the particle diameter, the circularity, and the average circularity of the toner particle are obtained by using FPIA-3000 manufactured by Sysmex Corporation with respect to the toner particles of the toner to be measured.

The above-mentioned FPIA-3000 manufactured by Sysmex Corporation employs a method of measuring particles dispersed in water or the like according to a flow type image analysis method, and the particle suspension is suctioned and guided to a flat sheath flow cell and is formed to be flattened sample flow by the sheath liquid. When the sample flow is irradiated with strobe light, at least 5000 toner particles passing through the flow are captured as still images through an objective lens by using a CCD camera. The captured particle image is subjected to two-dimensional image processing, and an equivalent circle diameter is calculated from the projected area and the circumferential length. The diameter of a circle having the same area from the area of a two-dimensional image is calculated as the equivalent circle diameter for each imaged particle.

In the exemplary embodiment, the equivalent circle diameter is set to be the particle diameter of the toner particle, and the circularity is calculated by the following Expression (1). Further, it is possible to calculate the content ratio of (% by number) for a certain range of the particle diameter, and the circularity by performing a statistical process of data for each of the toner particles. The same is true for the following description.

$$\text{circularity}=\text{perimeter of equivalent circle diameter}/\text{perimeter}=[2\times(A\times\pi)^{1/2}]/PM \quad \text{Expression (1):}$$

(In the above expression, A represents the projected area and PM represents the circumferential length.)

In addition, from the aspect that the specific toner prevents the occurrence of the image flow under the high temperature and high humidity environment, the content ratio of toner particles having a circularity of 0.900 or more and less than 0.950 is preferably in a range of 5% by number to 15% by number (further preferably in a range of 10% by number to 15% by number) with respect to the entirety of the toner particles, and the content ratio of toner particles having a circularity in a range of 0.950 to 1.000 is preferably in a range of 75% by number to 85% by number (further preferably in a range of 78% by number to 85% by number) with respect to the toner particles.

The volume average particle diameter (D50v) of the toner particles is preferably in a range of 2 μm to 10 μm, and is further preferably in a range of 4 μm to 8 μm.

The volume average particle diameter of the toner particles is measured using COULTER MULTISIZER II (manufactured by Beckman Coulter, Inc.) and ISOTON-II (manufactured by Beckman Coulter, Inc.) as an electrolytic solution. In measurement, 10 mg of a measurement sample is added into 2 ml of a 5 wt % aqueous solution containing sodium dodecylbenzenesulfonate as a dispersant. The measurement sample added to 100 ml of the electrolytic solution is prepared, and the electrolytic solution in which the measurement sample is suspended is dispersed for 1 minute by an ultrasonic disperser. Then, with the COULTER MULTISIZER II, the particle diameter distribution of particles having particle diameter falling within a range of 1.0 μm to 30 μm is measured using an aperture having an aperture diameter of 50 μm to obtain a volume average distribution. The cumulative distributions are drawn from the small particle side with respect to the particle diameter ranges (channels) separated based on measured particle distribution as the volume standard, and the particle diameter (D50v) when the cumulative percentage becomes 50% is defined as the volume average particle diameter of the measurement sample.

Hereinafter, the constituent components of the specific toner will be described.

The specific toner may contain a toner particle containing a binder resin having a crystalline polyester resin, a colorant, and a release agent. The specific toner may contain external additives attached to the surfaces of the toner particles.

Binder Resin

Examples of the binder resin include a crystalline polyester resin. The binder resin may include resins other than the crystalline polyester resin. For example, specific examples of the other resin include vinyl resins formed of homopolymer of monomers such as styrenes (for example, styrene, para-chloro styrene, and α-methyl styrene), (meth) acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, an amorphous polyester resin, a polyurethane resin, a polyamide resin, a cellulose resin, a polyether resin, and a modified rosin, a mixture thereof with the above-described vinyl resin, or a graft polymer obtained by polymerizing a vinyl monomer with the coexistence of such non-vinyl resins.

These binder resins other than the crystalline polyester resin may be used singly or in combination of two or more types thereof. Among them, the crystalline polyester resin and the amorphous polyester resin may be suitably used in combination as the binder resin. In the binder resin, the content of the crystalline polyester resin may be used in a range of 1% by weight to 10% by weight (preferably in a range of 2% by weight to 9% by weight) with respect to the entirety of the binder resin. When the content of the crystalline polyester resin is in the above range, the average circularity of the toner particles is easily controlled to be in a range of 0.955 to 0.971 and the above M ratio and L ratio are easily controlled to be in the above ranges.

Note that, "crystalline" of the resin means having not a stepwise endothermic change but a clear endothermic peak in the differential scanning calorimetry (DSC), and specifically means that the half-value width of the endothermic peak is within 10° C. when measured at a heating rate of 10 (° C./min).

On the other hand, "amorphous" of the resin means that the half value width is higher than 10° C., the endothermic change is stepwise, or a clear endothermic peak is not recognized.

Crystalline Polyester Resin

Examples of the crystalline polyester resin include a polycondensate of polyvalent carboxylic acid and polyol. As the crystalline polyester resin, a commercially available product may be used or, synthesized product may be used.

From the viewpoint that the crystalline polyester resin easily forms a crystalline structure, a polycondensate obtained by using a polymerizable monomer having a linear aliphatic group rather than a polymerizable monomer having an aromatic group is preferable.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonanedicarboxylic acid, 1,10-decanedicarboxylic acid, 1, 12-dodecanedicarboxylic acid, 1,14-tetradecanedicarboxylic acid, and 1,18-octadecanedicarboxylic acid), aromatic dicarboxylic acid (for example, dibasic acid such as phthalic acid, isophthalic acid, terephthalic acid, naphthalene-2,6-dicarboxylic acid), anhydrides thereof, or lower alkyl esters (having, for example, from 1 to 5 carbon atoms) thereof.

As the polyvalent carboxylic acid, tri- or higher-valent carboxylic acid having a crosslinked structure or a branched structure may be used in combination with dicarboxylic acid. Examples of tri-valent carboxylic acid include aromatic carboxylic acids (for example, 1,2,3-benzenetricarboxylic acid, 1,2,4-benzenetricarboxylic acid, 1,2,4-naphthalenetricarboxylic acid), anhydrides thereof, or lower alkyl esters (having, for example, from 1 to 5 carbon atoms) thereof.

Examples of the polyvalent carboxylic acid include a dicarboxylic acid having a sulfonic acid group and a dicarboxylic acid having an ethylenic double bond may be used together with these dicarboxylic acids.

The polyvalent carboxylic acids may be used singly or in combination of two or more types thereof.

Examples of the polyol include an aliphatic diol (for example, a linear aliphatic diol having a carbon number of 7 to 20 in the main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, examples of the aliphatic diol preferably include 1,8-octanediol, 1,9-nonanediol, and 1,10-decanediol.

As the polyol, a tri- or higher-valent polyol having a crosslinked structure or a branched structure may be used in combination with diol. Examples of the tri- or higher-valent polyol include glycerin, trimethylolethane, trimethylolpropane, and pentaerythritol.

The polyol may be used singly or in combination of two or more types thereof.

Here, polyol may have the aliphatic diol of which the content is preferably 80 mol % or more, and further preferably 90 mol % or more.

The melting temperature of the crystalline polyester resin is preferably from 50° C. to 100° C., more preferably from 55° C. to 90° C., and most preferably from 60° C. to 85° C.

The melting temperature is obtained from a DSC curve obtained by differential scanning calorimetry (DSC), and specifically obtained according to "melting peak temperature" described in the method of obtaining a melting temperature in JIS K 7121-1987 "Testing methods for transition temperatures of plastics". The weight average molecular weight (Mw) of the crystalline polyester resin is preferably in a range of 6,000 to 35,000. The measuring method is the same as that for the weight average molecular weight with respect to the amorphous polyester described later.

In the case where the melting temperature of the crystalline polyester resin is in the above-described range, the average circularity of the toner particles is easy to control to be in a range of 0.955 to 0.971, and the above-described M ratio (the content ratio of toner particles having the particle diameter which is 4.5 μm or more and less than 7.5 and the circularity which is 0.980 or more), and the L ratio (the content ratio of toner particles having the particle diameter which is 7.5 μm or more and less than 15 and the circularity which is 0.900 or more and less than 0.940) are easy to control to be in the above-described range. In addition, in the case where the weight average molecular weight of the crystalline polyester resin is in the above-described range, the average circularity of the toner particles is easy to control to be in a range of 0.955 to 0.971, and the above-described M ratio and L ratio are easy to control to be in the above-described range.

Meanwhile, in a case where the weight average molecular weight of the crystalline polyester resin is excessively large, it is hard to obtain the toner particle which is formed into an almost spherical shape while the average circularity of the toner particles is in a range of 0.955 to 0.971.

The crystalline polyester resin is prepared by using a well-known preparing method, similarly to the preparation of the amorphous polyester resin described later.

Amorphous Polyester Resin

Examples of the amorphous polyester resin include condensation polymers of polyvalent carboxylic acids and polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid having a crosslinked structure or a branched structure may be used in combination with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyol.

As the polyol, a tri- or higher-valent polyol having a crosslinked structure or a branched structure may be used in combination with diol. Examples of the tri- or higher-valent polyol include glycerin, trimethylolpropane, and pentaerythritol.

The polyol may be used singly or in combination of two or more types thereof.

The glass transition temperature (Tg) of the amorphous polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "Extrapolated glass transition onset temperature" described in the method of obtaining a glass transition temperature in JIS K 7121-1987 "Testing methods for transition temperatures of plastics".

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using GPC.HLC-8120 GPC, manufactured by Tosoh Corporation as a measuring device, Column TSK gel SUPER HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

In addition, in the case where the glass transition temperature of the amorphous polyester resin is in the above-described range, the average circularity of the toner particles is easy to control to be in a range of 0.955 to 0.971, and the above M ratio and L ratio are easy to control to be in the above range. In addition, in the case where the weight average molecular weight of the amorphous polyester resin is in the above-described range, the average circularity of the toner particles is easy to control to be in a range of 0.955 to 0.971, and the above M ratio and L ratio are easy to control to be in the above range. Further, for example, in the case where the weight average molecular weight of the amorphous polyester resin is excessively large, it is hard to obtain the toner particle which is formed into an almost spherical shape while the average circularity of the toner particles is in a range of 0.955 to 0.971.

A known preparing method is used to prepare the amorphous polyester resin. Specific examples thereof include a method of conducting a reaction at a polymerization temperature set to be in a range of 180° C. to 230° C., if necessary, under reduced pressure in the reaction system, while removing water or an alcohol generated during condensation.

When monomers of the raw materials are not dissolved or compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is preferably from 40% by weight to 95% by weight, more preferably from 50% by weight to 90% by weight, and most preferably from 60% by weight to 85% by weight, with respect to the entirety of the toner particles.

Colorant

Examples of the colorant includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The colorants may be used singly or in combination of two or more types thereof.

As the colorant, if necessary, a surface-treated colorant may be used, or a dispersant may be used in combination. Further, as the colorant, plural types of colorants may be used in combination.

The content of the colorant is preferably in a range of 1% by weight to 30% by weight, and is further preferably in a range of 3% by weight to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and more preferably from 60° C. to 100° C.

The melting temperature is obtained from a DSC curve obtained by differential scanning calorimetry (DSC), and specifically obtained from "melting peak temperature" described in the method of obtaining a melting temperature in JIS K 7121-1987 "Testing methods for transition temperatures of plastics".

The content of the release agent is preferably from 1% by weight to 20% by weight, and more preferably from 5% by weight to 15% by weight with respect to the entirety of the toner particles.

Other Additives

Examples of other additives include well-known additives such as a magnetic material, a charge controlling agent, and an inorganic powder. These additives are contained in the toner particle as internal additives.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning active agent (for example, metal salts of higher fatty acids typified by zinc stearate, and particles having fluorine high molecular weight polymer).

Meanwhile, in a case where the specific toner contains the toner particle and an external additive, it is likely that in the toner dam, the external additive is present on a nip portion side (for example, in the vicinity of the nip portion 113A as illustrated in FIG. 6) between the cleaning blade and the specific photoreceptor, from the position of the toner particles. For this reason, in addition to the action by the shape of the above-described toner particles, the corona products are easily removed from the photoreceptor surface due to the cleaning action by the external additive, and thus the image flow is more easily prevented under the high temperature and high humidity environment. Further, when abrasive particles (for example, metal titanate particles such as strontium titanate) are contained as the external additive, the image flow is still more easily prevented under the high temperature and high humidity environment.

The amount of the external additive is, for example, preferably in a range of 0.01% by weight to 5% by weight, and is further preferably in a range of 0.01% by weight to 2.0% by weight with respect to the toner particles.

Preparing Method of Specific Toner

Next, the method of preparing the specific toner will be described.

The specific toner is obtained by additionally adding the external additive to the toner particles after preparing the toner particles.

The preparing method of the toner particles is not particularly limited, and well-known method may be employed. For example, the toner particles may be prepared by using a wetting method (for example, an aggregation and coalescence method, a suspension polymerization method, and a dissolution suspension method).

Among them, the toner particles may be obtained by using the aggregation and coalescence method.

Specifically, for example, in a case where the toner particles are prepared by using the aggregation and coalescence method, the toner particles are prepared through the steps. The steps include a step (a resin particle dispersion preparing step) of preparing a resin particle dispersion in which resin particles constituting the binder resin containing the crystalline polyester resin are dispersed, a colorant particle dispersion in which particles of the colorant (hereinafter, also referred to as "a colorant particle") are dispersed, and a release agent particle dispersion in which particles of the release agent (hereinafter, also referred to as "a release agent particle") are dispersed; a step (an aggregated particles forming step) of forming aggregated particles by aggregating the resin particle, the colorant particle, and the release agent particle in the resin particle dispersion; and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the colorant and the release agent will be described; however, other additives other than the colorant and the release agent may also be used.

Resin Particle Dispersion Preparing Step

First, along with a resin particle dispersion in which the resin particles, which are to form the binder resin containing the crystalline polyester resin, are dispersed, for example, a colorant particle dispersion in which colorant particles are dispersed and a release agent particle dispersion in which the release agent particles are dispersed are prepared.

As the binder resin, in a case where the crystalline polyester resin and amorphous polyester are used in combination, a resin particle dispersion in which the crystalline polyester resin and the amorphous polyester are mixed with each other may be prepared as the resin particle dispersion.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchanged water, or the like, alcohols, and the like. The medium may be used singly or in combination of two or more types thereof.

Examples of the surfactant include an anionic surfactant such as sulfate, sulfonate, phosphate, and soaps; a cationic surfactant such as amine salt and quaternary ammonium salt; and a nonionic surfactant such as polyethylene glycol, alkyl phenol ethylene oxide adduct, and polyol. Among them, the anionic surfactant and the cationic surfactant are particularly preferable. The nonionic surfactant may be used in combination with the anionic surfactant or the cationic surfactant.

The surfactants may be used singly or in combination of two or more types thereof.

Regarding the resin particle dispersion, as a method of dispersing the resin particles in the dispersion medium, a general dispersing method using, for example, a rotary shearing-type homogenizer, or a ball mill, a sand mill, or a DYNO mill is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to the organic continuous phase (O phase); and adding an aqueous medium (W phase) to thereby form a discontinuous phase and convert the resin (so-called phase inversion) from W/O to O/W, thus dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and most preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably in a range of 5% by weight to 50% by weight, and further preferably in a range of 10% by weight to 40% by weight.

The colorant particle dispersion and the release agent particle dispersion are also prepared in the same manner as in the case of the resin particle dispersion. That is, the volume average particle diameter, the dispersion medium, the dispersing method, and the content of the particles with respect to the resin particles in the resin particle dispersion described above may be applied to those of the particles of the colorant dispersed in the colorant particle dispersion, and the release agent particle dispersed in the release agent particle dispersion.

Aggregated Particles Forming Step

Next, the resin particle dispersion, the colorant particle dispersion, and the release agent particle dispersion are mixed with each other.

The resin particles, the colorant particles, and the release agent particle are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added thereto. Then, the mixed dispersion is heated at a temperature of a glass transition temperature of the resin particles (specifically, for example, in a range of from a temperature 30° C. lower than the glass transition temperature to a temperature 10° C. lower than the glass transition temperature with respect to the resin particles) to aggregate the particles dispersed in the mixed dispersion, thereby forming the aggregated particles.

In the aggregated particle forming step, for example, the aggregating agent may be added at room temperature (for example, 25° C.) while stirring the mixed dispersion with a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant, an inorganic metal salt, or a divalent or more metal complex, which has an opposite polarity to the polarity of the surfactant used as the dispersing agent to be added to the mixed dispersion. Particularly, when a metal complex is used as the aggregating agent, the amount of the surfactant to be used is reduced and charging characteristics are improved.

An additive for forming a complex or a similar bond with a metal ion contained in the aggregating agent may be used, if necessary. A chelating agent is suitably used as the additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and is further preferably 0.1 parts by weight or more and less than 3.0 parts by weight, with respect to 100 parts by weight of resin particle.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Here, by adjusting a product (total heat quantity) of temperature and time with respect to the aggregated particle dispersion in the coalescence step, the average circularity of the toner particles may be controlled to be in a range of 0.955 to 0.971, and the above-described M ratio (the content ratio of the toner particles having the particle diameter of 4.5 μm or more and less than 7.5 μm, and the circularity of 0.980 or more) and the L ratio (the content ratio of the toner particles having the particle diameter of 7.5 μm or more and less than 15 μm, and the circularity of 0.900 or more and less than 0.940) may be controlled. As the heating is performed at a high temperature for long period of time, the toner particles are likely to be formed in to a spherical shape, and when a product of temperature and time is excessively large, the average circularity of the toner particles is particularly hard to satisfy the above-described range. For this reason, a product of temperature and time with respect to the aggregated particle dispersion is adjusted such that the average circularity of the toner particles satisfies the range of 0.955 to 0.971, and thereby the above-described M ratio and L ratio may be controlled.

The toner particles are obtained through the foregoing steps.

The toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so that the resin particles are attached on the surface of the aggregated particle, and a step of forming the toner particles having a core/shell structure by heating a second aggregated particle dispersion in which the second aggregated particles are dispersed, thereby coalescing the second aggregated particles.

Here, after the coalescence step ends, the toner particles formed in the solution are subjected to a washing step, a solid-liquid separation step, and a drying step, that are well known, thereby obtaining dry toner particles.

In the washing step, displacement washing using ion exchanged water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The specific toner according to the exemplary embodiment is prepared by adding and mixing, for example, an external additive to the obtained dry toner particles, if necessary. The mixing may be performed with, for example, a V-blender, a HENSCHEL mixer, a LODIGE MIXER, or the like. Furthermore, if necessary, coarse particles of the toner may be removed by using a vibration classifier, a wind classifier, or the like.

Developer

The developer contains the above-described specific toner.

The developer may be a single-component developer containing only the specific toner, or a two-component developer obtained by mixing the specific toner with a carrier.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particles are dispersed in the matrix resin; and a resin impregnated-type carrier in which a resin is impregnated into the porous magnetic particles.

The magnetic particle dispersion-type carrier and the resin impregnated-type carrier may be a carrier in which the particles which form the above carrier are set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluorine resin, polyester, polycarbonate, a phenol resin, and an epoxy resin.

Other additives such as the conductive particles may be contained in the coating resin and the matrix resin.

Examples of the conductive particles include particles of metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is exemplified. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution in the kneader coater and removing a solvent.

The mixing ratio (weight ratio) of the specific toner to the carrier in the two-component developer is preferably in a range of specific toner:carrier=1:100 to 30:100, and is further preferably in a range of 3:100 to 20:100.

As described above, an example of the image forming apparatus according to the exemplary embodiment is described with reference to the drawings; however, the exemplary embodiment is not limited thereto.

Examples

Hereinafter, the exemplary embodiment will be more specifically described with reference to Examples and Comparative Examples; however, the exemplary embodiment is not limited thereto. Note that, "part" means "part by weight" unless otherwise noted.

Preparation of Toner

Preparation of Crystalline Polyester Resin (A)

First, 100 parts by weight of dimethyl sebacate, 67.8 parts by weight of hexane diol, and 0.10 parts by weight of dibutyl tin oxide are allowed to react with each other under nitrogen atmosphere at 185° C. for five hours in a three-necked flask while removing water generated during the reaction to the outside, then the temperature is increased to 220° C. while slowly reducing pressure, and the reaction is performed for six hours, followed by cooling. Thus, a crystalline polyester resin (A) having the weight average molecular weight of 33,700 is prepared.

Preparation of Amorphous Polyester Resin (1)

First, 60 parts by weight of dimethyl terephthalate, 82 parts by weight of dimethyl fumarate, 34 parts by weight of dodecenyl succinic anhydride, 137 parts by weight of bisphenol A ethylene oxide adduct, 191 parts by weight of bisphenol A propylene oxide adduct, and 0.5 parts by weight of dibutyl tin oxide are allowed to react with each other under nitrogen atmosphere at 180° C. for three hours in a three-necked flask while removing water generated during the reaction to the outside, the temperature is increased up to 230° C. while slowly reducing pressure, and the reaction is performed for three hours, followed by cooling. Thus, an amorphous polyester resin (1) having the weight average molecular weight of 22100 is prepared.

Preparation of Colorant Particle Dispersion

Further, a colorant particle dispersion is prepared by mixing 50 parts by weight of cyan pigment (copper phthalocyanine, C.I. Pigment blue 15:3, prepared by Dainichiseika Color & Chemicals Mfg. Co., Ltd.), 5 parts by weight of nonionic surfactant NONIPOL 400 (prepared by Kao Corporation), and 200 parts by weight of ion exchanged water are mixed, dispersing the mixture for about one hour by using a high-pressure impact disperser Ultimaizer (HJP30006, manufactured by Sugino Machine Ltd.), and adjusting the moisture amount.

Preparation of Release Agent Particle Dispersion

A release agent particle dispersion having a moisture amount adjusted such that the concentration of the release agent becomes 20% by weight in the dispersion in which the release agent having the volume average particle diameter of 250 nm is dispersed is prepared by heating a solution at 120° C., the solution being prepared by mixing 60 parts by weight of paraffin wax (HNP9, manufactured by Nippon Seiro, Co., Ltd., melting point of 77° C.), 4 parts by weight of anionic surfactant (NEOGEN RK, manufactured by Dai-Ichi Kogyo Seiyaku Co., Ltd.), and 200 parts by weight of ion exchanged water, subjecting the solution to a dispersing treatment with a homogenizer (ULTRA-TURRAX T50, manufactured by IKA Ltd.), and then a dispersing treatment with MANTON-GAULIN high pressure homogenizer (manufactured by Manton Gaulin Mfg Company Inc) under the condition of 120° C., 350 kg/cm2, and one hour.

Preparation of Rosin Dispersion 100 parts by weight of rosin (prepared by Harima Chemicals Group, Inc.) and 78 parts by weight of methyl ethyl ketone are put into the three-necked flask, the resin is dissolved in the three-necked flask while being stirred, 350 parts by weight of ion exchanged water is added into the three-necked flask, and the three-necked flask is warmed up. Then, the resultant is dispersed by using a homogenizer (ULTRA-TURRAX T50, manufactured by IKA Ltd.), and removing the solvent is performed. The volume average particle diameter is 185 nm. To the resultant, ion exchanged water is added, thereby preparing a rosin dispersion having the solid concentration of 25%.

Preparation of Crystalline/Amorphous Mixed Polyester Resin Particle Dispersion (A1)

A crystalline/amorphous mixed polyester resin particle dispersion (A1) in which crystalline/amorphous mixed polyester resin particles having the volume average particle diameter of 158 nm are dispersed, and which has a solid concentration of 25% is prepared by putting 5 parts by weight of crystalline polyester resin (A), 95 parts by weight of amorphous polyester resin (1), 50 parts by weight of methyl ethyl ketone, and 15 parts by weight of isopropyl alcohol into the three-necked flask, dissolving the resin by heating at 60° C. with stirring, then adding 25 parts by weight of 10% ammonia aqueous solution into the three-necked flask, slowly adding further 400 parts by weight of ion exchanged water into the three-necked flask to thereby perform a phase inversion emulsification, then reducing the pressure, and performing removing solvent.

Preparation of Amorphous Resin Particle Dispersion (A2)

An amorphous polyester resin particle dispersion (A2) in which amorphous polyester resin particles having the volume average particle diameter of 175 nm are dispersed and which has a solid concentration of 25% is prepared by using the same method as that of the crystalline/amorphous mixed polyester resin particle dispersion (A1) except that the amount of the amorphous polyester resin (1) is changed to 100 parts by weight.

Preparation of Toner Particle 1

720 parts by weight of crystalline/amorphous mixed polyester resin particle dispersion (A1), 50 parts by weight of the colorant particle dispersion, 70 parts by weight of the release agent particle dispersion, 6 parts by weight of rosin dispersion, 2.2 parts by weight of water glass (SNOWTEX OL (registered trademark) manufactured by Nissan Chemical Industries), and 1.5 parts by weight of cationic surfactant (SANISOL B50, prepared by Kao Corporation) are put into to a round stainless steel flask, 0.1 N sulfuric acid is added thereto to adjust pH to 3.8, 30 parts by weight of nitric acid aqueous solution having 10% by weight of concentration of polyaluminum chloride as coagulant is added into the flask, and then, the mixture is dispersed at 30° C. by using a homogenizer (ULTRA-TURRAX T50, manufactured by IKA Ltd.). The resultant is heated up to 40° C. at 1° C./min in oil bath for heating, held at 40° C. for 30 minutes, and then 160 parts by weight of amorphous polyester resin particle dispersion (A2) is slowly added into the dispersion, and further held for one hour.

After that, after adjusting pH to 7.0 by adding 0.1 N sodium hydroxide, the resultant is heated up to 88° C. at 1° C./min while continuously stirring, held for four hours, cooled up to 20° C. at a rate of 20° C./min, filtrated, washed with ion exchanged water, and then dried by using a vacuum dryer so as to obtain a toner particle 1. The content of the crystalline polyester resin in the toner particle 1 is 4.1 parts by weight with respect to the binder resin in the toner.

In the toner particle 1, the content ratio of toner particles having the volume average particle diameter of 5.5 μm, the average circularity of 0.963, the particle diameter of 4.5 μm or more and less than 7.5 μm, and the circularity of 0.980 or more is 25%, and the content ratio of the toner particles having the particle diameter of 7.5 μm or more and less than 15 μm, and the circularity of 0.900 or more and less than 0.940 is 1.1%.

Further, the ratio of the circularity of the toner particle 1 with respect to the entirety of the toner particles is 0.900 or more and less than 0.950, and the ratio of the circularity with respect to the entirety of the toner particles is in a range of 0.950 to 1.000 are also measured. The results are indicated in Table 1.

The volume average particle diameter of the total toner particles of toner as indicated in Table 1 is measured by using the above-described measuring method.

In addition, all of the toners indicated in Table 1 are obtained by adding 1.2 parts by weight of commercially available fumed silica RX 50 (manufactured by Nippon Aerosil Co., Ltd.) as an external additive to 100 parts by weight of toner particles by using a HENSCHEL mixer (MITSUI MIKE MACHINERY Co. Ltd.) under the conditions of peripheral speed 30 m/s and 5 minutes.

Further, a two-component developer is prepared by mixing 8 parts by weight of the toner to which the external additive is added, and 100 parts by weight of the carrier. The carrier is prepared in the following manner. 100 parts by weight of ferrite particles (the volume average particle diameter: 50 μm), 14 parts by weight of toluene, and 2 parts by weight of styrene-methyl methacrylate copolymer (component ratio: styrene/methyl methacrylate=90/10, the weight average molecular weight Mw=80,000) are prepared, then these components without ferrite particles are dispersed by being stirred for 10 minutes by using stirrer so as to prepare a coating solution. Then, the coating solution and the ferrite particles are put into a vacuum degassing type kneader (manufactured by Inoue Seisakusho Co., Ltd), the mixture is stirred at 60° C. for 30 minutes, the pressure is reduced to further degas while warming up the mixture, the mixture is dried, and then classifying with a mesh of 105 μm is performed.

Preparation of Toner Particle 2

A toner particle 2 is prepared in the same manner as in preparing the toner particle 1 except that the content of the rosin dispersion is changed from 6 parts by weight to 4.8 parts by weight, the content of water glass is changed from 2.2 parts by weight to 3.4 parts by weight, and the heating temperature and time is changed from 88° C. and four hours to 85° C. and three hours. The crystalline polyester resin in the toner particle 2 is 4.1 parts by weight with respect to the binder resin in the toner particles.

In the toner particle 2, the content ratio of the toner particles having the volume average particle diameter of 5.8 μm, the average circularity of 0.956, the particle diameter of 4.5 μm or more and less than 7.5 μm, and the circularity of 0.980 or more is 17%, and the content ratio of the toner particles having the particle diameter of 7.5 μm or more and less than 15 μm, and the circularity of 0.900 or more and less than 0.940 is 2.8%.

In addition, the ratio of the toner particles having the circularity which is 0.900 or more and less than 0.950 with respect to the entirety of the toner particles of the toner particle 2, and the ratio of the toner particles having the circularity which is in a range of 0.950 to 1.000 with respect to the entirety of the toner particles are also measured. The results are indicated in Table 1.

Preparation of Toner Particles 3

A toner particle 3 is prepared in the same manner as in preparing the toner particle 1 except that the content of the rosin dispersion is changed from 6 parts by weight to 4.8 parts by weight, the content of water glass is changed from 2.2 parts by weight to 5.8 parts by weight, and the heating temperature and time is changed from 88° C. and four hours to 85° C. and three hours. The crystalline polyester resin in the toner particle 3 is 4.1 parts by weight with respect to the binder resin in the toner particles.

In the toner particle 3, the content ratio of the toner particles having the volume average particle diameter of 5.8 μm, the average circularity of 0.951, the particle diameter of 4.5 μm or more and less than 7.5 μm, and the circularity of 0.980 or more is 12%, and the content ratio of the toner particles having the particle diameter of 7.5 μm or more and less than 15 μm, and the circularity of 0.900 or more and less than 0.940 is 3.2%.

In addition, the ratio of the toner particles having the circularity which is 0.900 or more and less than 0.950 with respect to the entirety of the toner particles of the toner particle 3, and the ratio of the toner particles having the circularity which is in a range of 0.950 to 1.000 with respect to the entirety of the toner particles are also measured. The results are indicated in Table 1.

Preparation of Toner Particles 4

A toner particle 4 is prepared in the same manner as in preparing the toner particle 1 except that the content of the rosin dispersion is changed from 6 parts by weight to 7.8 parts by weight, the content of water glass is changed from 2.2 parts by weight to 1.4 parts by weight, and the heating temperature and time is changed from 88° C. and four hours to 90° C. and four hours. The crystalline polyester resin in the toner particle 4 is 4.1 parts by weight with respect to the binder resin in the toner particles.

In the toner particle 4, the content ratio of the toner particles having the volume average particle diameter of 5.7 μm, the average circularity of 0.970, the particle diameter of 4.5 μm or more and less than 7.5 μm, and the circularity of 0.980 or more is 38%, and the content ratio of the toner particles having the particle diameter of 7.5 μm or more and less than 15 μm, and the circularity of 0.900 or more and less than 0.940 is 0.4%.

In addition, the ratio of the toner particles having the circularity which is 0.900 or more and less than 0.950 with respect to the entirety of the toner particles of the toner particle 4, and the ratio of the toner particles having the circularity which is in a range of 0.950 to 1.000 with respect to the entirety of the toner particles are also measured. The results are indicated in Table 1.

Preparation of Toner Particles 5

A toner particle 5 is prepared in the same manner as in preparing the toner particle 1 except that the content of the rosin dispersion is changed from 6 parts by weight to 7.8 parts by weight, the content of water glass is changed from 2.2 parts by weight to 1.6 parts by weight, and the heating temperature and time is changed from 88° C. and four hours to 90° C. and five hours. The crystalline polyester resin in the toner particle 5 is 4.1 parts by weight with respect to the binder resin in the toner particles.

In the toner particle 5, the content ratio of the toner particles having the volume average particle diameter of 5.9 μm, the average circularity of 0.973, the particle diameter of 4.5 μm or more and less than 7.5 μm, and the circularity of 0.980 or more or more is 43%, and the content ratio of the toner particles having the particle diameter of 7.5 μm or more and less than 15 μm, and the circularity of 0.900 or more and less than 0.940 is 0.2%.

In addition, the ratio of the toner particles having the circularity which is 0.900 or more and less than 0.950 with respect to the entirety of the toner particles of the toner particle 5, and the ratio of the toner particles having the circularity which is in a range of 0.950 to 1.000 with respect to the entirety of the toner particles are also measured. The results are indicated in Table 1.

Preparation of Specific Photoreceptor

Formation of Undercoat Layer 100 parts by weight of zinc oxide (manufactured by TAYCA Corporation, average particle diameter of 70 nm, Specific surface area value of 15 $m^2/g$) is mixed with 500 parts by weight toluene, the mixture is stirred, 1.3 parts by weight of the silane coupling agent (KBM503, Shin-Etsu Chemical Co., Ltd.) is added to the mixture, and the mixture is stirred for two hours. Thereafter, toluene is distilled by distillation under the reduced pressure, sintered at 120° C. for three hours, and subjected to surface treatment with a silane coupling agent so as to obtain zinc oxide. 110 parts by weight of surface-treated zing oxide is mixed with 500 parts by weight of tetrahydrofuran, the mixture is stirred, a solution in which 0.6 parts by weight of alizarin is dissolved into 50 parts by weight of tetrahydrofuran is added to the mixture, and then the mixture is stirred at 50° C. for five hours. After that, the zinc oxide to which alizarin is attached is separated by vacuum filtration, and is dried under the reduced pressure at 60° C., thereby obtaining an alizarin-attached zinc oxide.

38 parts by weight of solution in which 60 parts by weight of the alizarin-attached zinc oxide, 13.5 parts by weight of curing agent (Blocked isocyanate SUMIDUR 3175, manufactured by Sumitomo Bayer Urethane Co., Ltd), and 15 parts by weight of butyral resin (S-Lec BM-1, manufactured by Sekisui Chemical Co., Ltd.) are mixed into 85 parts by weight of methyl ethyl ketone, and 25 parts by weight of methyl ethyl ketone are mixed, and dispersed for two hours in a sand mill using glass beads having a diameter of 1 mmφ so as to obtain a dispersion.

0.005 parts by weight of dioctyltin dilaurate, and 40 parts by weight of silicone resin particle (TOSPEARL 145, manufactured by Momentive Performance Materials Inc.) are added to the obtained dispersion as a catalyst, and thereby a coating solution for forming an undercoat layer. An aluminum substrate is coated with the coating solution for forming the undercoat layer by a dipping coating method, and dried and hardened at 170° C. for 40 minutes, thereby forming the undercoat layer having a thickness of 20 μm.

Formation of Charge Generation Layer 15 parts by weight of hydroxygallium phthalocyanine (CGM-1), as the charge generation material (having diffraction peaks at Bragg angles (2θ±0.2°) of at least 7.3°, 16.0°, 24.9°, and 28.0° in an X-ray diffraction spectrum using CuKα characteristic X-ray), 10 parts by weight of vinyl chloride-vinyl acetate copolymer resin (VMCH, manufactured by Nippon Unicar Co., Ltd.) as the binder resin, and 200 parts by weight of n-butyl acetate are mixed to obtain a mixture. The mixture is dispersed using a sand mill with glass beads having a diameter of 1 mmφ for 4 hours. 175 parts by weight of n-butyl acetate and 180 parts by weight of methyl ethyl ketone are added to the obtained dispersion, followed by stirring. As a result, a coating liquid for forming a charge transport layer is obtained. This coating liquid for forming a charge transport layer is dip-coated on the undercoat layer, followed by drying at room temperature (25° C.). As a result, a charge generation layer having a thickness of 0.2 μm is formed.

Formation of Charge Transporting Layer

Next, 45 parts by weight of N,N'-diphenyl-N,N'-bis(3-methylphenyl)-[1, 1 ']biphenyl-4, 4'-diamine (TPD), and parts by weight of bisphenol Z polycarbonate resin (viscosity average molecular weight: 50,000) as the binder resin are added to 800 parts by weight of tetrahydrofuran (THF)/toluene mixed solvent (weight ratio: 70/30), and the mixture is dissolved so as to obtain a coating solution for forming the charge transporting layer. The charge generation layer is coated with the coating solution for forming the charge transporting layer, and then dried at 130° C. for 45 minutes so as to form a charge transport layer having a film thickness of 20 μm.

Formation of Overcoat Layer

Synthesis of Compound A-4

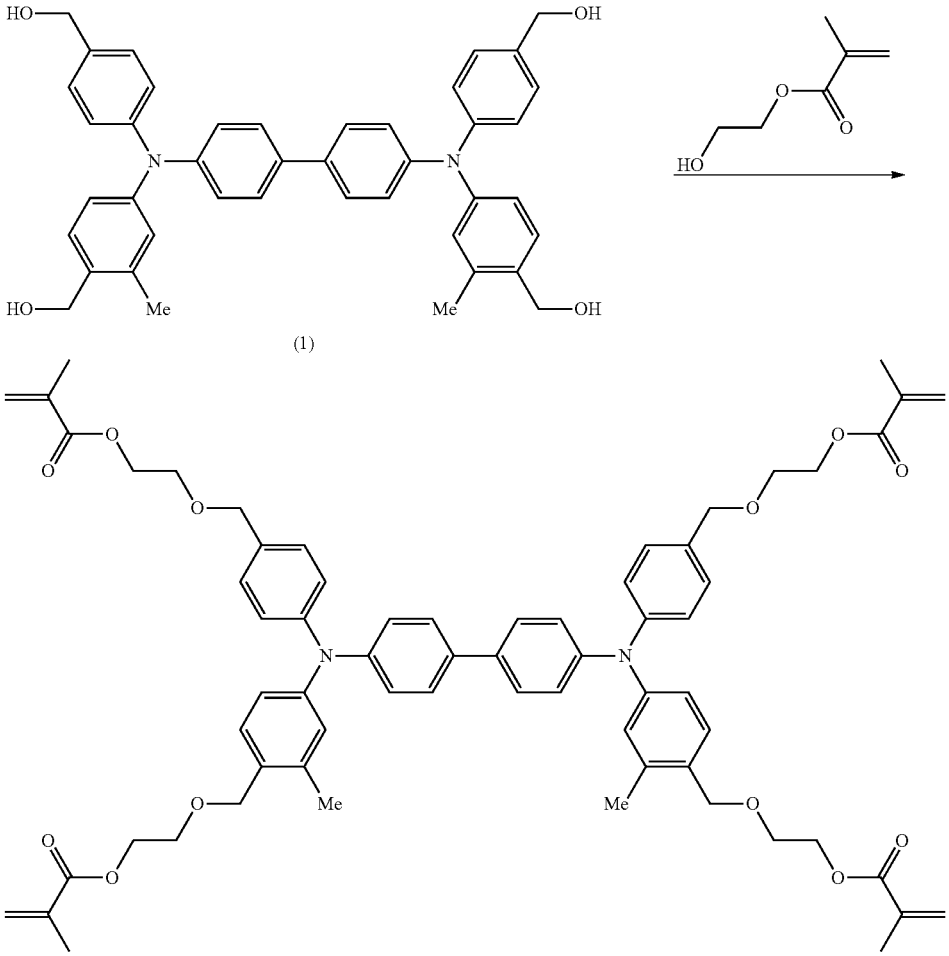

Figure 7:
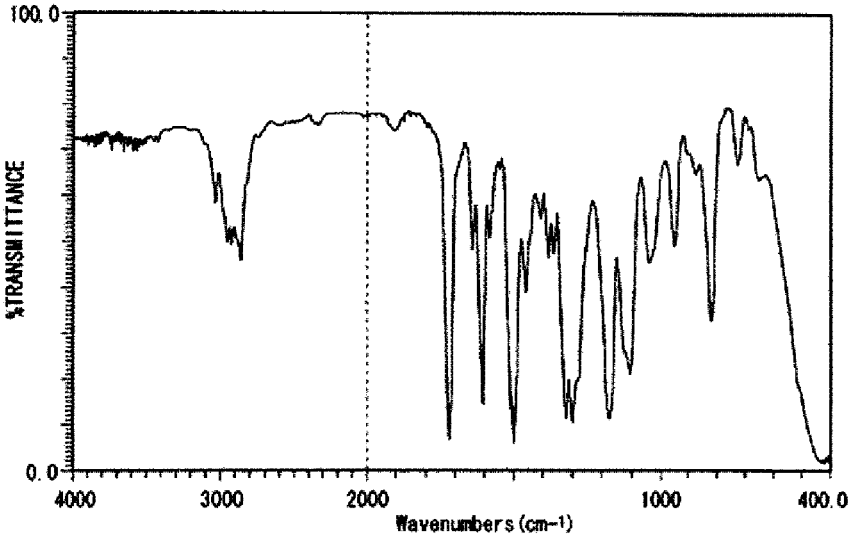
FIG. 7 is an IR spectrum of a product (A-4).

10 g of the above-described compound (1), 50 g of hydroxyethyl methacrylate, 20 ml of tetrahydrofuran, and 0.5 g of AMBERLYST 15E (manufactured by Rohm and Haas Company) are added to 200 ml of flask, the mixture is stirred at room temperature (25° C.) for 24 hours. After reaction, 100 ml of methanol is added to the reactant, and the precipitated oil is taken out with decant. This oily product was purified by silica gel column chromatography so as to obtain 12 g of oily (A-4). An IR spectrum of the obtained (A-4) is illustrated in FIG. 7.

30 parts by weight of the specific charge transport material (compound A-4), 0.2 parts by weight of colloidal silica (product name: PL-1, manufactured by Fuso Chemical Co., Ltd.), 30 parts by weight of toluene, 0.1 parts by weight of 3, 5-di-t-butyl-4-hydroxytoluene (BHT), 0.1 parts by weight of azoisobutyronitrile (10 hour half-life temperature: 65° C.), and V-30 (manufactured by Wako Pure Chemical Industries, Ltd., 10 hour half-life temperature: 104° C.) are added to prepare the coating solution for forming an overcoat layer. The charge transport layer is coated with the coating solution by using a spray coating method, air-dried at room temperature for 30 minutes, heated in a nitrogen gas stream at an oxygen concentration of 110 ppm from room temperature to 150° C. for 30 minutes and further heated at 150° C. for 30 minutes for curing, thereby forming the overcoat layer having film thickness of 10 μm.

In this way, the specific photoreceptor is obtained.

Preparation of Cleaning Blade

A plate-shaped material, which is formed of polyurethane and has a hardness of 75 degrees and a size of 347 mm×10 mm×2 mm (thickness), is used as a cleaning blade.

Evaluation

As the image forming apparatus, the specific photoreceptor and the cleaning blade are attached to D136 Printer manufactured by Fuji Xerox Co., Ltd. In addition, a modifier containing the developer having the above-described toners 1 to 5 in the developing device is prepared.

The tip end of the cleaning blade contacts with the photoreceptor toward the direction opposite to the rotation direction of the photoreceptor. Note that, in the cleaning blade, an angle θ is set to be 23° and a pressing pressure of N is set to be 2.6 gf/mm$^2$.

In addition, the rotational speed of the surface of the specific photoreceptor at the time of forming images is set to be 600 mm/s, and a fixing temperature provided by the fixing unit is set to be 190° C. or 175° C.

Evaluation of Image Flow

The evaluation of the image flow is performed as follows. An overall halftone image having an image density of 40% is printed on 20,000 sheets using A4 sheet (C2 paper manufactured by Fuji Xerox Co., Ltd.) under the high temperature and high humidity environment (temperature of 28° C., humidity of 85% RH), and after 24 hours under the same environment, an overall halftone image having an image density of 40% is printed on one sheet, and the image on the sheet is visually observed. The evaluation criteria areas follows. The results are shown in Table 1.

Evaluation Criteria

A: Any image flow is not observed at all.

B: Any image flow being problematic on an image is not observed.

C: Image flow being problematic on an image is observed.

Evaluation of Cleaning Properties

The evaluation of the cleaning properties is performed as follows. An overall halftone image having an image density of 40% is printed on 20,000 sheets using A4 sheet (C2 paper manufactured by Fuji Xerox Co., Ltd.) under the high temperature and high humidity environment (temperature of 28° C., humidity of 85% RH), and then the surface of the specific photoreceptor is visually observed.

Evaluation Criteria

A: No problem in cleaning properties

B: Fine toner passes through but no problems happen on image.

C: Fine toner passes through and image streaks are generated.

TABLE 1

| | Toner | | | | | | Evaluation | |
|---|---|---|---|---|---|---|---|---|
| | No. | Average R | M ratio (% by number) | L ratio (% by number) | 0.900 ≤ R < 0.950 (% by number) | 0.950 ≤ R ≤ 1.000 (% by number) | Image flow | Cleaning properties |
| Example 1 | 1 | 0.963 | 25 | 1.1 | 11 | 77 | A | A |
| Example 2 | 2 | 0.956 | 17 | 2.8 | 14 | 72 | A | A |
| Example 3 | 4 | 0.970 | 38 | 0.4 | 7 | 82 | A | A |
| Comparative Example 1 | 3 | 0.951 | 12 | 3.2 | 17 | 69 | C | A |
| Comparative Example 2 | 5 | 0.973 | 43 | 0.2 | 4 | 91 | A | C |

In Table 1, the "M ratio" represents the content ratio of the toner particles having a particle diameter of 4.5 μm or more and less than 7.5 μm and a circularity of 0.980 or more, the "L ratio" represents the content ratio of the toner particles having a particle diameter of 7.5 μm or more and less than 15 μm and a circularity of 0.900 or more and less than 0.940, and "R" represents the circularity.

From the above results, it is understood that, the occurrence of the image flow is prevented under the high temperature and high humidity environment in Examples, as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that is provided with a photosensitive layer and an overcoat layer on an electroconductive substrate in this order;

a charge unit that charges a surface of the electrophotographic photoreceptor;

an electrostatic latent image forming unit that forms an electrostatic latent image on a charged surface of the electrophotographic photoreceptor;

a developing unit that contains a developer containing toner particles, and develops the electrostatic latent image formed on the surface of the electrophotographic photoreceptor with the developer to form a toner image;

a transfer unit that transfers the toner image to a surface of a recording medium;

a cleaning unit that includes a cleaning blade and a tip of the cleaning blade contacts with the electrophotographic photoreceptor toward the direction opposite to a rotation direction of the electrophotographic photoreceptor to remove a residue on the surface of the electrophotographic photoreceptor; and a fixing unit that fixes the toner image transferred on the recording medium, wherein the toner particle contains a binder resin containing a crystalline polyester resin, a colorant, and a release agent, an average circularity of the toner particles is from 0.955 to 0.971, a content ratio of the toner particles having a particle diameter of 4.5 μm or more and less than 7.5 μm and a circularity of 0.980 or more is in a range of 16% by number to 40% by number, and a content ratio of the toner particles having a particle diameter of 7.5 μm or more and less than 15 μm and a circularity of 0.900 or more and less than 0.940 is 3% by number or less.

2. The image forming apparatus according to claim 1, wherein the overcoat layer is formed of a cured material of a composition which contains a compound having at least one group selected from the group consisting of an acryloyl group and a methacryloyl group.

3. The image forming apparatus according to claim 1, wherein the content ratio of the toner particles having a particle diameter of 4.5 μm or more and less than 7.5 μm and a circularity of 0.980 or more is in a range 16% by number to 30% by number.

4. The image forming apparatus according to claim 1, wherein the content ratio of the toner particles having a particle diameter of 4.5 μm or more and less than 7.5 μm and a circularity of 0.980 or more is in a range 16% by number to 25% by number.

5. The image forming apparatus according to claim 1, wherein a content ratio of the toner particles having a circularity of 0.900 or more and less than 0.950 is in a range of range of 5% by number to 15% by number with respect to the entirety of the toner particles, and a content ratio of the toner particles having a circularity of 0.950 to 1.000 is in a range of 75% by number to 85% by number with respect to the entirety of the toner particles.

6. The image forming apparatus according to claim 5, wherein the content ratio of the toner particles having a circularity of 0.900 or more and less than 0.950 is in a range of range of 10% by number to 15% by number with respect to the entirety of the toner particles.

7. The image forming apparatus according to claim 1, wherein a content of the crystalline polyester resin contained in the toner particles is in a range of 1% by weight to 10% by weight with respect to the entirety of the binder resin contained in the toner particles.

8. The image forming apparatus according to claim 1, wherein a rotational speed of the electrophotographic photoreceptor is 300 mm/s or more.

9. The image forming apparatus according to claim 1, wherein a fixing temperature provided by the fixing unit is in a range of 100° C. or more and less than 190° C.

* * * * *